US010813805B2

(12) United States Patent
Tsusaka et al.

(10) Patent No.: US 10,813,805 B2
(45) Date of Patent: Oct. 27, 2020

(54) STANDING-UP MOTION ASSIST SYSTEM, CONTROL METHOD FOR CONTROLLER OF STANDING-UP MOTION ASSIST SYSTEM, STORAGE MEDIUM, CARE BELT, AND ROBOT

(71) Applicant: Panasonic Intellectual Property Management Co., Ltd., Osaka (JP)

(72) Inventors: Yuko Tsusaka, Osaka (JP); Yudai Fudaba, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 948 days.

(21) Appl. No.: 15/414,577

(22) Filed: Jan. 24, 2017

(65) Prior Publication Data

US 2017/0128293 A1 May 11, 2017

Related U.S. Application Data

(63) Continuation of application No. PCT/JP2015/004064, filed on Aug. 17, 2015.

(30) Foreign Application Priority Data

Sep. 19, 2014 (JP) ..... 2014-190774
Mar. 30, 2015 (JP) ..... 2015-069538

(51) Int. Cl.
*A61G 5/14* (2006.01)
*A61G 7/10* (2006.01)
(Continued)

(52) U.S. Cl.
CPC ..... *A61G 5/14* (2013.01); *A61G 5/00* (2013.01); *A61G 7/10* (2013.01); *A61G 7/1017* (2013.01);
(Continued)

(58) Field of Classification Search
CPC ... A61G 7/0526; A61G 7/1017; A61G 7/1013
See application file for complete search history.

(56) References Cited

U.S. PATENT DOCUMENTS 2,439,163 A * 4/1948 Farmer ..... A61G 7/053 5/86.1
4,204,529 A * 5/1980 Cochrane ..... A61F 5/3707 602/19
(Continued)

FOREIGN PATENT DOCUMENTS

JP 7-015032 U 3/1995
JP 9-000570 1/1997
(Continued)

OTHER PUBLICATIONS

International Search Report of PCT application No. PCT/JP2015/004064 dated Nov. 2, 2015.

*Primary Examiner* — Eric J Kurilla
(74) *Attorney, Agent, or Firm* — Wenderoth, Lind & Ponack, L.L.P.

(57) ABSTRACT

In a standing-up motion assist system for assisting a care receiving person, a care belt includes a first holder that holds a neck part or a back part of the care receiving person, a second holder that holds a lumbar part of the care receiving person, a third holder that connects the first holder and the second holder and holds armpits of the care receiving person, a second connector located at a chest of the care receiving person, and a first connector that connects the first holder and the second holder. A pulling mechanism is connected to the second connector and pulls the second connector. A controller controls the pulling mechanism so as to pull the second connector in a forward and upward direction with reference to the care receiving person, and,
(Continued)

thereafter, pull the second connector in a backward and upward direction with reference to the care receiving person.

11 Claims, 48 Drawing Sheets

(51) Int. Cl.
*A61G 5/00* (2006.01)
*A61H 3/04* (2006.01)

(52) U.S. Cl.
CPC ..... *A61G 7/1046* (2013.01); *A61G 7/1051* (2013.01); *A61G 7/1061* (2013.01); *A61G 7/1086* (2013.01); *A61H 3/04* (2013.01); *A61H 2003/043* (2013.01); *A61H 2003/046* (2013.01); *A61H 2201/0188* (2013.01); *A61H 2201/0192* (2013.01); *A61H 2201/165* (2013.01); *A61H 2201/1619* (2013.01); *A61H 2201/1635* (2013.01)

(56) References Cited

U.S. PATENT DOCUMENTS 5,001,789 A * 3/1991 Schoenberger ..... A61G 7/1017 5/87.1
5,022,106 A * 6/1991 Richards ..... A61G 7/1017 4/254
5,530,976 A * 7/1996 Horcher ..... A61G 7/1015 182/3
5,644,805 A * 7/1997 Horcher ..... A61G 7/1015 5/86.1
5,878,450 A * 3/1999 Bouhuijs ..... A61G 7/1017 5/83.1
6,122,778 A * 9/2000 Cohen ..... A62B 35/0006 182/3
6,389,619 B1 * 5/2002 Dunn ..... A61G 7/1017 5/81.1 R
7,003,820 B1 * 2/2006 Iura ..... A61G 5/128 5/83.1
7,392,554 B1 * 7/2008 Su ..... A61G 7/1017 5/86.1
7,627,912 B1 * 12/2009 McKinney ..... A61G 7/1011 5/81.1 R
8,621,684 B2 * 1/2014 Okumatsu ..... A61G 7/1017 5/81.1 R
8,650,677 B2 * 2/2014 Altena ..... A61G 5/14 5/81.1 R
9,844,481 B2 * 12/2017 Tsusaka ..... A61G 7/10
10,076,845 B2 * 9/2018 Tsusaka ..... A61G 7/1017
2005/0217024 A1 * 10/2005 Aarestad ..... A61G 7/1015 5/86.1
2008/0028516 A1 2/2008 Morishima
2010/0154117 A1 * 6/2010 Odashima ..... A61G 7/1017 5/87.1
2010/0162483 A1 * 7/2010 Biersteker ..... A61G 7/1017 5/87.1
2011/0037285 A1 * 2/2011 Gil Vizuete ..... A61G 7/1023 294/140
2011/0056019 A1 * 3/2011 Altena ..... A61G 5/14 5/87.1
2011/0083267 A1 * 4/2011 Gibson ..... A61G 5/14 5/87.1
2011/0270443 A1 11/2011 Kamiya et al.
2011/0277235 A1 * 11/2011 Okumatsu ..... A61G 7/1017 5/83.1
2012/0174314 A1 * 7/2012 Clement ..... A61G 7/10 5/81.1 R
2012/0255118 A1 * 10/2012 Hammond ..... A61G 7/1017 5/86.1
2013/0110015 A1 * 5/2013 Ota ..... A61G 7/1048 601/24
2013/0219615 A1 * 8/2013 Eklof ..... A61G 7/1017 5/83.1
2013/0263374 A1 * 10/2013 Yamaguchi ..... A61G 7/1017 5/87.1
2015/0190293 A1 * 7/2015 Hacikadiroglu ..... A61G 5/14 5/87.1
2017/0014290 A1 * 1/2017 Tsusaka ..... A61G 7/10
2017/0035631 A1 * 2/2017 Tsusaka ..... B25J 19/06
2017/0128292 A1 * 5/2017 Tsusaka ..... A61G 7/1073
2017/0128293 A1 * 5/2017 Tsusaka ..... A61G 5/00
2017/0128299 A1 * 5/2017 Tsusaka ..... B25J 13/00
2017/0157773 A1 * 6/2017 Tsusaka ..... A61G 7/1017
2017/0216119 A1 * 8/2017 Tsusaka ..... A61G 7/1017
2017/0216120 A1 * 8/2017 Tsusaka ..... A61G 7/1017

FOREIGN PATENT DOCUMENTS

JP 2002-336310 11/2002
JP 2004-089227 3/2004
JP 2004-194780 7/2004
JP 2005-312600 11/2005
JP 2008-036100 2/2008
JP 2008-067849 3/2008
JP 2010-246635 11/2010
JP 2011-019571 2/2011
JP 2013-078601 5/2013
JP 2013-158386 8/2013
WO WO-2009126040 A2 * 10/2009 ..... A61G 7/1017

* cited by examiner

FIG. 5A

| TIME (msec) | POSITION (m) |
|---|---|
| t0 | p0 |
| t1 | p1 |
| .. | .. |
| t10 | p10 |
| t11 | p11 |
| ⋮ | ⋮ |

FIG. 5B

| TIME | POSITION |
|---|---|
| t0 | p0(X0,Z0) |
| t1 | p1(X1,Z1) |
| .. | .. |
| t28 | p28(X28,Z28) |
| t29 | p29(X29,Z29) |
| t30 | p30(X30,Z30) |
| t31 | p31(X31,Z31) |
| t32 | p32(X32,Z32) |
| .. | .. |
| t50 | p50(X50,Z50) |
| t51 | p51(X51,Z51) |
| .. | .. |

FIG. 10

| TIME (msec) | POSITION (m) | FORCE (N) |
|---|---|---|
| t0 | p0 | f0 |
| t1 | p1 | f1 |
| .. | .. | .. |
| t10 | p10 | f10 |
| t11 | p11 | f11 |
| ⋮ | ⋮ | ⋮ |

STANDING-UP MOTION ASSIST SYSTEM, CONTROL METHOD FOR CONTROLLER OF STANDING-UP MOTION ASSIST SYSTEM, STORAGE MEDIUM, CARE BELT, AND ROBOT

BACKGROUND

1. Technical Field

The present disclosure relates to a standing-up motion assist system that assists a care receiving person to stand up from a sitting position, a control method for a controller of a standing-up motion assist system, a storage medium, a care belt, and a robot.

2. Description of the Related Art

It is known to configure a standing-up motion assist robot such that a trajectory of standing-up motion from a starting point to an ending point is set for each specific care receiving person, and the assist is performed according to the set trajectory such that the standing-up motion precisely starts from the starting point and precisely ends at the the ending point. This standing-up motion assist robot is designed in view that, to ensure safety for the care receiving person, it is important to precisely achieve the starting point (corresponding to, for example, a sitting position of the care receiving person) and the ending point (corresponding to, for example, a standing-up position of the care receiving person) of the trajectory (see Japanese Unexamined Patent Application Publication No. 2013-158386). It is also known to configure a standing-up assist apparatus so as to be capable of wrapping a lower part of the body including buttocks of a care receiving person in a sling and lifting the care receiving person upward with the sling (see Japanese Unexamined Patent Application Publication No. 2010-246635).

SUMMARY

One non-limiting and exemplary embodiment provides a technique of achieving an improvement in assist of a care receiving person.

In one general aspect, the techniques disclosed here feature a standing-up motion assist system that assists a standing-up motion of a care receiving person, the standing-up motion assist system including a care belt including a first holder that holds a neck part or a back part of the care receiving person, a second holder that holds a lumbar part of the care receiving person, a third holder that connects the first holder and the second holder and holds armpits of the care receiving person, and a first connector that includes a second connector located at a chest of the care receiving person and that connects, in front of the care receiving person, the first holder and the second holder, a pulling mechanism that is connected to the second connector and that pulls the second connector, and a controller that controls the pulling mechanism such that the pulling mechanism pulls the second connector in a forward and upward direction with reference to the care receiving person, and, thereafter, the pulling mechanism pulls the second connector in a backward and upward direction with reference to the care receiving person.

According to aspects of the present disclosure, it is possible to realize an improvement in assisting a care receiving person.

It should be noted that general or specific embodiments may be implemented as a system, a method, an integrated circuit, a computer program, a storage medium, or any selective combination thereof. The computer-readable storage medium may be a non-volatile storage medium, for example, a CD-ROM (Compact Disc-Read Only Memory) or the like.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF THE DRAWINGS

FIG. 5A is a diagram illustrating details of an operation information database according to the first embodiment of the present disclosure;

FIG. 5B is a diagram illustrating details of an operation information database according to a modification of the present disclosure;

FIG. 10 is a diagram illustrating details of an operation information database according to the second embodiment of the present disclosure;

DETAILED DESCRIPTION

Figure 1A:
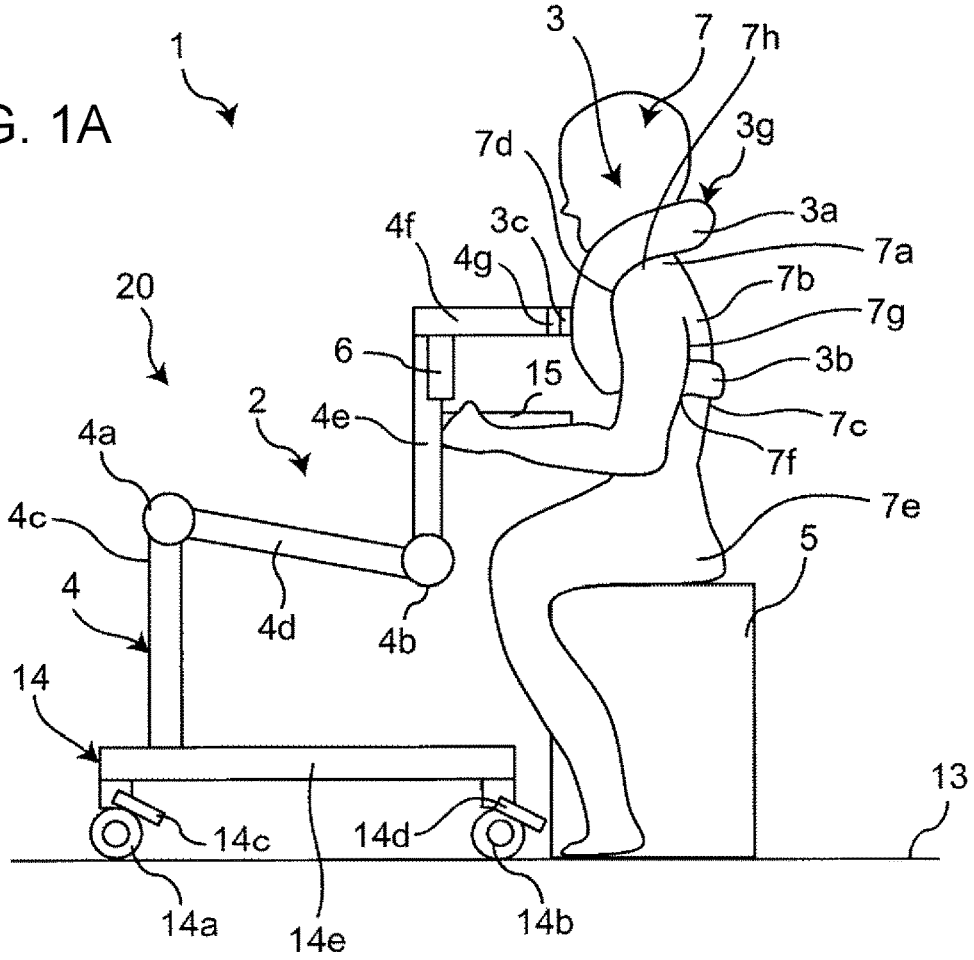
FIG. 1A is a side view schematically illustrating a configuration of a robot of a robot system which is an example of a standing-up motion assist system (that is, a standing-up operation assist apparatus) according to a first embodiment of the present disclosure, in which a care receiving person is also illustrated.

Embodiments of the present disclosure are described below with reference to drawings.

Before the embodiments of the present disclosure are described in detail below with reference to drawings, various aspects of the present disclosure are described.

In a first aspect of the present disclosure, a standing-up motion assist system, that assists a standing-up motion of a care receiving person, includes a care belt including a first holder that holds a neck part or a back part of the care receiving person, a second holder that holds a lumbar part of the care receiving person, a third holder that connects the first holder and the second holder and holds armpits of the care receiving person, and a first connector that includes a second connector located at a chest of the care receiving person and that connects, in front of the care receiving person, the first holder and the second holder, a pulling mechanism that is connected to the second connector and that pulls the second connector, and a controller that controls the pulling mechanism such that the pulling mechanism pulls the second connector in a forward and upward direction with reference to the care receiving person, and, thereafter, the pulling mechanism pulls the second connector in a backward and upward direction with reference to the care receiving person.

The aspect described above makes it possible to provide a standing-up motion assist system capable of assisting a standing-up motion such that in an initial state of the standing-up motion (that is, when buttocks are moved away from a sitting position), a care receiving person leans forward as slightly as possible thereby allowing the standing-up motion to be performed in a similar manner to an operation of a normal adult person.

In a standing-up motion assist system according to a second aspect of the present disclosure, based on the first aspect described above, the controller controls the pulling mechanism such that the pulling speed of the pulling mechanism is increased when the pulling mechanism is pulling the second connector in the forward and upward direction with reference to the care receiving person.

This second aspect provides the standing-up motion assist system capable of assisting the standing-up motion such that in the initial state of the standing-up motion, the care receiving person leans forward as slightly as possible thereby urging the buttocks to be moved away from the sitting position.

In a standing-up motion assist system according to a third aspect of the present disclosure, based on the first or second aspect described above, the first holder holds the neck part, the chest, and the sides of the torso in a direction from the back to the front of the body of the care receiving person, and the second holder holds the back part via the sides of the torso.

In this third aspect, when the control apparatus controls the operation of the pulling mechanism connected to the second connector, controlled force can be easily transferred directly to the care receiving person even in a situation in which a shoulder has a problem.

In a standing-up motion assist system according to a fourth aspect of the present disclosure, based on the first or second aspect described above, the first holder holds the neck part, the chest, and the sides of the torso in a direction from the back to the front of the body of the care receiving person, and the second holder holds the back part via the sides of the torso.

In this fourth aspect, when the control apparatus controls the operation of the pulling mechanism connected to the second connector, controlled force can be easily transferred directly to the care receiving person even in a situation in which a neck part has a problem.

In a standing-up motion assist system according to a fifth aspect of the present disclosure, based on one of the first to fourth aspects described above, the pulling mechanism includes a walking mechanism including a pair of front wheels and a pair of back wheels.

This fifth aspect makes it possible for the care receiving person to start walking immediately after the care receiving person stands up from the sitting position to the standing-up position with the assist of the arm mechanism.

In a standing-up motion assist system according to a sixth aspect of the present disclosure, based on one of the first to fifth aspects described above, the pulling mechanism includes an arm mechanism including a plurality of joints, and the standing-up motion assist system further includes a force acquirer that acquires information about a force applied to the arm mechanism from the outside, a position acquirer that acquires information about a position of the arm mechanism, and an operation information generator that generates operation information about the arm mechanism from the information about the force acquired by the force acquirer and the information about the position acquired by the position acquirer, wherein the controller controls an operation of the arm mechanism based on the operation information generated by the operation information generator.

The sixth aspect makes it possible to provide the standing-up motion assist system capable of assisting the standing-up motion such that in the initial state of the standing-up motion, the care receiving person leans forward as slightly as possible regardless of the height of the care receiving person and regardless of the muscle strength of the lower part of the body or the upper part of the body of the care receiving person himself/herself thereby allowing the standing-up motion to be performed in a similar manner to an operation of a normal adult person.

In a standing-up motion assist system according to a seventh aspect of the present disclosure, based on sixth aspect described above, the operation information generator generates operation information such that when the controller is controlling the pulling mechanism so as to pull the second connector in a forward and upward direction with reference to the care receiving person, the operation information generator calculates the difference between a first force at a first time acquired by the force acquirer and a second force at a second time acquired by the force acquirer earlier than the first time, and in a case where the absolute value of the force, acquired by the force acquirer after the sign of the difference between the first force and the second force is inverted, is equal to or greater than a threshold value, the operation information generator generates operation information that causes the pulling speed, at which the arm mechanism pulls the second connector in the upward direction, to be increased compared to the speed as of when the sign of the difference is not yet inverted.

In a standing-up motion assist system according to an eighth aspect of the present disclosure, based on sixth aspect described above, the operation information generator generates operation information such that when the controller is controlling the pulling mechanism so as to pull the second connector in a forward and upward direction with reference to the care receiving person, the operation information generator calculates the difference between a first force at a first time acquired by the force acquirer and a second force at a second time acquired by the force acquirer earlier than the first time, and the operation information generator generates operation information that causes the pulling speed, at which the arm mechanism pulls the second connector in the upward direction, to be increased as the absolute value of the force, acquired by the force acquirer after the sign of the difference between the first force and the second force is inverted, increases.

In the seventh or eighth aspect, it is possible to automatically generate operation information regardless of a difference in timing of moving the buttocks away from the sheet depending on the height of the care receiving person and/or the muscle strength of the lower part of the body or the upper part of the body of the care receiving person.

In a standing-up motion assist system according to a ninth aspect of the present disclosure, based on one of the first to eighth aspects described above, one of the pulling mechanism and the second connector includes a buckle, and the other one of the pulling mechanism and the second connector includes a buckle receiver, wherein the buckle and the buckle receiver are removably connected to each other.

In the ninth aspect, when the care receiving person wearing the care belt reaches a destination such as a toilet or the like using the standing-up motion assist system, it is allowed to easily remove the care belt from the pulling mechanism.

In a tenth aspect of the present disclosure, there is provided a method of controlling a controller of a standing-up motion assist system, the standing-up motion assist system including a care belt including a first holder that holds a neck part or a back part of a care receiving person, a second holder that holds a lumbar part of the care receiving person, a third holder that connects the first holder and the second holder and holds armpits of the care receiving person, and a first connector that includes a second connector located at a chest of the care receiving person and that connects, in front of the care receiving person, the first holder and the second holder, a pulling mechanism that is connected to the second connector and that pulls the second connector, and the controller that controls the pulling operation of the pulling mechanism, the control method including causing the controller to control the pulling mechanism to pull the second connector in a forward and upward direction with reference to the care receiving person, and thereafter causing the controller to control the pulling mechanism to pull the second connector in a backward and upward direction with reference to the care receiving person.

This tenth aspect makes it possible to provide the standing-up motion assist system capable of assisting the standing-up motion such that in the initial state of the standing-up motion (that is, when the buttocks are removed away from the sitting position), the care receiving person leans forward as slightly as possible thereby allowing the standing-up motion to be performed in a similar manner to an operation of a normal adult person.

An eleventh aspect of the present disclosure, there is provided a non-transitory computer-readable recording medium storing a program for a controller of a standing-up motion assist system, the standing-up motion assist system including a care belt including a first holder that holds a neck part or a back part of a care receiving person, a second holder that holds a lumbar part of the care receiving person, a third holder that connects the first holder and the second holder and holds armpits of the care receiving person, and a first connector that includes a second connector located at a chest of the care receiving person and that connects, in front of the care receiving person, the first holder and the second holder, a pulling mechanism that is connected to the second connector and that pulls the second connector, the controller that controls the pulling operation of the pulling mechanism, the program including causing the controller to control the pulling mechanism to pull the second connector in a forward and upward direction with reference to the care receiving person, and thereafter causing the controller to control the pulling mechanism to pull the second connector in a backward and upward direction with reference to the care receiving person.

This eleventh aspect makes it possible to provide the standing-up motion assist system capable of assisting the standing-up motion such that in the initial state of the standing-up motion (that is, when the buttocks are removed away from the sitting position), the care receiving person leans forward as slightly as possible regardless of the height of the care receiving person and/or regardless of the muscle strength of the lower part of the body or the upper part of the body of the care receiving person himself/herself thereby allowing the standing-up motion to be performed in a similar manner to an operation of a normal adult person.

In a twelfth aspect of the present disclosure, a robot includes an arm mechanism that is connected to a connector included in a supporter worn by a user and that moves the connector in a direction along an x-axis and/or in a direction along a z-axis, a controller that controls the arm mechanism based on data stored in an operation information database in terms of one or more times and one or more target coordinate values at the respective times, wherein the time and the target coordinate value have a one-to-one correspondence, each target coordinate value indicates a target position associated with the arm mechanism at a corresponding time, the x-axis and the z-axis are parallel to a virtual plane in which an arm included in the arm mechanism operates, the x-axis and the z-axis are perpendicular to each other, and the z-axis is perpendicular to a surface on which the robot is installed, the z-axis is defined so as to be positive in a direction toward the robot from the surface on which the robot is installed, the x-axis is defined so as to be positive in a direction from a leading end of the arm mechanism toward the connector, a z-axis coordinate value of the target coordinate value increases when the time is in a range of t1 to t3, an x-axis coordinate value of the target coordinate value decreases when the time is in a range of t1 to t2, an x-axis coordinate value of the target coordinate value increases when the time is in a range of t2 to t3, and $t1<t2<t3$.

In a thirteenth aspect of the present disclosure, based on the twelfth aspect described above, the supporter includes a left shoulder part including a part extending along a left shoulder of the user wearing the supporter, a right shoulder part including a part extending along a right shoulder of the user wearing the supporter, a left lumbar part including a part extending along a left lumbar of the user wearing the supporter, a right lumbar part including a part extending along a right lumbar of the user wearing the supporter, a connection region connected to the left shoulder part, the right shoulder part, the left lumbar part, and the right lumbar part, and including a part extending along a back of the user wearing the supporter, and the connector, the connector connected to the left shoulder part, the right shoulder part, the left lumbar part, and the right lumbar part, wherein when the user wears the supporter, the user is located between the connector and the connection region.

Underlying Knowledge Forming Basis of the Present Disclosure

Figure 18A:
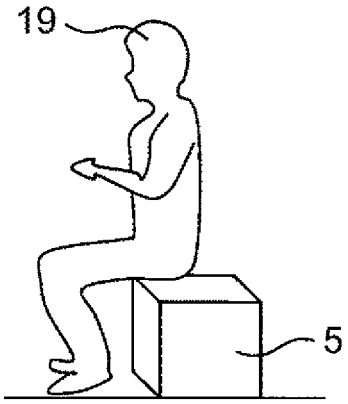
FIG. 18A is a diagram illustrating a standing-up operation of a normal adult person.
Figure 18B:
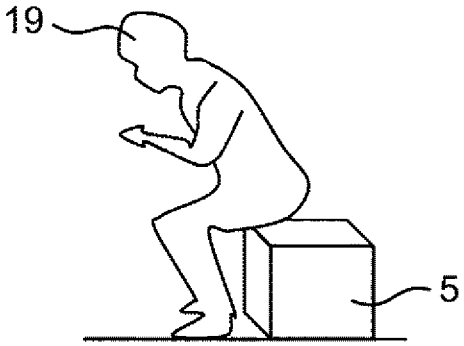
FIG. 18B is a diagram illustrating a standing-up operation of a normal adult person.

FIG. 18A to FIG. 18F illustrate a manner in which a normal adult person 19 sitting on a sheet 5 stands up from a sitting position to a standing-up position. As illustrated in FIG. 18A and FIG. 18B, in the sitting position, the normal adult person 19 leans his/her upper body forward such that the barycenter moves forward.

Figure 18C:
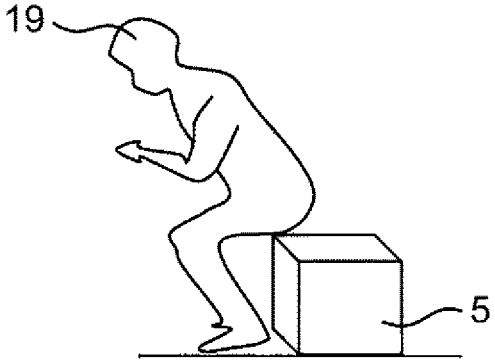
FIG. 18C is a diagram illustrating a standing-up operation of a normal adult person.
Figure 18D:
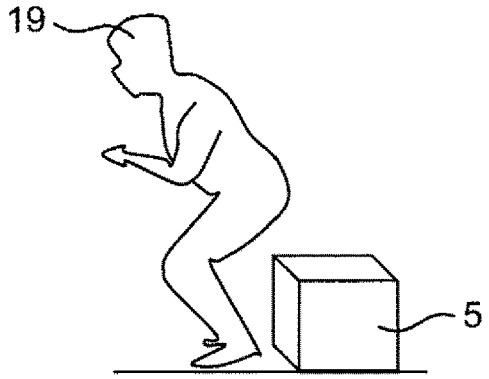
FIG. 18D is a diagram illustrating a standing-up operation of a normal adult person.
Figure 18E:
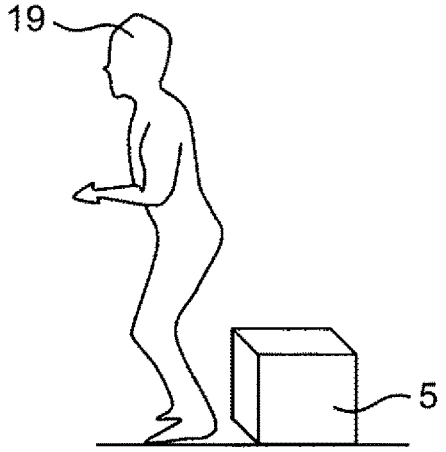
FIG. 18E is a diagram illustrating a standing-up operation of a normal adult person.
Figure 18F:
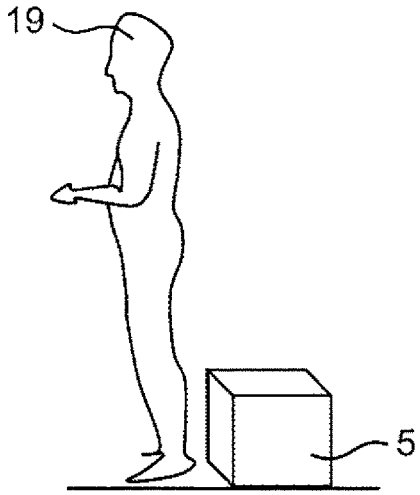
FIG. 18F is a diagram illustrating a standing-up operation of a normal adult person.

Next, as illustrated in FIG. 18C, the normal adult person 19 moves his/her buttocks away from the sheet 5. After the buttocks are moved away from the sheet 5, as illustrated in FIG. 18D to FIG. 18F, the normal adult person 19 expands his/her knees thereby getting back the barycenter in the backward until reaching the standing-up position.

Figure 17A:
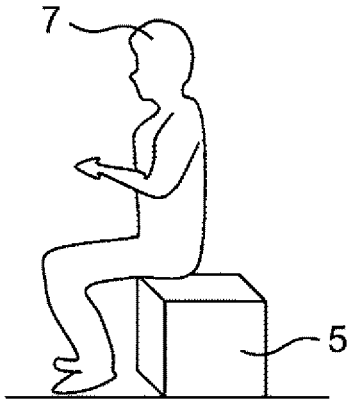
FIG. 17A is a diagram illustrating a standing-up operation of an elderly person.
Figure 17B:
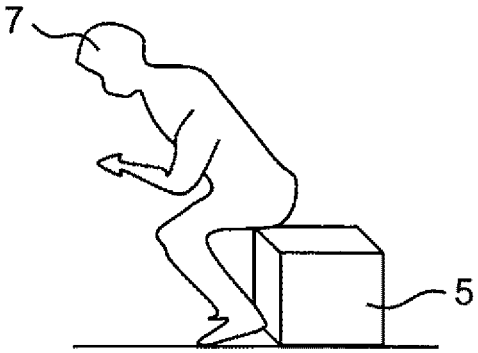
FIG. 17B is a diagram illustrating a standing-up operation of an elderly person.
Figure 17C:
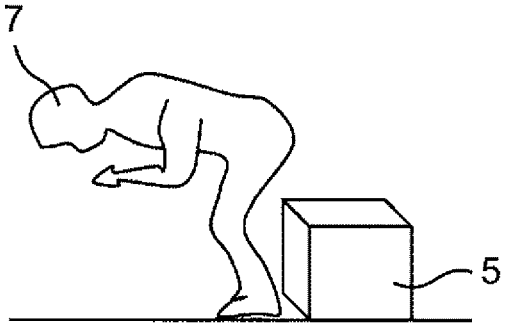
FIG. 17C is a diagram illustrating a standing-up operation of an elderly person.

Many care receiving persons moves slowly because they have week muscle strength. Therefore, in an initial standing-up operation phase (that is, when the care receiving person 7 moves his/her buttocks from the sitting position), the care receiving person 7 needs to deeply lean forward such that the barycenter moves forward as illustrated in FIG. 17B and FIG. 17C.

Therefore, in a manual mode disclosed in Japanese Unexamined Patent Application Publication No. 2013-158386, when the moving speed of the supporting part is set to be low to adapt to the motion of the care receiving person 7, if the forward leaning position is not deep enough in the trajectory, it is difficult to move the buttocks away from the sheet. Conversely, when the forward leaning position is deep in the trajectory, it is possible to move the buttocks away from the sheet, but the trajectory has a long distance until the standing-up position is reached. Besides, a half-leaning position is taken for a long period after the buttocks are moved away from the sheet, and thus a large load is imposed on the lower part of the body of the care receiving person 7. Furthermore, in the case where the forward leaning position is deep, the glance is mostly directed toward the ground, and a change in glance, for example, toward the front occurs during the process of standing-up operation, which may cause the care receiving person 7 to feel dizzy or the like.

The inventors of the present invention have realized that it is advantageous to assist a care receiving person to stand up such that in an initial phase of the standing-up motion (that is, when buttocks are moved away from a sitting position), a care receiving person leans forward as slightly as possible thereby allowing the standing-up motion to be performed in a similar manner to an operation of a normal adult person.

The inventors of the present invention have also realized that the standing-up motion assist robot disclosed in Japanese Unexamined Patent Application Publication No. 2013-158386 has a large moving range, and it is necessary to support almost all weight of a care receiving person, and thus this standing-up motion assist robot has a problem that it has a large size and a heavy weight.

In view of the above, the inventors have got a technical idea that a first region of a neck part or a back part of a care receiving person and a second region of a lumbar part of the care receiving person may be held by a holding mechanism, and the holding mechanism may be pulled by a pulling mechanism such that in an initial state of the standing-up motion (that is, when buttocks are moved away from a sitting position), the care receiving person leans forward as slightly as possible thereby allowing the standing-up motion to be performed in a similar manner to an operation of a normal adult person. This also makes it possible to achieve a small size and a light weight for the apparatus.

Figure 6A:
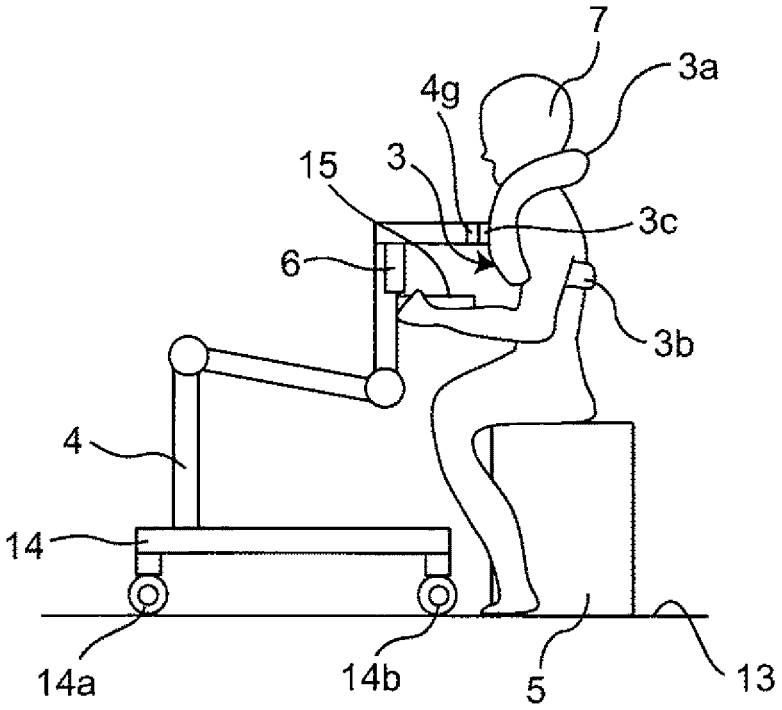
FIG. 6A is a diagram illustrating an operation of the robot system according to the first embodiment of the present disclosure.
Figure 6B:
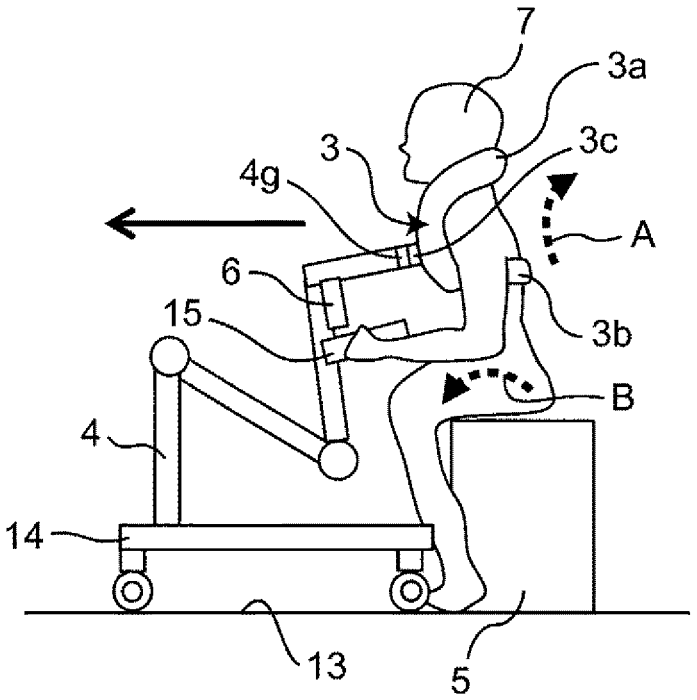
FIG. 6B is a diagram illustrating an operation of the robot system according to the first embodiment of the present disclosure.
Figure 6C:
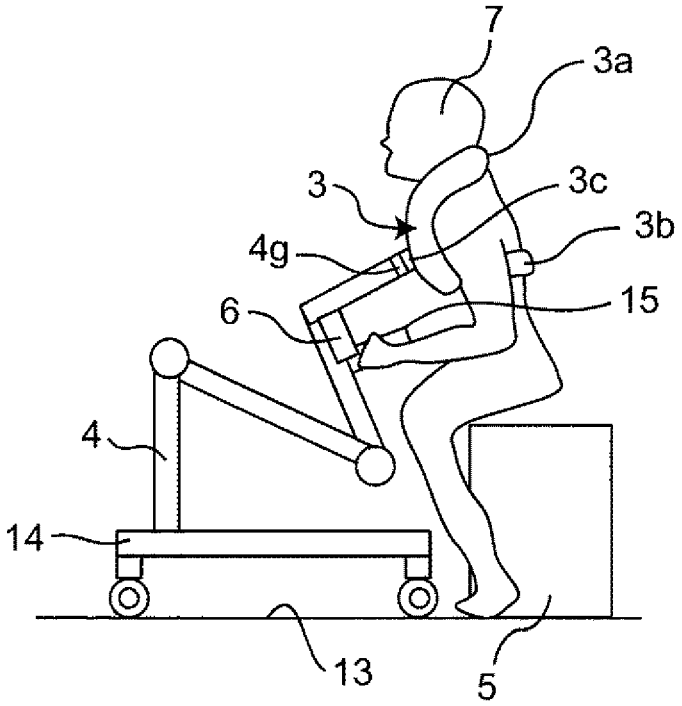
FIG. 6C is a diagram illustrating an operation of the robot system according to the first embodiment of the present disclosure.
Figure 23A:
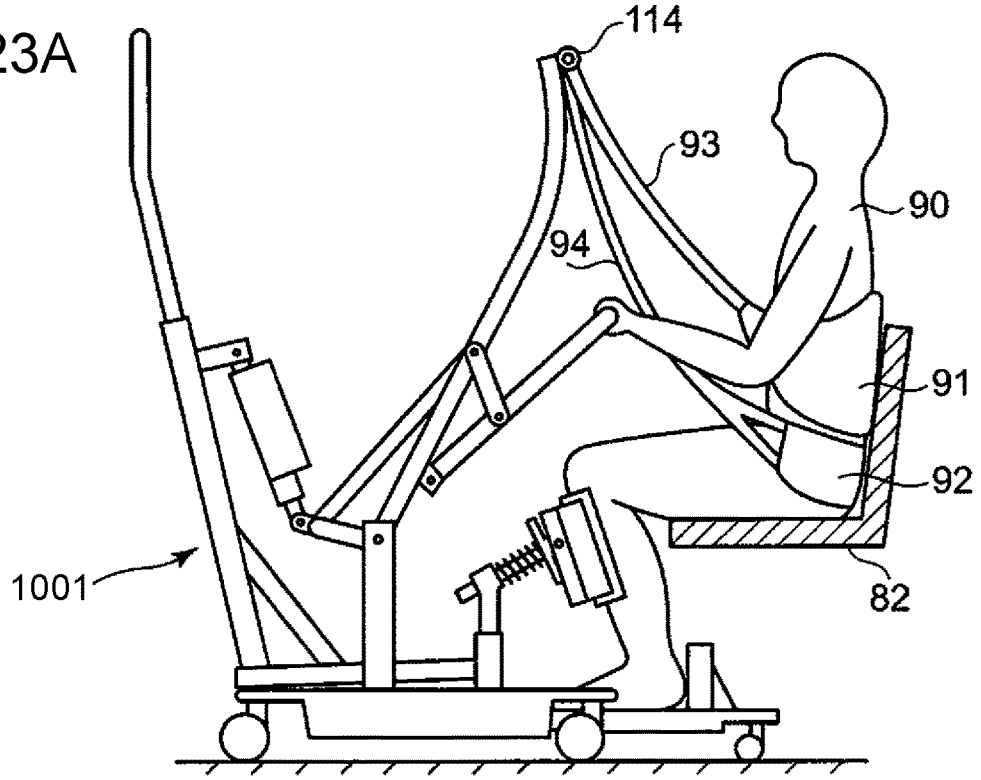
FIG. 23A is a diagram illustrating an operation of a robot system disclosed in Japanese Unexamined Patent Application Publication No. 2010-246635, corresponding to FIG. 6A illustrating the operation of the robot system according to the first embodiment of the present disclosure.
Figure 23B:
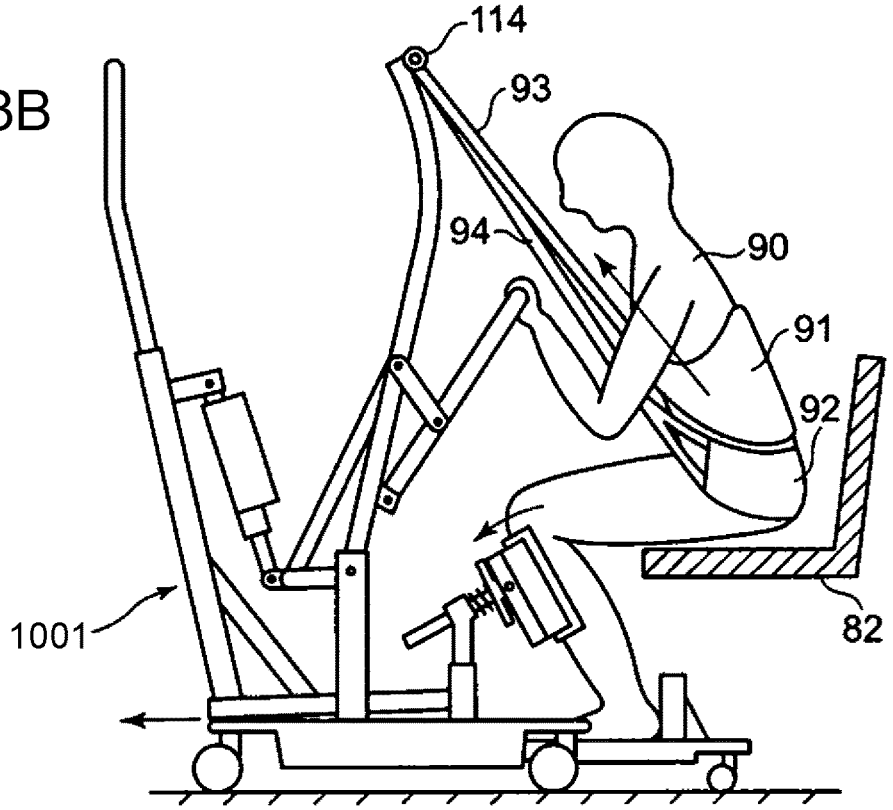
FIG. 23B is a diagram illustrating an operation of the robot system disclosed in Japanese Unexamined Patent Application Publication No. 2010-246635, corresponding to FIG. 6B.
Figure 23C:
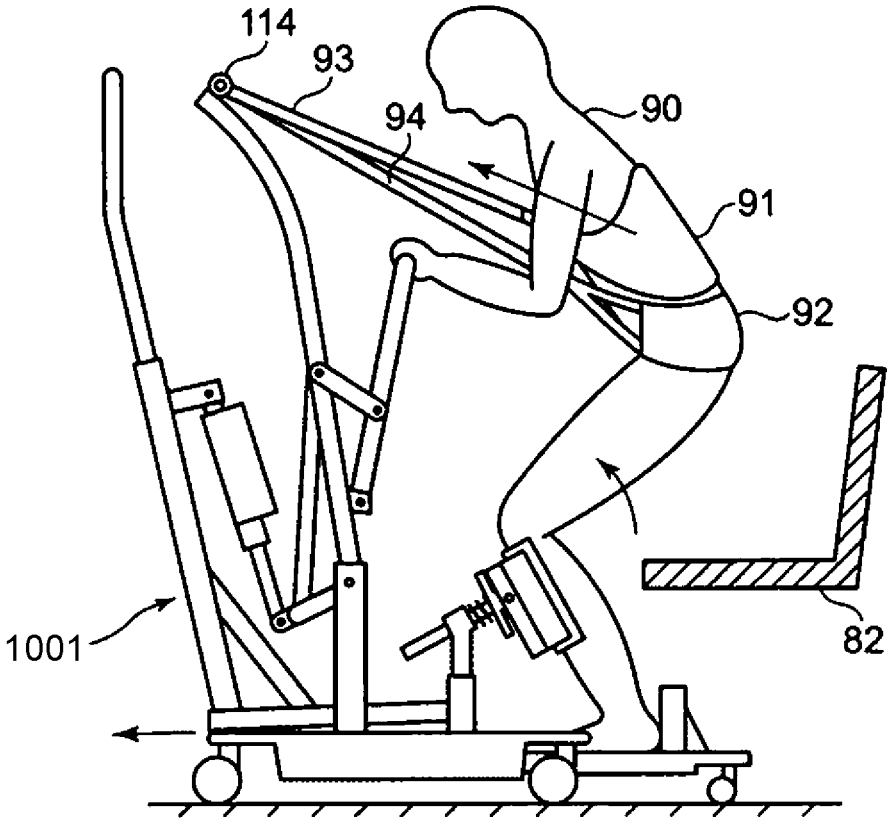
FIG. 23C is a diagram illustrating an operation of the robot system disclosed in Japanese Unexamined Patent Application Publication No. 2010-246635, corresponding to FIG. 6C.

FIG. 23A to FIG. 23C are diagrams illustrating an operation of a robot system disclosed in Japanese Unexamined Patent Application Publication No. 2010-246635, corresponding to FIG. 6A to FIG. 6C illustrating the operation of the robot system according to a first embodiment of the present disclosure.

In a standing-up assist apparatus disclosed in Japanese Unexamined Patent Application Publication No. 2010-246635, as illustrated in FIG. 23A, belts 93 and 94 extending from waring parts (slings) 91 and 92 which are worn on a body of a care receiving person 90 are connected to a pulling mechanism 1001 via a ring 114 serving as a connector such that the belts 93 and 94 each have a large length so as to slacken. That is, the ring 114 functions as the connector between the belts 93 and 94 and the wearing parts 91 and 92 is not located close to a chest 7*d* of the care receiving person 7 but located at a position far above and far forward away from the chest 7*d*, and the belts 93 and 94 have slack between the ring 114 and the wearing parts 91 and 92. As a result, force transmitted from the ring 114 to the belts 93 and 94 is not efficiently transmitted to the wearing parts 91 and 92 from the belts 93 and 94. In particular, a significant reduction occurs in force transmitted to the upper wearing part 91, which makes it difficult to urge the care receiving person 7 to bend back his/her upper part of the body as represented in FIG. 6B by a dashed-line arrow A curved in a clockwise direction.

Therefore, as illustrated in FIG. 23B, when the care receiving person 90 stands up from the sheet 82, the standing-up assist apparatus disclosed in Japanese Unexamined Patent Application Publication No. 2010-246635 does not urge the care receiving person 90 to bend his/her upper part of the body backward, and thus, in the standing-up motion, the caregiver 90 is forced to be pulled up in a forward and upward direction in a state in which the back of the caregiver 90 is rounded. Thus, when the care receiving person 90 is assisted by the standing-up assist apparatus disclosed in Japanese Unexamined Patent Application Publication No. 2010-246635, the care receiving person 90 may have a difficulty in standing up.

Furthermore, the wearing parts 91 and 92 do not hold the front part of the body of the care receiving person 7, and thus there is a possibility that the wearing parts 91 and 92 move off the upper part of the body of the care receiving person 7, which may cause the care receiving person 7 to fall down and forward.

The embodiments of the present disclosure described below handle the situations described above.

The standing-up motion assist system and other related matters according to the embodiments of the present disclosure are described in detail below.

First Embodiment

Figure 1B:
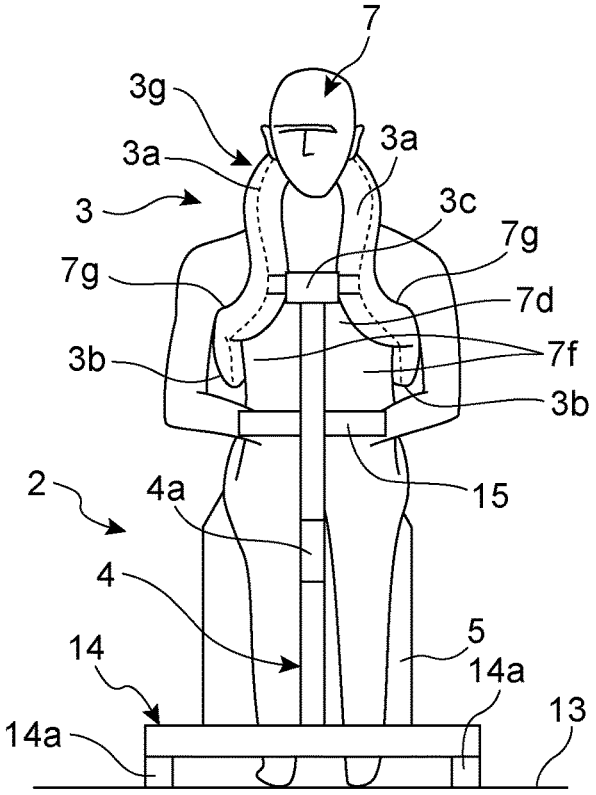
FIG. 1B is a front view schematically illustrating a configuration of the robot and a care receiving person in the robot system in a state in which the care receiving person is in a sitting position according to the first embodiment of the present disclosure.
Figure 1C:
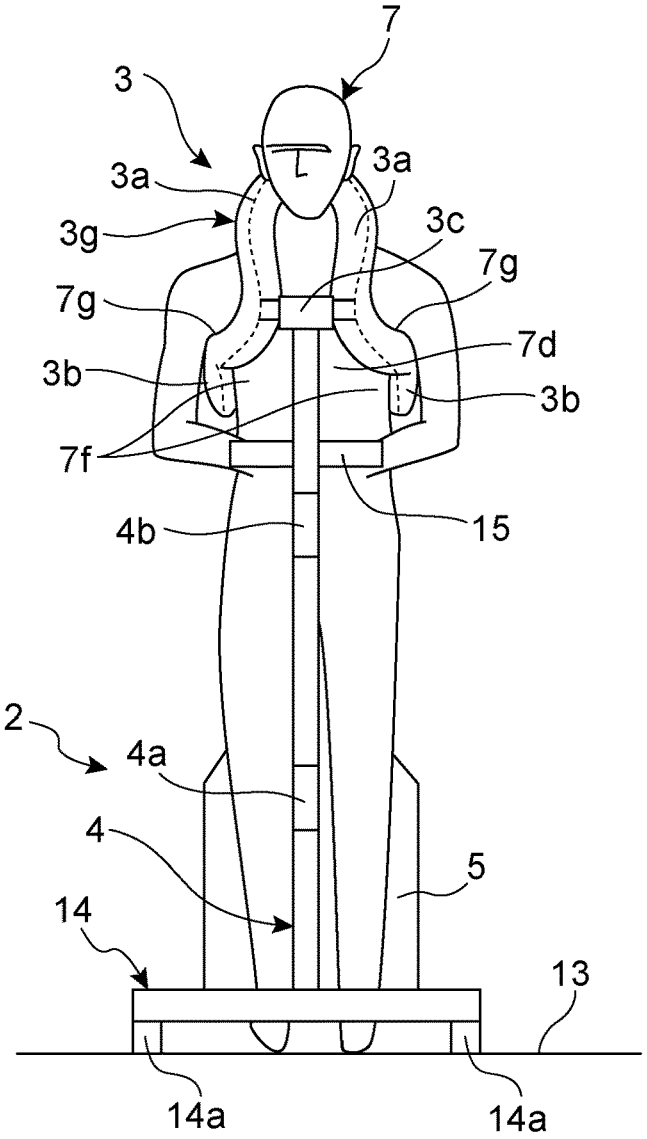
FIG. 1C is a front view schematically illustrating a configuration of the robot and a care receiving person in the robot system in a state in which the posture of the care receiving person has reached a standing-up position according to the first embodiment of the present disclosure.
Figure 1D:
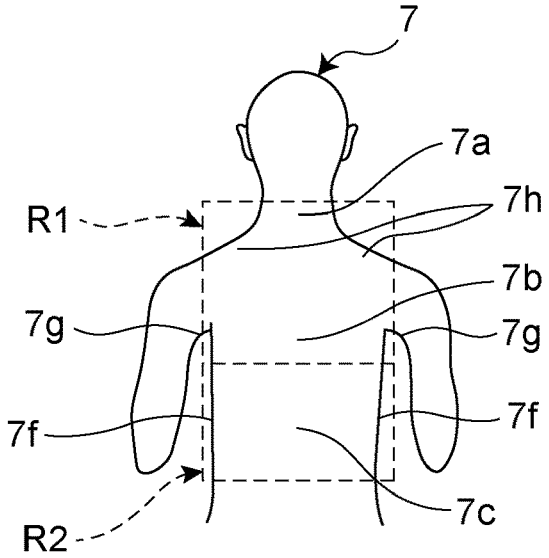
FIG. 1D is a diagram illustrating a positional relationship between a care belt of the robot system and a body of a care receiving person according to the first embodiment of the present disclosure.
Figure 2:
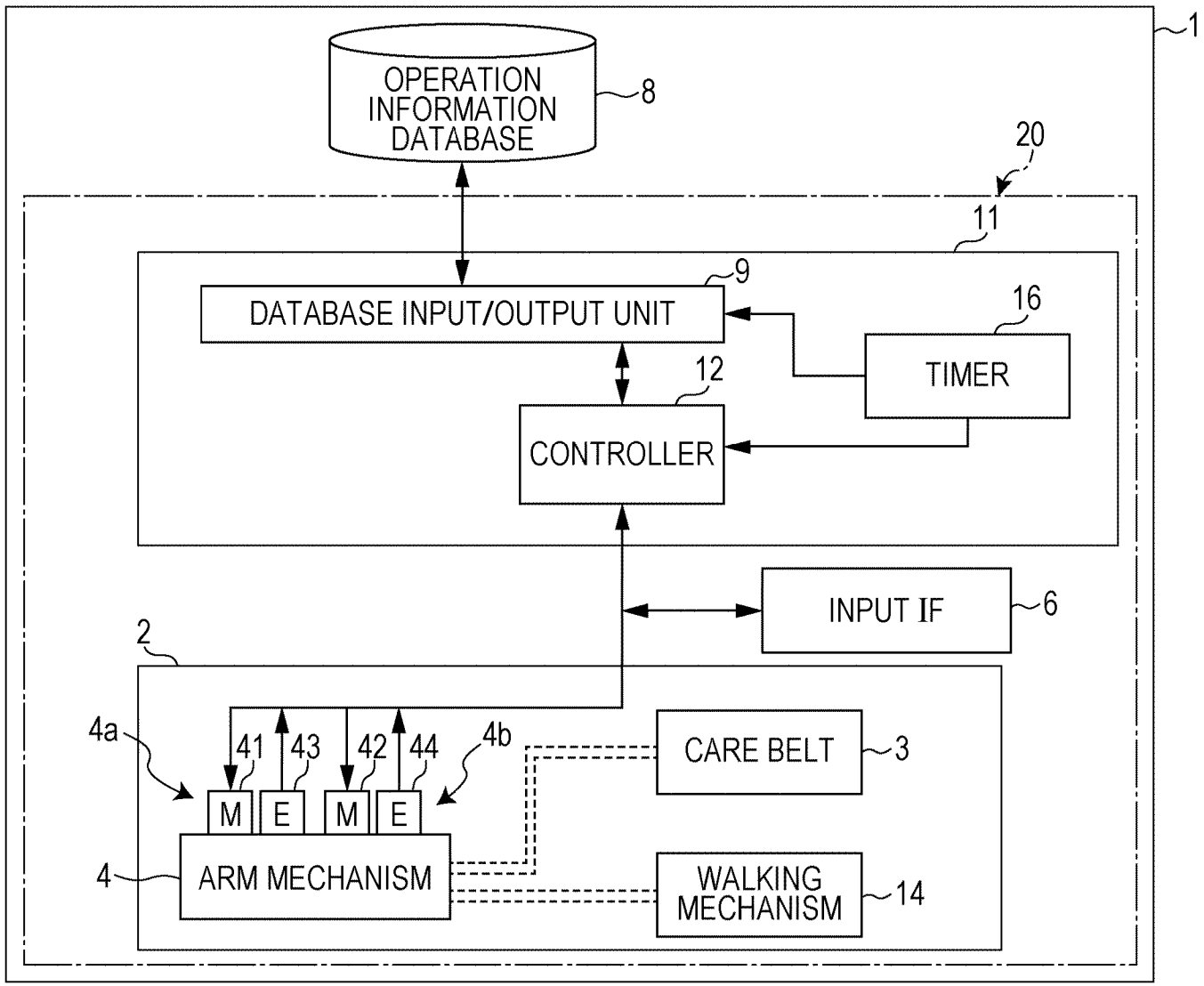
FIG. 2 is a block diagram illustrating a detailed configuration of the robot system according to the first embodiment of the present disclosure.
Figure 3A:
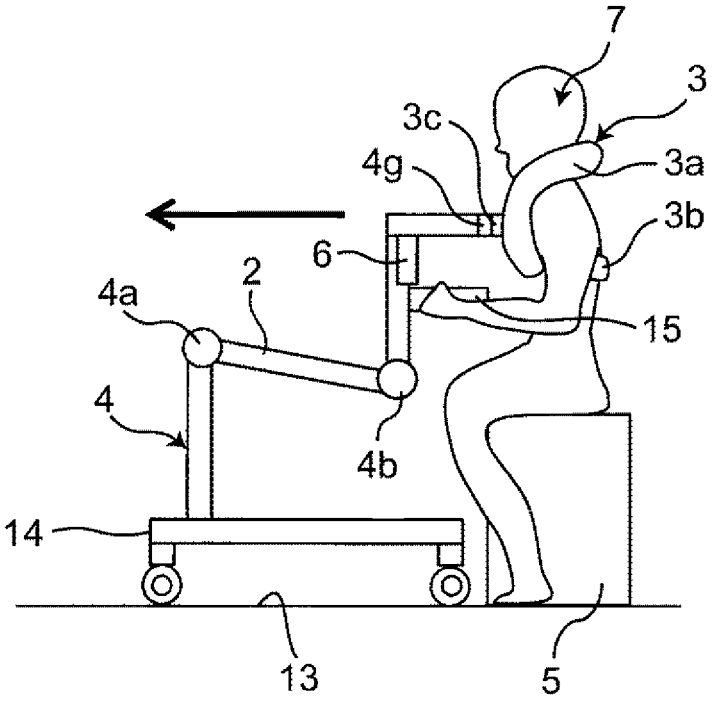
FIG. 3A is a diagram schematically illustrating an operation of the robot system according to the first embodiment of the present disclosure.
Figure 3B:
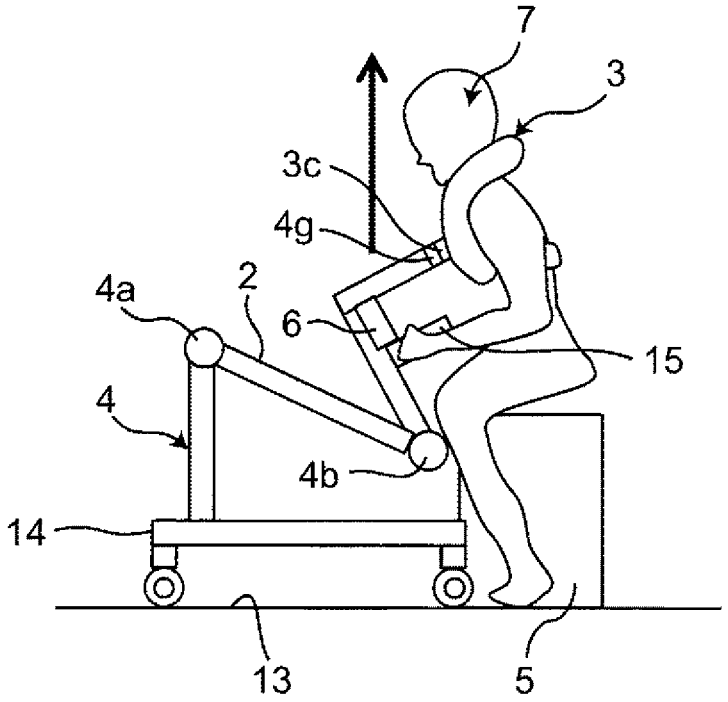
FIG. 3B is a diagram schematically illustrating an operation of the robot system according to the first embodiment of the present disclosure.
Figure 3C:
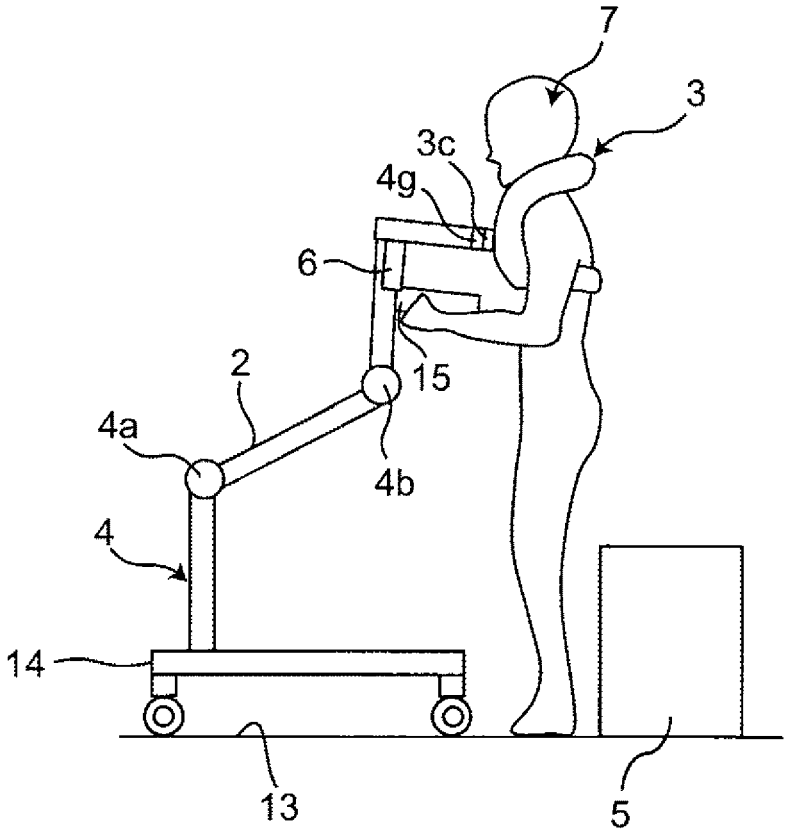
FIG. 3C is a diagram schematically illustrating an operation of a robot system according to the first embodiment of the present disclosure.

FIG. 1A and FIG. 1B are respectively a side view and a front view illustrating a robot 20 which is included in a robot system 1 as an example of a standing-up motion assist system (that is, a standing-up motion assist apparatus) according to the first embodiment of the present disclosure, and which is configured to, as an example of an operation using the robot system 1, assist a standing-up motion of a care receiving person 7 from a sitting position to a standing-up position. A care receiving person 7 is allowed to be in a sitting position by sitting on a sheet 5 on a floor 13. FIG. 1C is a front view illustrating the robot system 1 and the care receiving person 7 in a standing-up position. FIG. 1D is a diagram illustrating a positional relationship between the care belt 3 of the robot system 1 and the body of the care receiving person 7. FIG. 2 is a block diagram illustrating a detailed structure of the robot system 1 according to the first embodiment. FIG. 3A to FIG. 3C are diagrams illustrating an operation of the robot system according to the first embodiment of the present disclosure.

The robot system 1 illustrated in FIG. 1A to FIG. 2 is an example of a standing-up motion assist system including a robot 20 that assists the standing-up motion of the care receiving person 7. The robot system 1 includes operation information database 8 located outside the robot 20 as illustrated in FIG. 2. Alternatively, the operation information database 8 may be disposed in the robot 20 although not shown in the figures.

The robot 20 is placed on the floor 13 and includes a main mechanism 2 a control apparatus 11, and an input IF 6.

The main mechanism 2 includes an arm mechanism 4, a care belt 3, and a walking mechanism 14. The arm mechanism 4 includes at least a robot arm, which is an example of a pulling mechanism.

Care Belt 3

As illustrated in FIG. 1A to FIG. 1C, the care belt 3 includes the holding mechanism 3*g* and the connector 3*c* which are allowed to be worn by the care receiving person 7.

The holding mechanism 3*g* includes at least a first holder 3*a* that holds a neck part 7*a* or a back part 7*b* of the care receiving person 7, a second holder 3*b* that holds a lumbar part 7*c* of the care receiving person 7, and a third holder 3*h* that connects the first holder 3*a* and the second holder 3*b* and holds armpits 7*g* of the care receiving person 7. More specifically, the holding mechanism 3*g* includes the first holder 3*a* capable of holding a first region R1 which is one of or both the neck part 7*a* and the back part 7*b* of the care receiving person 7, and the second holder 3*b* capable of holding a second region R2 which is the lumbar part 7*c* of the care receiving person 7. For example, as illustrated in FIG. 1D, the holding mechanism 3*g* may include a first holder 3*a* capable of holding a first region R1 which is one or both of the neck part 7*a* and the back part 7*b* of the care receiving person 7 and a corresponding portion of a chest 7*d*, and a second holder 3*b* capable of holding a second region R2 extending from the chest 7*d* of the care receiving person 7 to the lumbar part 7*c* via the both sides 7*f* of the torso excluding the armpits.

The connector 3*c* includes a second connector 3*cb* and a first connector 3*ca* wherein the second connector 3*cb* is located at the chest 7*d* of the care receiving person 7, and the first connector connects, in front of the care receiving person 7, the first holder 3*a* and the second holder 3*b*. The connector 3*c* is capable of being located at the chest 7*d* (that is, close to chest 7*d* or a region including the chest 7*d* and its surrounding part) when the holding mechanism 3*g* is worn. Furthermore, the connector 3*c* is connected to the holding mechanism 3*g* and is capable of being removably connected to one end (for example, a back end) of the arm mechanism 4 described below. Note that the term "chest 7*d*" refers to the chest 7*d* and its surrounding part (for example, the chest 7*d* itself and the region in front of the chest 7*d* within a particular range (for example, within a range of 30 mm)).

Figure 4A:
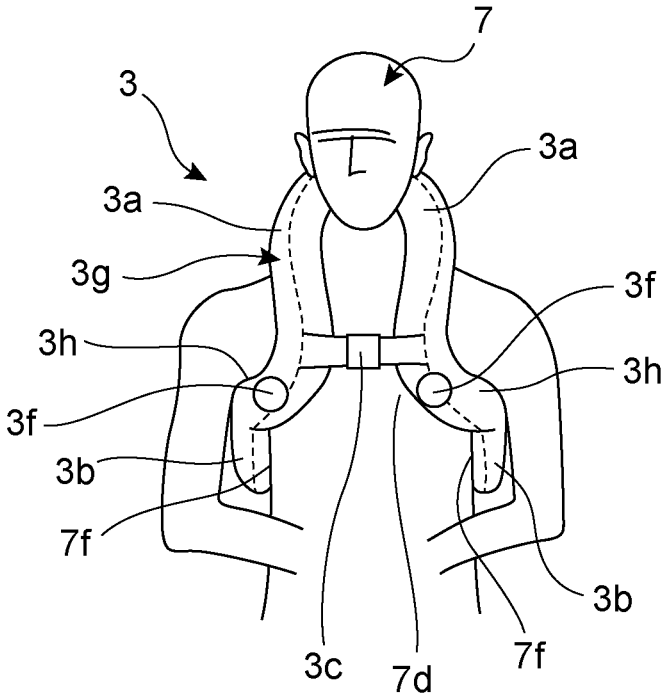
FIG. 4A is a front view illustrating a detailed configuration of a holding mechanism according to the first embodiment of the present disclosure in a state in which the holding mechanism is worn by a care receiving person.
Figure 4B:
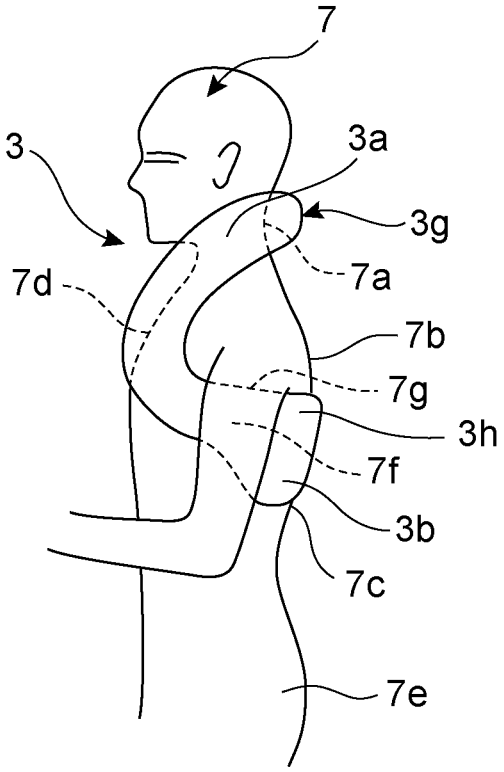
FIG. 4B is a left-side view illustrating a detailed configuration of the holding mechanism according to the first embodiment of the present disclosure in a state in which the holding mechanism is worn by a care receiving person.

More specific example of the holding mechanism 3*g* is illustrated in FIG. 4A and FIG. 4B. FIG. 1A to FIG. 1E schematically illustrate a manner in which the holding mechanism 3*g* illustrated in FIG. 4A to FIG. 4C is worn by the care receiving person 7.

Figure 4C:
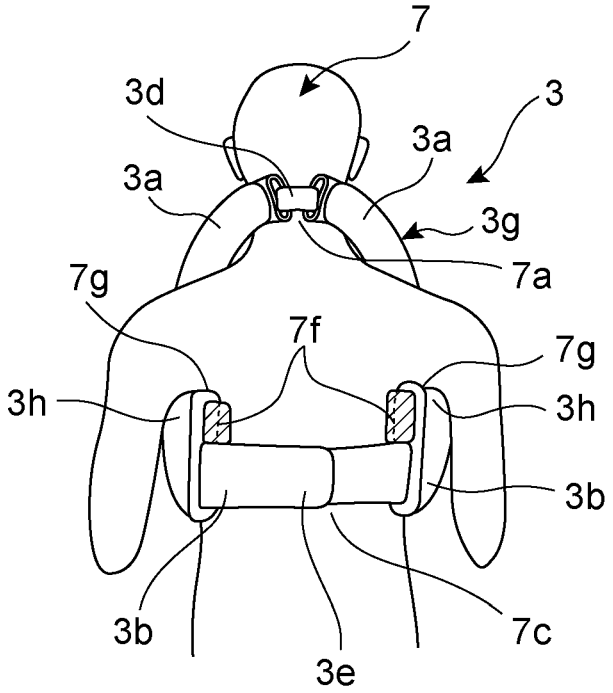
FIG. 4C is a rear view illustrating a detailed configuration of the holding mechanism according to the first embodiment of the present disclosure in a state in which the holding mechanism is worn by a care receiving person.

The first holder 3*a* of the holding mechanism 3*g* shown in FIG. 4A to FIG. 4C is formed of a hermetically-closed cylinder-shaped element into a shape like an inverted U character as seen when looking at the front of the care receiving person 7. That is, the first holder 3*a* is placed such that it extends from the first region R1 of the back part 7*b* including the neck part 7*a* in a direction from the back to the front of the body of the care receiving person 7 passing over the both shoulders 7*h*, and then it extends downward to the front parts of the both sides 7*f* of the torso passing over the front parts of the both shoulders 7*h* and the chest 7*d* thereby holding at least the first region R1 of the back part 7*b*. In other words, to make it easier to urge the care receiving person 7 to bend back the upper part of the body when the care receiving person 7 pulled forward, it is necessary to wrap the first holder 3*a* around the first region R1 of the neck part 7*a* or the back part 7*b* so as to hold the upper part of the body of the care receiving person 7 by the first holder 3*a*. To achieve this, the first holder 3*a* is placed such that the hermetically-closed cylinder-shaped element extending in the inverted U-like form is wrapped around the first region R1 including the back side of the neck part 7*a*, and it extends passing over the front parts of the both shoulders 7*h* and the chest 7*d* until the ends thereof reach the front parts of the both sides 7*f* of the torso.

On the other hand, the second holder 3*b* is formed of a hermetically-closed cylinder-shaped element in the U-like form protruding, as seen from the above the care receiving person 7, backward from front parts of the both sides of the care receiving person 7. That is, the second holder 3*b* is disposed such that the ends of the hermetically-closed cylinder-shaped element in the U-like form of the second holder 3*b* are connected, at the both sides 7*f* of the care receiving person 7, to the respective ends of the first holder 3*a* such that the both side parts 7*c* of the torso and the second region R2 close to the lumbar part 7*c* are wrapped with the hermetically-closed cylinder-shaped element. In other words, to make it easier to bend forward the pelvis of the care receiving person 7 when the care receiving person 7 is pulled forward, it is necessary to wrap the second holder 3*b* around the second region R2 near the lumbar part 7*c* such that the second holder 3*b* holds the lumbar or a part close to the lumbar of the care receiving person 7. To achieve this, the hermetically-closed cylinder-shaped element in the U-like form serving as the second holder 3*b* is placed such that it is wrapped around the second region R2 extending from the both side parts 7*f* to the lumbar part 7*c* of the torso thereby covering the second region R2 on the lumbar part 7*c* with the second holder 3*b*. The first holder 3*a* and the second holder 3*b* communicate with each other and form the hermetically-closed cylinder-shaped element.

Alternatively, as illustrated in FIG. 1B to FIG. 1C and in FIG. 4A to FIG. 4C or elsewhere, the third holder 3*h* may be formed in the shape of a hermetically-closed cylinder such that the first holder 3*a* and the second holder 3*b* is connected, at the both armpits 7*g* of the care receiving person 7, into a single integrated form such that it is possible to hold the both armpits 7*g*. This makes it possible for the armpits 7*g* to be more reliably held by the third holder 3*h* in the operation of pulling the care receiving person 7 thereby making it possible to more reliably assist the upward movement of the care receiving person 7 when the care receiving person 7 is pulled upward. However, in a case where it is possible to hold the body of the care receiving person 7 by the first holder 3*a* and the second holder 3*b* such that it is allowed to well perform the standing-up motion assist including the pulling forward and pulling upward, the third holder 3*h* may be omitted. Note that in the example illustrated in FIG. 1A, the third holder 3*h* is omitted.

The first holder 3*a*, the second holder 3*b*, and the third holder 3*h* are formed, by way of example, such that the outer part is made from polyvinyl chloride or nylon and the inside of the hermetically-closed cylinder-shaped element is filled with air. Furthermore, the first holder 3*a* and the second holder 3*b* each include a valve 3*f* for use in supplying air to fill them with air.

Note that in the present example, the first holder 3*a*, the second holder 3*b*, and the third holder 3*h* are respectively filled with air. Instead of filling them with air, they may be filled with a soft material such as a urethane material or the like. In this case, the valve 3*f* for use in filling them with air is not necessary.

Figure 19A:
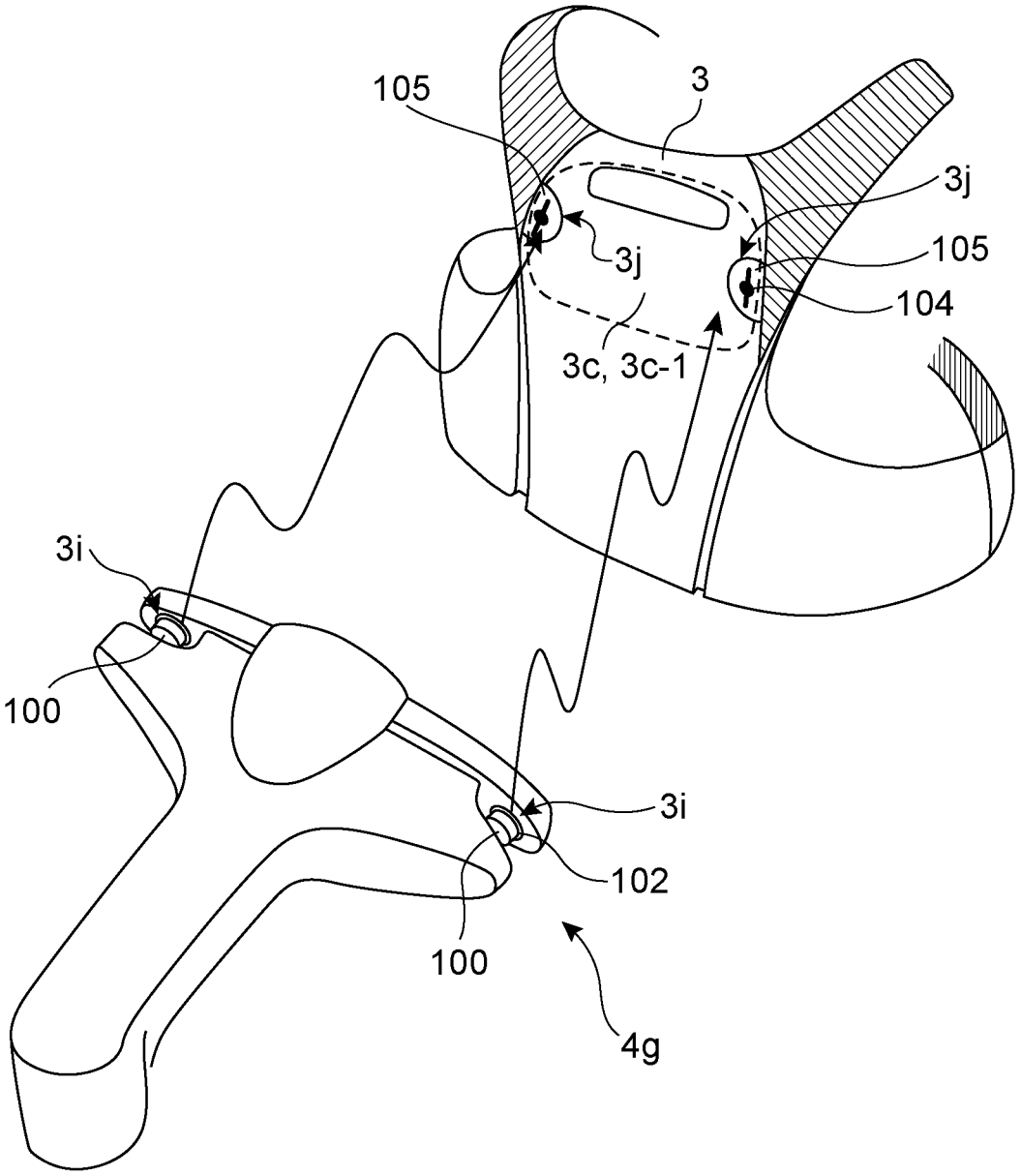
FIG. 19A is a front view illustrating a detailed configuration of a holding mechanism according to the first embodiment of the present disclosure.
Figure 19B:
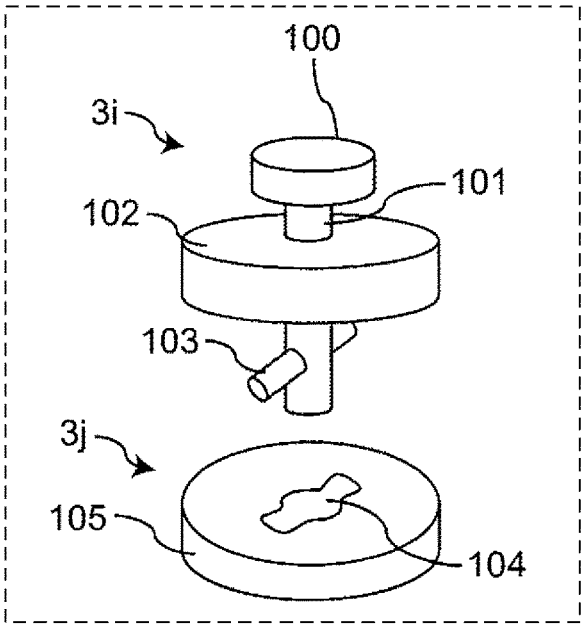
FIG. 19B is a perspective view illustrating a detailed configuration of a buckle and a buckle receiver of a connecting mechanism in FIG. 19A.
Figure 19C:
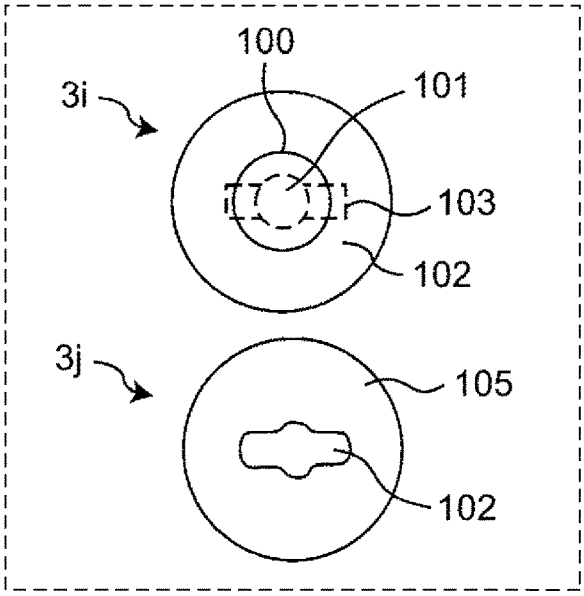
FIG. 19C is a plan view illustrating a detailed configuration of the buckle and the buckle receiver of the connecting mechanism in FIG. 19A.
Figure 19D:
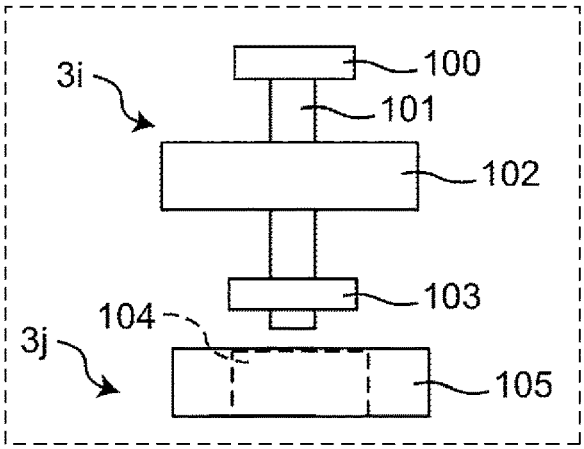
FIG. 19D is a side view illustrating a detailed configuration of the buckle and the buckle receiver of the connecting mechanism in FIG. 19A.
Figure 19E:
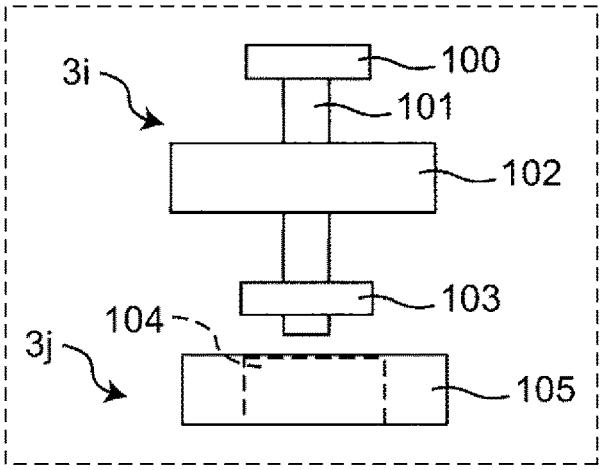
FIG. 19E is a diagram illustrating a manner in which the buckle shown in FIG. 19A is inserted in the buckle receiver.
Figure 19F:
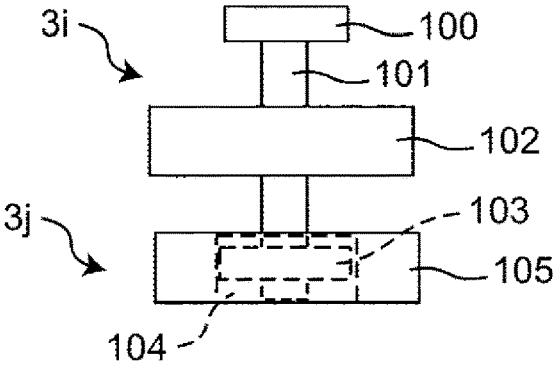
FIG. 19F is a diagram illustrating a manner in which the buckle shown in FIG. 19A is inserted in the buckle receiver.
Figure 19G:
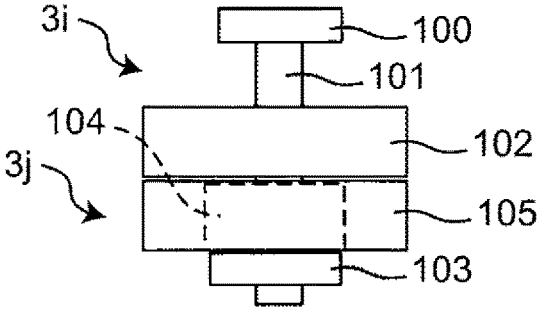
FIG. 19G is a diagram illustrating a manner in which the buckle shown in FIG. 19A is inserted in the buckle receiver.
Figure 19H:
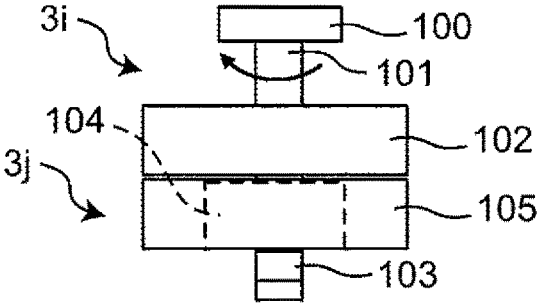
FIG. 19H is a diagram illustrating a manner in which the buckle shown in FIG. 19A is inserted in the buckle receiver.
Figure 19I:
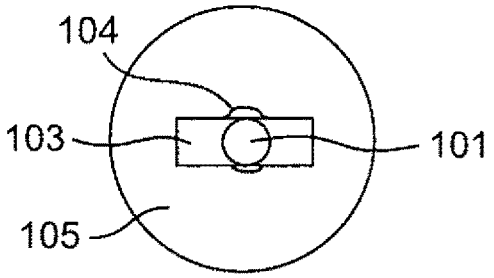
FIG. 19I is a bottom view illustrating a state in which the buckle shown in FIG. 19G is inserted in the buckle receiver
Figure 19J:
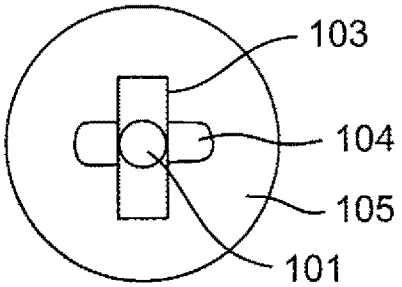
FIG. 19J is a bottom view illustrating a state in which the buckle shown in FIG. 19H is inserted in the buckle receiver.

The connector 3*c* is, by way of example, connected to one end of the arm mechanism 4 as illustrated in FIG. 1A to FIG. 1C, and the connector 3*c* is located close to the center of the chest 7*d* of the care receiving person 7 and in the middle between the first holder 3*a* and the second holder 3*b* such that the connector 3*c* bridges the ends of the respective first holder 3*a* and the second holder 3*b*. The connector 3*c* is connected to the one end (for example, the back end) of the arm mechanism 4, by way of example, using a screw. However, other methods may be used to connect the connector 3*c* to the one end of the arm mechanism 4. For example, by using a buckle 3*i* and a buckle receiver 3*j* such as those illustrated in FIG. 19A, the buckle 3*i* disposed on the one end of the arm mechanism 4 may be connected to the buckle receiver 3*j* disposed on the connector 3 in an easily removable manner.

More specifically, for example, the buckle 3*i* may be disposed on one of the one end of the arm mechanism 4 and the connector 3*c*, and the buckle receiver 3*j* may be disposed on the other one such that the buckle receiver 3*j* is located at a location opposing the buckle 3*i*.

As illustrated in FIG. 19A to FIG. 19D, each buckle 3*i* is configured such that an operation unit 100 is fixed to one end of a cylinder-shaped shaft 101, the shaft 101 rotatably penetrates a disk-shaped shaft bearing 102, and a clamp 103 is provided such that it extends, at a location close to the other end of the shaft 101, through the shaft 101 in a direction along a diameter of the shaft 101 such that both ends of the clamp 103 project outward from the shaft 101. The shaft bearing 102 is fixed to one end of the arm mechanism 4.

Each buckle receiver 3*j* is configured in the form of a disk-shaped bearing fixing part 105 having a through-hole 104 through which the shaft 101 and the clamp 103 penetrate. The bearing fixing part 105 is fixed to the connector 3*c*.

Thus, as illustrated in FIG. 19E to FIG. 19J, when the operation unit 100 of each buckle 3*i* is rotated, the shaft 101 rotates with respect to the shaft bearing 102, and the clamp 103 rotates together with the shaft 101. Therefore, if, after the buckle 3*i* is positionally adjusted with respect to buckle receiver 3*j* such that the phase of the shaft 101 and the clamp 103 is consistent with the phase of the through-hole 104 of the buckle receiver 3*j*, the shaft 101 and the clamp 103 of the buckle 3*i* are passed through the through-hole 104 of the buckle receiver 3*j* (see FIG. 19G and FIG. 19I), and then the operation unit 100 is rotated by, for example, 90°, then the clamp 103 is engaged with the bearing fixing part 105 without getting back through the through-hole 104 and thus the buckle 3*i* is latched by the buckle receiver 3*j* (see FIG. 19H and FIG. 19J). If the operation unit 100 is rotated further by, for example, 90° such that the phase of the shaft 101 and the clamp 103 of the buckle 3*i* is consistent with the phase of the through-hole 104 of the buckle receiver 3*j* (see FIG. 19G and FIG. 19I), it becomes possible to get back the shaft 101 and the clamp 103 of buckle 3*i* from the buckle receiver 3*j* through the through-hole 104 of the buckle receiver 3*j* thereby causing the buckle 3*i* to be released from the latch by the buckle receiver 3*j*.

As described above, it is possible to connect the buckle 3*i* disposed at one end of the arm mechanism 4 to the buckle receiver 3*j* disposed on the connector 3 in a manner in which it is allowed to easily remove the buckle 3*i* from the buckle receiver 3*j*.

Figure 19K:
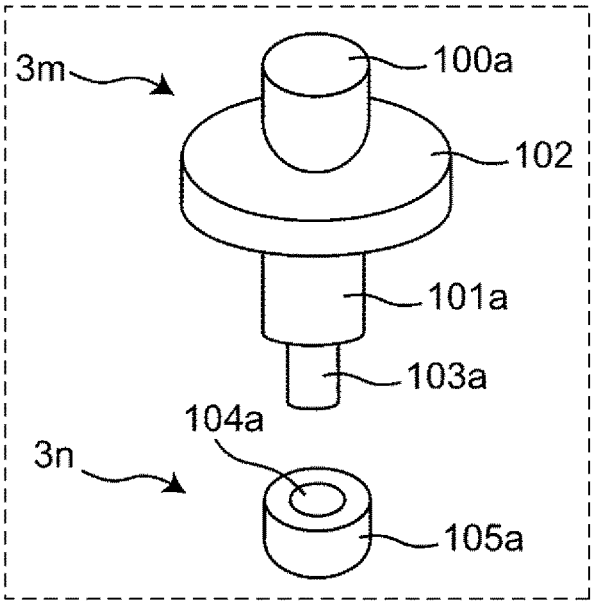
FIG. 19K is a perspective view illustrating a detailed configuration of a buckle and a buckle receiver of a connecting mechanism of a holding mechanism according to another modification of the first embodiment of the present disclosure.
Figure 19L:
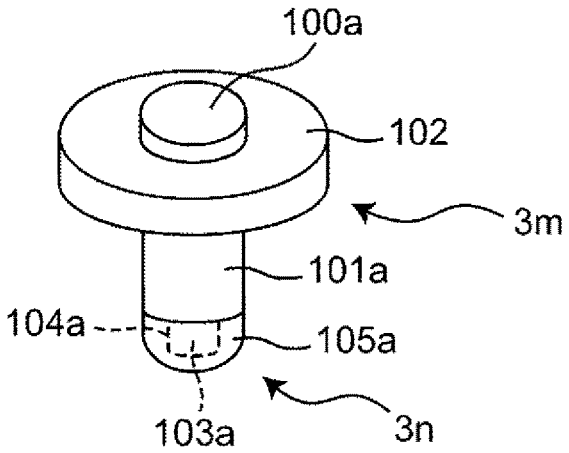
FIG. 19L is a perspective view illustrating a state in which, in the connecting mechanism of the holding mechanism shown in FIG. 19K, the buckle and the buckle receiver are engaged with each other.

The configuration of the buckle and the buckle receiver is not limited to the example described above. For example, in an alternative example, a buckle 3*m* and a buckle receiver 3*n* configured as illustrated in FIG. 19K and FIG. 19L may be employed. In this alternative example, by simply pressing down an operation unit (for example, a button) 100*a* of the buckle 3*m* in a direction along an axis of the shaft 101*a*, it is possible to fit a leading end of the shaft 101*a* into a recess 104*a* of a cap-shaped bearing fixing part 105*a* of the buckle receiver 3*n* such that the leading end of the shaft 101*a* is latched in the recess 104*a* of the bearing fixing part 105*a*. More specifically, the operation unit 100*a* is fixed, for example, such that a ball provided inside the clamp 103*a* is pushed out by the operation unit 100*a* and caught firmly by the inner wall of the recess 104*a* of the bearing fixing part 105*a*. To remove the buckle 3*m* from the buckle receiver 3*n*, the operation unit 100*a* is again pressed down. In response, the ball moves into the operation unit 100*a*, and the latch by the inner wall of the recess 104*a* is released and the operation unit 100*a* is pushed up by a biasing force provided by a spring or the like in the direction along the axis of the shaft 101*a*.

By employing the structure described above, it becomes possible for the care receiving person 7 to urgently move to a desired place such as a toilet or the like. To this end, the care belt 3 is worn in advance by the care receiving person 7. When the care receiving person 7 is to move the toilet and get on the toilet, it is allowed to easily and quickly connect and remove the care belt 3 to and from the robot system 1 by using the buckle 3*i* and the buckle receiver 3*j*.

The connector 3*c* may be formed, by way of example, using a material having a lower elasticity than those of the first holder 3*a*, the second holder 3*b*, and the third holder 3*h*. This makes it possible to prevent the connector 3*c* from expanding when the care belt 3 is pulled by the arm mechanism 4, and thus it is ensured to transfer external force from the arm mechanism 4 to the holding mechanism 3*g*.

Note that in order to ensure that the force from the arm mechanism 4 via the connector 3*c* is applied to the holding mechanism 3*g* equally for both right and left sides of the holding mechanism 3*g*, the first holder 3*a* of the holding mechanism 3*g* is formed to be bilaterally symmetric when seen from the front, and the second holder 3*b* is formed to be bilaterally symmetric when seen from the above.

The first holder 3*a* and the second holder 3*b* may be configured such that it is allowed to separate them from each other at any position thereby making it possible for the care receiving person 7 to easily wear the holding mechanism 3*g*. More specifically, for example, as illustrated as a first detachable attaching part 3*d* and a second detachable attaching part 3*e* in FIG. 4C, a detachable attaching part such as a surface fastener is provided on the first holder 3*a* and also on the second holder 3*b* such that the first detachable attaching part 3*d* and the second detachable attaching part 3*e* allow the first holder 3*a* and the second holder 3*b* to be separated from each other thereby making it possible to easily attach and detach the holding mechanism 3*g* to and from the body of the care receiving person 7. In the example illustrated in FIG. 4C, the attachment and detachment is performed at the back of the care receiving person 7. Alternatively, one of the first detachable attaching part 3*d* and the second detachable attaching part 3*e* may be lengthened and the attachment and detachment may be performed at one armpit. This makes it possible to easily perform attachment and detachment at an armpit even in a situation in which it is difficult for the care receiving person 7 to reach his/her back.

The configuration of the holding mechanism 3*g* is not limited to that illustrated in FIG. 4A to FIG. 4C, but modifications such as those descried below may be employed.

Figure 4D:
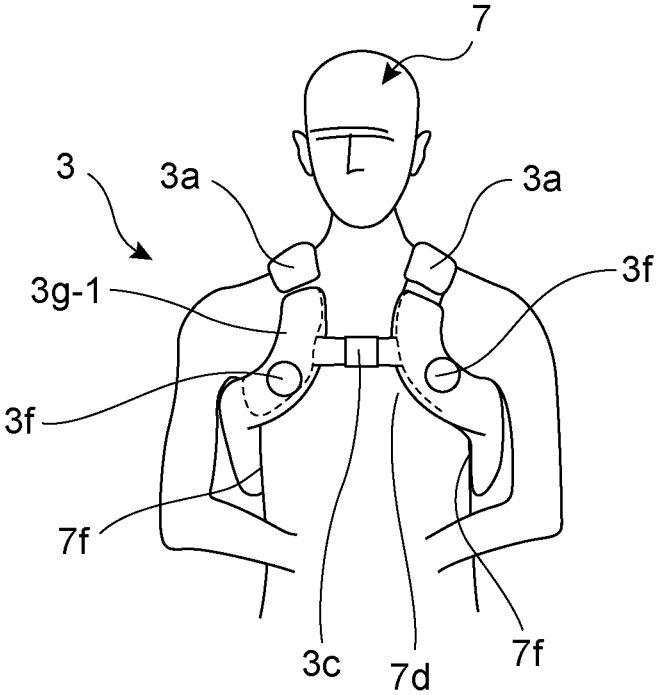
FIG. 4D is a front view illustrating a detailed configuration of a holding mechanism according to a first modification of the first embodiment of the present disclosure in a state in which the holding mechanism is worn by a care receiving person.
Figure 4E:
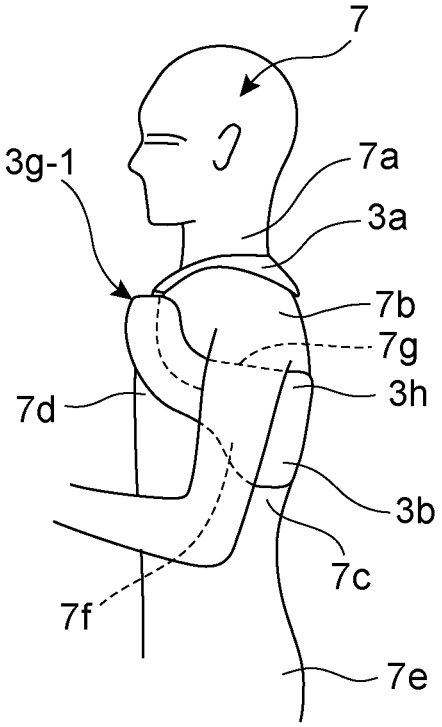
FIG. 4E is a left-side view illustrating a detailed configuration of the holding mechanism according to the first modification of the first embodiment of the present disclosure in a state in which the holding mechanism is worn by a care receiving person.
Figure 4F:
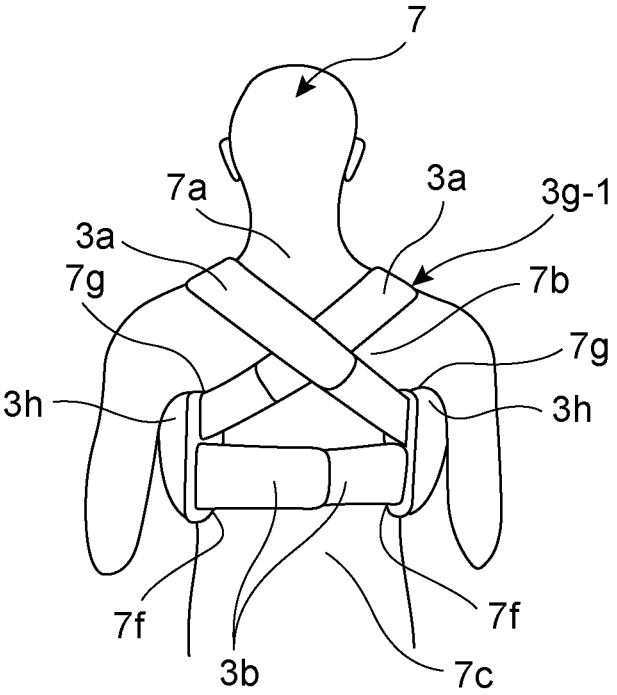
FIG. 4F is a rear view illustrating a detailed configuration of the holding mechanism according to the first modification of the first embodiment of the present disclosure in a state in which the holding mechanism is worn by a care receiving person.

A holding mechanism 3*g*-1 illustrated in FIG. 4D to FIG. 4F is a first modification of the first embodiment of the holding mechanism 3*g*. In this holding mechanism 3*g*-1 illustrated in FIG. 4D to FIG. 4F, the holding mechanism 3*g*-1 is worn by a care receiving person 7 such that the first holders 3*a* are crossed in an X shape on the back of the care receiving person 7 thereby holding the first region R1 including the back part 7*b* of the care receiving person 7.

Figure 4G:
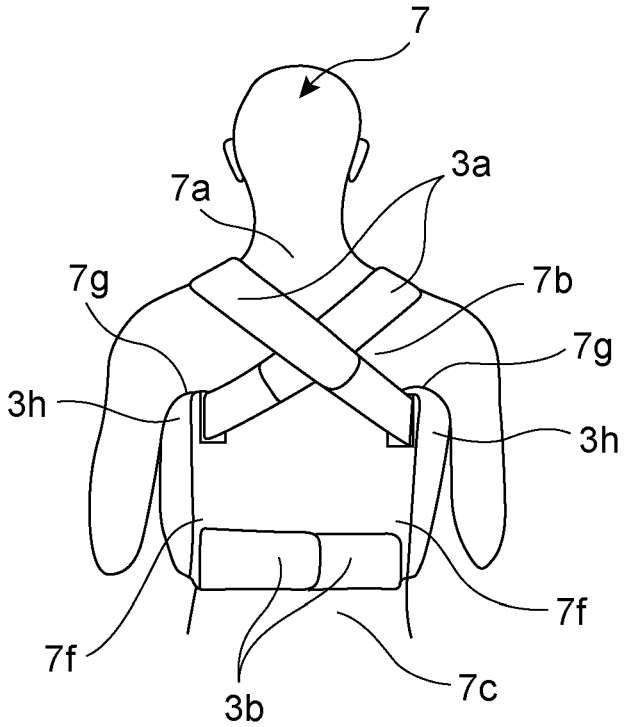
FIG. 4G is a rear view illustrating a detailed configuration of the holding mechanism according to the first modification of the first embodiment of the present disclosure in a state in which the position, where the holding mechanism is worn by a care receiving person, is changed.

The second holder 3*b* of the holding mechanism 3*g*-1 shown in FIG. 4D to FIG. 4F may be worn at a position close to a lower part of the lumbar part 7*c* as illustrated in FIG. 4G such that the second region R2 including the lumbar part 7*c* is held by the second holder 3*b*.

Figure 4H:
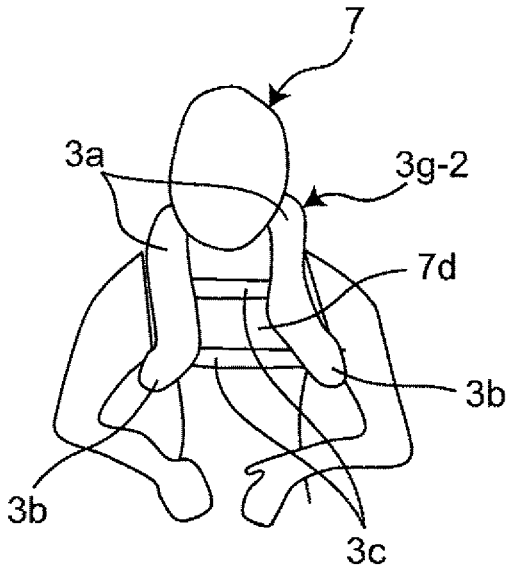
FIG. 4H is a front view illustrating a detailed configuration of a holding mechanism according to a second modification of the first embodiment of the present disclosure in a state in which the holding mechanism is worn by a care receiving person.

In a second modification of the first embodiment, as illustrated in FIG. 4H, two connectors 3*c* may be provided at upper and lower positions of the holding mechanism 3*g*-2 such that the connectors 3*c* extend between two parts of the first holder 3*a* of the arm mechanism 4 and they are connected to each other.

Figure 4I:
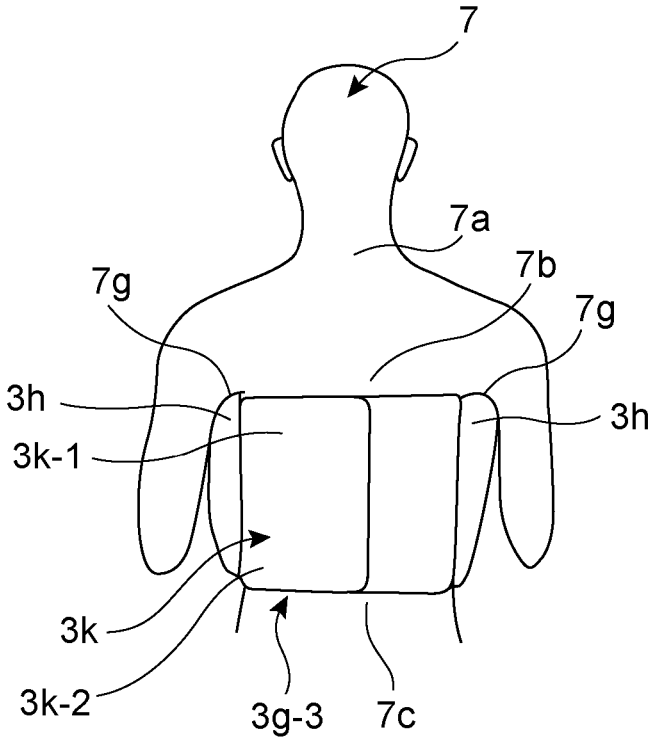
FIG. 4I is a front view illustrating a detailed configuration of a holding mechanism according to a third modification of the first embodiment of the present disclosure wherein a first holder and a second holder are realized using a single belt-shaped fourth holder.
Figure 4J:
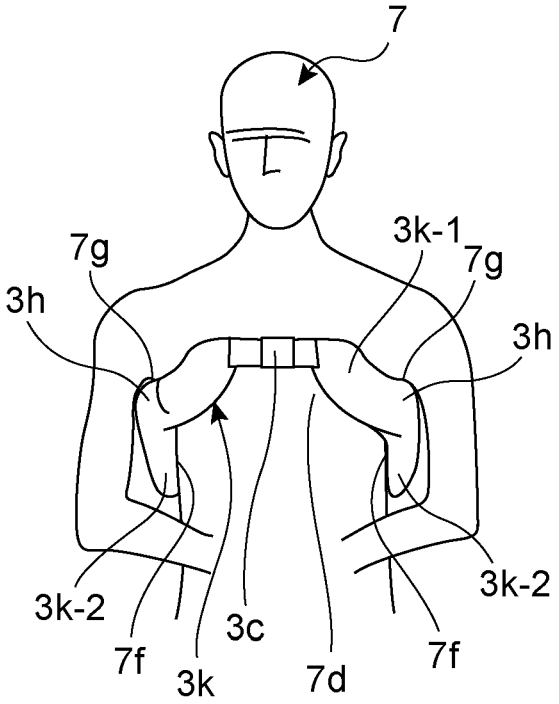
FIG. 4J is a left-side view illustrating a detailed configuration of the holding mechanism according to the third modification of the first embodiment of the present disclosure in a state in which the holding mechanism is worn by a care receiving person.
Figure 4K:
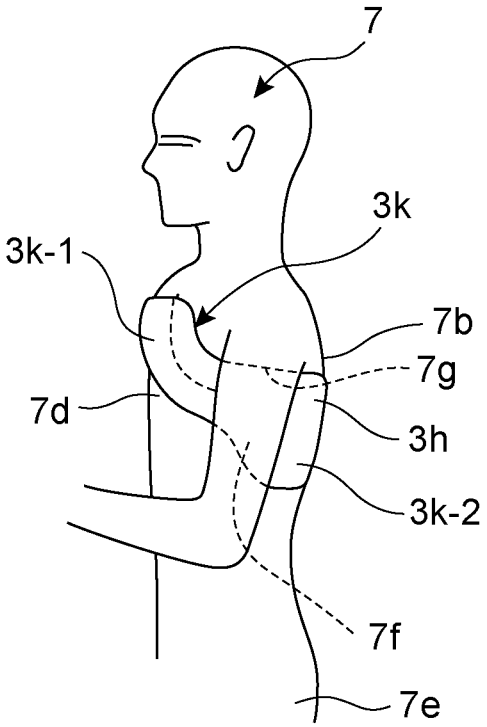
FIG. 4K is a rear view illustrating a detailed configuration of the holding mechanism according to the third modification of the first embodiment of the present disclosure in a state in which the holding mechanism is worn by a care receiving person.

A third modification of the first embodiment is another example in which the first holder 3*a* is wrapped around the neck part 7*a* or the back part 7*b*. That is, as illustrated in FIG. 4I to FIG. 4K, the first holder 3*a* may include a holding mechanism 3*g*-3 that holds the back part 7*b*. More specifically, as illustrated in FIG. 4I to FIG. 4K, the first holder 3*a* and the second holder 3*b* form a single belt-shaped fourth holder 3*k*. This fourth holder 3*k* is configured so as to be capable of holding the lower part of the back part 7*b*, the armpits 7*g*, and the lumbar part 7*c* of the care receiving person 7. More specifically, the fourth holder 3*k* includes a first-holder counterpart 3*k*-1 corresponding to the first holder 3*a* that holds the first region R1 and a second-holder counterpart 3*k*-2 corresponding to the second holder 3*a* that holds the second region R2, which are formed in an integral shape using a single wide belt. The first-holder counterpart 3*k*-1 holds a region from the back to the front of the body of the care receiving person 7 such that the held region includes the first region R1 of the back part 7*b* including not the neck part 7*a* but the part below the scapula, the both side parts of the chest 7*d*, and the chest 7*d*. The second-holder counterpart 3*k*-2 holds a region from the back to the front of the body of the care receiving person 7 such that the held region includes the second region R2 near the lumbar part 7*c*, the both side parts 7*f* of the torso, and the font part of the torso. Also in this example, the third holder 3*h* may be formed integrally with the fourth holder 3*k*.

Figure 4L:
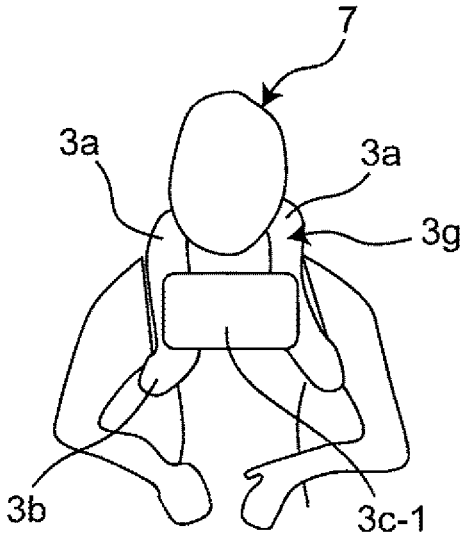
FIG. 4L is a front view illustrating a detailed configuration of a holding mechanism according to a fourth modification of the first embodiment of the present disclosure.
Figure 4M:
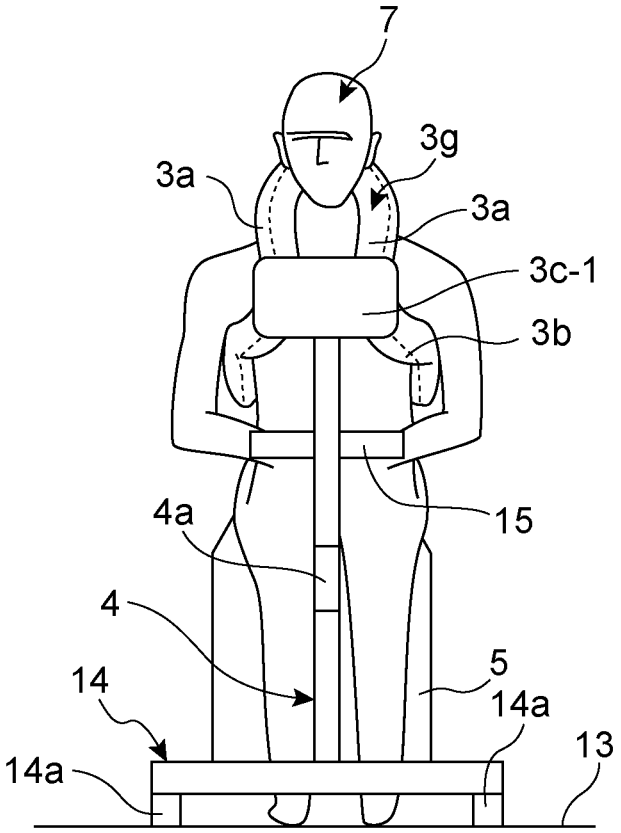
FIG. 4M is a front view corresponding to the front view illustrated in FIG. 1C and illustrating a detailed configuration of a robot including the holding mechanism according to the fourth modification of the first embodiment of the present disclosure.

In a fourth modification of the first embodiment, as illustrated in FIG. 4L and FIG. 4M, the connector 3*c* may be formed using not a thin belt-shaped material but a thick or elastic rectangular plate-shaped material as a connector 3*c*-1. Furthermore, as represented by a dashed-line in FIG. 19A, the connecting mechanism between the connector 3*c* and the arm mechanism 4 may be configured such that the end of the arm mechanism 4 is connected to the connector 3*c*-1 using the buckle 3*i* and the buckle receiver 3*j* and/or the like in an attachable/detachable manner and the connector 3*c*-1 is inserted in the inside of the care belt 3. In this structure, even when the arm mechanism 4 is brought accidentally into contact with the holding mechanism 3*g* via the connector 3*c*-1, the structure allows it to reduce the force caused by the contact, and thus it is possible to prevent an excess force from being applied to the care receiving person 7.

Walking Mechanism 14

The walking mechanism 14 includes at least a pair of wheels 14*a* and a pair of wheels 14*b*. More specifically, for example, the walking mechanism 14 includes a rectangular base 14*e*, the pair of front wheels 14*a*, the pair of rear wheels 14*b*, a front-wheel brake 14*c*, and a rear-wheel brake 14*d*, and the walking mechanism 14 is placed on a floor 13. The pair of front wheels 14*a* is disposed at a front end of the rectangular base 14*e* such that the respective front wheels are rotatably disposed in two corners at the front end. The pair of rear wheels 14*b* is disposed at a back end of the rectangular base 14*e* such that the respective rear wheels are rotatably disposed in two corners at the back end. The front-wheel brake 14*c* is used to brake the pair of front wheels 14*a*. The rear-wheel brake 14*d* is used to brake the pair of rear wheels 14*b*. The arm mechanism 4 is disposed above the walking mechanism 14. More specifically, the arm mechanism 4 is disposed in the center of the front part of the rectangular base 14*e* such that the arm mechanism 4 extends vertically. For example, in the state shown in FIG. 3C, if the care receiving person 7 applies force in the forward direction (for example, in the leftward direction in FIG. 3C), then the pair of front wheels 14*a* and the pair of rear wheels 14*b* rotate, and thus the walking mechanism 14 serves as a walking assist apparatus that assists the care receiving person 7 to walk. Although in this example, the pair of front wheels 14*a* and the pair of rear wheels 14*b* rotate in response to a pushing operation by the care receiving person 7, a motor may be provided for each or all of the front wheels and rear wheels to assist the pushing operation by the care receiving person 7 thereby making it possible for the care receiving person 7 to move more easily. Furthermore, for example, the front-wheel brake 14*c* and the rear-wheel brake 14*d* may be realized using electromagnetic brakes such that it is allowed to turn on/off the brakes for the pair of front wheels 14*a* or the pair of the rear wheels 14*b* by operating the input IF 6. By turning on the front-wheel brake 14*c*, it is possible to brake the pair of front wheels 14*a*. By turning on the rear-wheel brake 14*d*, it is possible to brake the pair of rear wheels 14*b*. By turning off the front-wheel brake 14*c*, it is possible to release the brake of the pair of front wheels 14*a*. By turning off the rear-wheel brake 14*d*, it is possible to release the brake of the pair of rear wheels 14*b*. In this example, electromagnetic brake is used by way of example. Alternatively, a manual brake may be used.

Arm Mechanism 4

The arm mechanism 4 includes a robot arm as an example of a pulling mechanism. The arm mechanism 4 is connected to the second connector 3*cb* to pull the second connector 3*cb*. For example, the arm mechanism 4 is disposed above the walking mechanism 14, and the leading end of the arm mechanism 4 is connected to the holding mechanism 3*g* via the connector 3*c*. For example, the arm mechanism 4 may be a two-degree-of-freedom robot arm including a first motor 41, a first encoder 43 that detects the number of rotations (for example, the rotation angle) of the rotation axis of the first motor 41, a second motor 42, and a second encoder 44 that detects the number of rotations of the rotation axis of the second motor 42. The control apparatus 11 controls the first motor 41 and the second motor 42 based on position information obtained by converting the rotation angle information detected by the first encoder 43 and the second encoder 44 into position information associated with the arm mechanism 4. By controlling the first motor 41 and the second motor 42 in the manner described above, it is possible, as illustrated by way of example in FIG. 3A to FIG. 3C, to drive the robot system 1 to assist the care receiving person 7 in the sitting position to move his/her buttocks 7*e* away from the sheet 5 such that the first holder 3*a* and the second holder 3*b* of the holding mechanism 3*g* are simultaneously pulled in the forward direction with reference to the care receiving person 7 and then pulled in the upward direction.

More specifically, the arm mechanism 4 includes a robot arm including a plurality of joints, a first arm 4*c*, a second arm 4*d*, a third arm 4*e*, a fourth arm 4*f*, a first driving unit 4*a*, and a second driving unit 4*b*. The first arm 4*c* is disposed on the rectangular base 14*e* such that the lower end of the first arm 4*c* is fixed to the center of the front end area of the rectangular base 14*e* such that the first arm 4*c* extends upward from the rectangular base 14*e*. The upper end of the first arm 4*c* is connected to the front end of the second arm 4*d* via the first joint including therein the first driving unit 4*a* such that the second arm 4*d* is rotatable. The back end of the second arm 4*d* is connected to the lower end of the third arm 4*e* via the second joint including therein the second driving unit 4*b* such that the third arm 4*e* is rotatable. The upper end of the third arm 4*e* is connected to the front end of the fourth arm 4*f* such that the third arm 4*e* and the fourth arm 4*f* form an L-like shape in which the axes of the third arm 4*e* and the fourth arm 4*f* are perpendicular to each other. The fourth arm 4*f* has, at its back end, a connector 4*g* connected to the connector 3*c* of the care belt 3 in an attachable/detachable manner.

The first driving unit 4*a* is disposed on a joint between the first arm 4*c* and the second arm 4*d*, and includes, for example, the first motor 41 that drives the second arm 4*d* so as to rotate with respect to the first arm 4*c* and the first encoder 43 that detects the rotation angle information associated with second arm 4*d*. Thus, under the control of the controller 12 described later, it is possible to drive the second arm 4*d* so as to rotate by a particular angle with respect to the first arm 4*c*. The second driving unit 4*b* is disposed on a joint between the second arm 4*d* and the third arm 4*e*, and includes, for example, the second motor 42 that drives the third arm 4*e* so as to rotate with respect to the second arm 4*d* and the second encoder 44 that detects the rotation angle information associated with third arm 4*e*. The rotation angle information detected by the first encoder 43 and that detected by the second encoder 44 are respectively converted into position information associated with the arm mechanism 4 and used as the position information by the controller 12. Thus, under the control of the controller 12 described later, it is possible to drive the third arm 4*e* so as to rotate by a particular angle with respect to the second arm 4*d* thereby moving the third arm 4*e* to a desired position.

The fourth arm 4*f* has, at its front part, an input interface (input IF) 6, such as an operation board including a button or the like disposed thereon, which is disposed so as to protrude downward. By disposing the input IF 6 in the above-described manner, it becomes possible for the care receiving person 7 in the sitting position to operate the input IF 6 from the side of the arm mechanism 4. Thus the care receiving person 7 is allowed to input various commands via the input IF 6 (for example, by pressing down a button) to turn on or off the brake of wheels (front wheels and rear wheels) of the robot system 1, turn on or off the power of the robot system 1, turn on or off a standing-up operation start button, and the like. Furthermore, a grab handle 15 is disposed so as to project from the center of the third arm 4*e* in a backward direction (for example, toward the care receiving person) such that the care receiving person 7 is allowed to grab the grab handle 15 when the care receiving person 7 is in the sitting position or when the care receiving person 7 stands up. The grab handle 15 may have a length large enough to allow the care receiving person 7 to put his/her elbow on the grab handle 15. In this configuration, when the care receiving person 7 stands up, the grab handle 15 serves as a grab handle, while when the care receiving person 7 walks, putting his/her elbow on the grab handle 15 makes it possible to walk in a stable manner. Furthermore, the fourth arm 4*f* may include a cushioning material such as urethane disposed on the upper side thereof. This makes it possible to reduce an impact that may be applied to the care receiving person 7 when the care receiving person 7 falls forward and a face of an upper part of the body of the care receiving person 7 comes into contact with the fourth arm 4*f*.

The control apparatus 11 includes the database input/output unit 9, the timer 16, and the controller 12. The controller 12 controls the arm mechanism 4 such that first, the second connector 3*cb* is pulled in a forward and upward direction with reference to the care receiving person 7, and then the second connector 3*cb* is pulled in a backward and upward direction with reference to the care receiving person 7. More specifically, for example, the control apparatus 11 controls the operations of the first driving unit 4*a* and the second driving unit 4*b* of the arm mechanism 4 independently such that the first holder 3*a* and the second holder 3*b* of the holding mechanism 3*g* are simultaneously pulled in a forward direction with reference to the care receiving person 7 thereby causing at least the buttocks 7*e* of the care receiving person 7 in the sitting position to move away from the sheet 5, and then, the care belt 3 is pulled in an upward direction with reference to the care receiving person 7 until the care receiving person 7 reaches the standing-up position thereby assisting the care receiving person 7 to stand up. More specifically, the control apparatus 11 performs the control operation such that the first holder 3*a* and the second holder 3*b* of the holding mechanism 3*g* are simultaneously pulled by the arm mechanism 4 as represented by an arrow in FIG. 3A thereby pulling the care receiving person 7 in the sitting position in a forward direction. In the above-described operation in which the first holder 3*a* and the second holder 3*b* are simultaneously pulled by the arm mechanism 4, the first region R1 of the neck part 7*a* or the back part 7*b* of the care receiving person 7 is first pulled in the forward direction. This straightens up the back of the care receiving person 7, which makes it possible for the care receiving person 7 to easily stand up. At the same time as the pulling operation described above, the second region R2 of the lumbar part 7*c* of the care receiving person 7 is pulled in the forward direction. This causes the pelvis of the care receiving person 7 to move in the forward direction, which makes it easy for the care receiving person 7 to move away from the sheet 5. Thus, compared to the case where the second region R2 of the lumbar part 7*c* is simply pulled in the forward direction, the pulling both the first region R1 and the second region R2 simultaneously in the forward direction makes it possible for the care receiving person 7 more surely and more easily to move his/her buttocks 7*e* away from the sheet 5. Subsequently, pulling upward is performed as represented by an arrow in FIG. 3B so as to move the buttocks 7*e* of the care receiving person 7 away from the sheet 5, and the following assisting operation is performed until the standing-up position shown in FIG. 3C is reached. In the above-described operation, let a "first phase" denote a phase from a state in which the control operation is started to a state in which the buttocks 7*e* of the care receiving person 7 are moved away from the sheet 5. Let a "second phase" denote a phase in which, after the first phase, the operation is performed until the care receiving person 7 reaches the standing-up position.

Timer 16

At particular fixed time intervals (for example, every 1 millisecond), the timer 16 outputs a command to execute the database input/output unit 9 and the controller 12 to the database input/output unit 9 and the controller 12.

Input IF 6

The input IF 6 is an operation interface including a button and/or the like and is disposed, for example, on the arm mechanism 4. The input IF 6 is used for issue instructions such as a command to turn on/off the power of the robot system 1, a command to turn on/off the front-wheel brake 14*c* and the rear-wheel brake 14*d*, and a command to start/stop the standing-up operation.

Operation Information Database 8

The controller 12 is executed according to a command from the timer 16 such that the position information associated with the arm mechanism 4 (position information obtained by converting rotation angle information detected by the first encoder 43 and that detected by the second encoder 44 into position information associated with the arm mechanism 4) is generated at particular fixed time intervals (for example, every 1 millisecond) by the controller 12 and the database input/output unit 9 in response to the execution command from the timer 16. In the first embodiment, the generated position information is output together with time as operation information to the operation information database 8 via the database input/output unit 9 and is stored as the operation information in the operation information database 8. Note that in the first embodiment, the operation information is generated via the input IF 6 or the like and stored in advance.

FIG. 5A illustrates an example of a content of information stored in a the operation information database 8.

(1) In fields of "time", information about a time during an operation of the arm mechanism 4 is described. In the first embodiment, time is expressed in units of milliseconds.

(2) Information described in fields of "position" describes a position of the arm mechanism 4 obtained by converting angle information detected by first and second encoders 43 and 44 of the arm mechanism 4. More specifically, the position information is given by positions on two axes, that is, a position on the x-axis defined in the moving direction of the robot system 1 (for example, front-back direction) and a position on the z-axis defined in the vertical direction. In the first embodiment, the position is expressed in units of meters.

Database Input/Output Unit 9

The database input/output unit 9 is configured to input/output data (that is, information) between the operation information database 8 and the controller 12.

Controller 12

The controller 12 operates the first motor 41 and the second motor 42 of the arm mechanism 4, independently, such that the arm mechanism 4 moves according to the operation information input from the database input/output unit 9. Furthermore, the controller 12 controls braking operations of the front-wheel brake 14*c* and the rear-wheel brake 14*d* according to ON/OFF commands associated with the front-wheel brake 14*c* and the rear-wheel brake 14*d* input via the input IF 6.

The operation of the robot system 1 performed under the control of the controller 12 is described below.

A procedure of operating the arm mechanism 4 of the robot system 1 and a corresponding operation of the care receiving person 7 are described below with reference to FIG. 6A to FIG. 6E and a flow chart shown in FIG. 7.

First, as illustrated in FIG. 6A, the care receiving person 7 sits on a sheet 5 such as a bed, a sheet, a toilet seat, or the like placed on a floor 13. Next, a caregiver or the like places the robot 20 of the robot system 1 in front of the care receiving person 7 sitting on the sheet 5.

Figure 7:
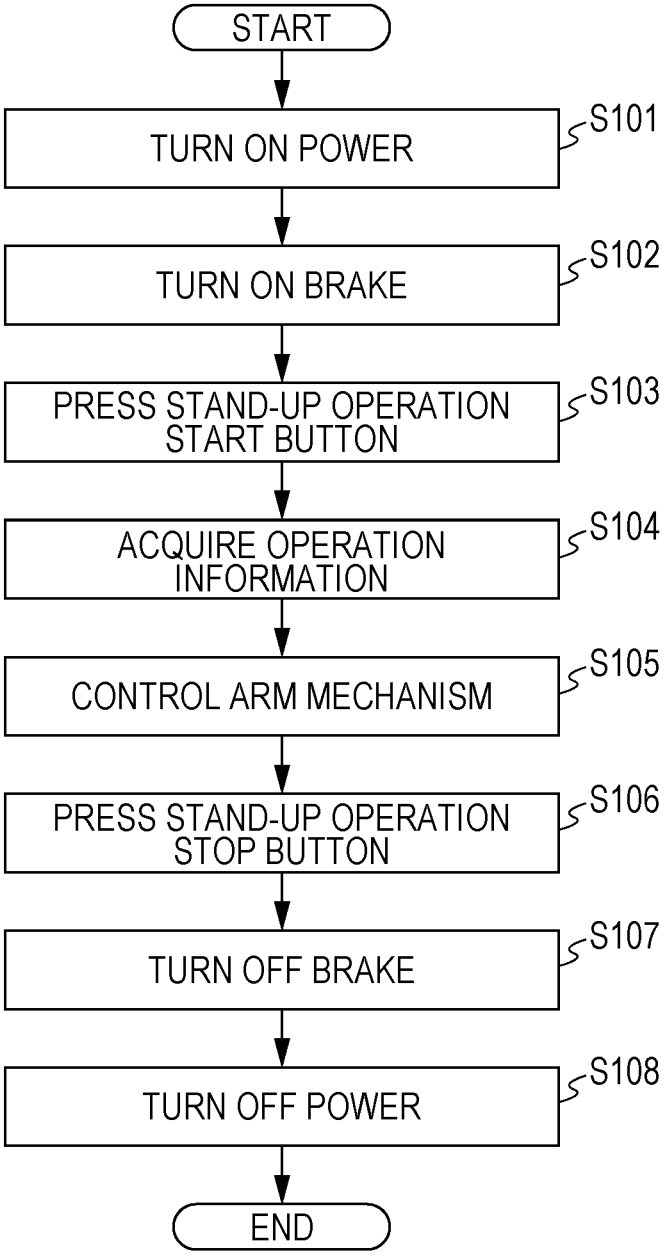
FIG. 7 is a flow chart illustrating an operation of a controller according to the first embodiment of the present disclosure.

Next, in step S101 in FIG. 7, the care receiving person 7 turns on the power of the robot system 1 by operating the input IF 6 of the robot 20.

Next, in step S102, the care receiving person 7 turns on the front-wheel brake 14*c* and the rear-wheel brake 14*d* by operating the input IF 6. In response, the controller 12B performs braking such that front wheels 14*a* and rear wheels 14*b* of the walking mechanism 14 are not allowed to rotate. This ensures that when the holding mechanism 3*g* is pulled by the arm mechanism 4 via the connector 3*c*, the walking mechanism 14 does not move, and force from the arm mechanism 4 is surely transferred to the holding mechanism 3*g* via the connector 3*c*.

Next, the care receiving person 7 wears the holding mechanism 3*g* of the care belt 3 connected to the arm mechanism 4 such that the holding mechanism 3*g* is tied around a body of the care receiving person 7, and the care receiving person 7 grabs the grab handle 15 with his/her both hands.

Next, in step S103, the care receiving person 7 presses down a standing-up operation start button on the input IF 6. In response, the robot system 1 starts to operate. In the present example, the robot system 1 operates when the standing-up operation start button is in the pressed-down state, but the robot system 1 stops the operation when the standing-up operation start button is released. In the following process from step S104 to step S106, the control apparatus 11 of the robot system 1 controls the operations of the first driving unit 4*a* and the second driving unit 4*b* of the arm mechanism 4 independently such that the buttocks 7*e* of the care receiving person 7 in the sitting position shown in FIG. 3A move away from the sheet 5 as illustrated in FIG. 3B in order to assist the standing-up motion as show in FIG. 3C.

Next, in step S104, the controller 12 acquires operation information from the database input/output unit 9.

Next, in step S105, the controller 12 controls driving the first motor 41 and the second motor 42 independently such that the arm mechanism 4 is driven according to the operation information acquired from the database input/output unit 9. More specifically, for example, under the control of the controller 12, the arm mechanism 4 moves in a forward direction (in a direction to the left in FIG. 6A) as illustrated in FIG. 6A and FIG. 6B. As a result, as illustrated in FIG. 6B, the first holder 3*a* and the second holder 3*b* of the holding mechanism 3*g* are both pulled simultaneously in the forward direction by the arm mechanism 4. In the operation, the pulling the first holder 3*a* forward by the arm mechanism 4 via the connector 3*c* urges the upper part of the body of the care receiving person 7 to bend back as represented by a clockwise dashed-line arrow A in FIG. 6B. Furthermore, pulling the second holder 3*b* forward via the connector 3*c* causes the pelvis of the care receiving person 7 to be urged to be bent forward as represented by a counterclockwise dashed-line arrow B in FIG. 6B. By assisting the forward leaning of the care receiving person 7 by the arm mechanism 4, the buttocks 7*e* of the care receiving person 7 are urged to move away from the sheet 5, and simultaneously the upper part of the body of the care receiving person 7 is urged to be bent back, and thus it becomes easy for the care receiving person 7 to stand up from the sheet 5. Furthermore, urging the upper part of the body of the care receiving person 7 to be bent back makes it possible for the care receiving person 7 to smoothly move from the sitting position to the standing-up position without having to take a deep forward leaning position.

When the arm mechanism 4 pulls the first holder 3*a* via the connector 3*c* in a forward direction (in a forward and upward direction) (in other words, in the first phase in which the buttocks 7*e* of the care receiving person 7 are moved away from the sheet 5 after the pulling operation is started), under the control of the controller 12, the first motor 41 and the second motor 42 of the arm mechanism 4 may drive the pulling operation such that the pulling speed in the forward direction is gradually increased. This makes is possible to more easily urge the care receiving person 7 to bend back his/her upper part of the body and bend forward his/her pelvis, and thus it becomes possible to more smoothly assist the standing-up motion of the care receiving person 7.

Figure 6D:
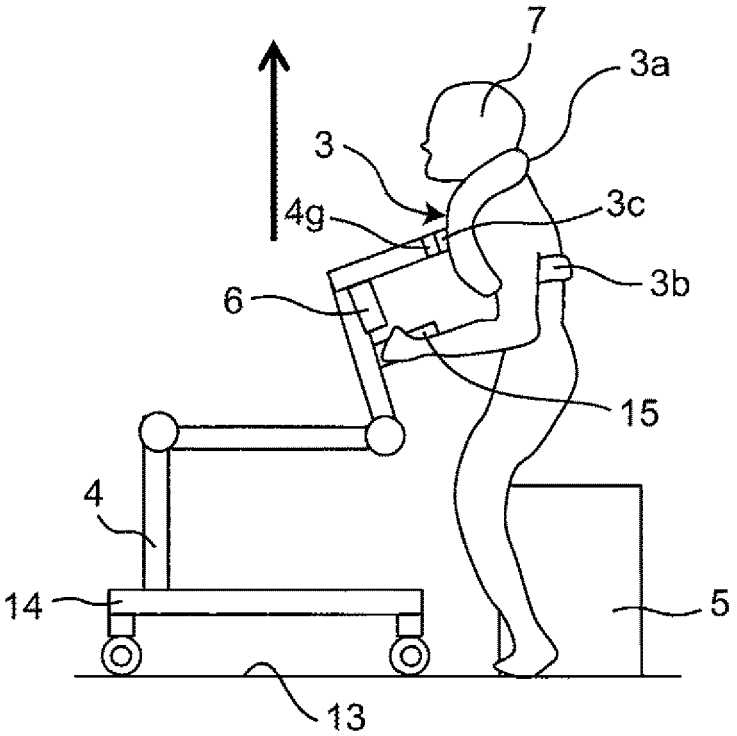
FIG. 6D is a diagram illustrating an operation of the robot system according to the first embodiment of the present disclosure.
Figure 6E:
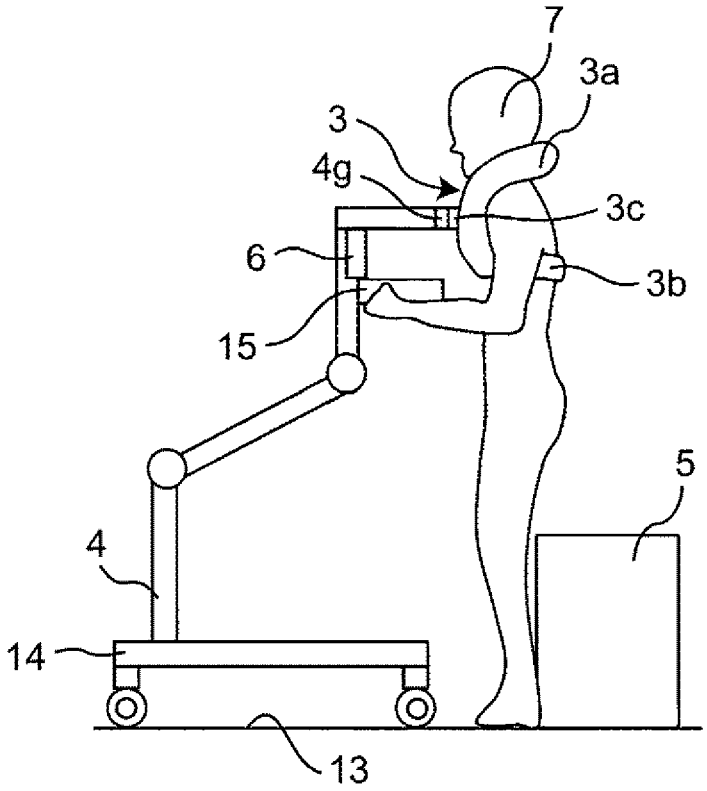
FIG. 6E is a diagram illustrating an operation of the robot system according to the first embodiment of the present disclosure.

Next, as illustrated in FIG. 6C, when the buttocks 7*e* of the care receiving person 7 move away from the sheet 5 (that is, at the end of the first phase), the controller 12 controls the driving of the arm mechanism 4 such that the arm mechanism 4 moves upward as represented by an upward arrow in FIG. 6D. As a result, the upward movement of the arm mechanism 4 assists the care receiving person 7 to move in the upward direction until the care receiving person 7 reaches the final standing-up position as illustrated in FIG. 6E and the standing-up operation is completed.

Next, in step S106, the care receiving person 7 releases the pressed-down input IF 6 (that is, the care receiving person 7 removes his/her finger from it). In response, the controller 12 stops controlling the standing-up operation and the operation of the arm mechanism 4. Note that even before step S106, the care receiving person 7 is allowed to releases the pressed-down input IF 6 to make the controller 12 stop controlling the standing-up operation and driving the arm mechanism 4 in the middle of the standing-up operation.

Next, in step S107, the care receiving person 7 turns off the front-wheel brake 14*c* and the rear-wheel brake 14*d* by operating the input IF 6.

Furthermore, in step S108, the care receiving person 7 turns off the power by operating the input IF 6. After the standing-up position is achieved as illustrated in FIG. 6E, if the care receiving person 7 applies force forward, then the force applied by the care receiving person 7 causes the front wheels 14*a* and rear wheels 14*b* to rotate, and thus the walking mechanism 14 serves as a walking assist apparatus to assist the care receiving person 7 to walk.

Effects of First Embodiment

The care belt 3 including the connector 3*c* and the holding mechanism 3*g* including the first holder 3*a* and the second holder 3*b* is provided on the arm mechanism 4, and the care belt 3 can be moved forward by putting it by the arm mechanism 4 under the control of the controller 12. Thus it is possible to assist the standing-up motion such that in the initial state of the standing-up motion (that is, in the first phase in which the buttocks 7*e* are moved away from the sitting position), the care receiving person 7 leans forward as slightly as possible thereby allowing the standing-up motion to be performed in a manner close to an operation of a normal adult person.

Second Embodiment

Figure 8:
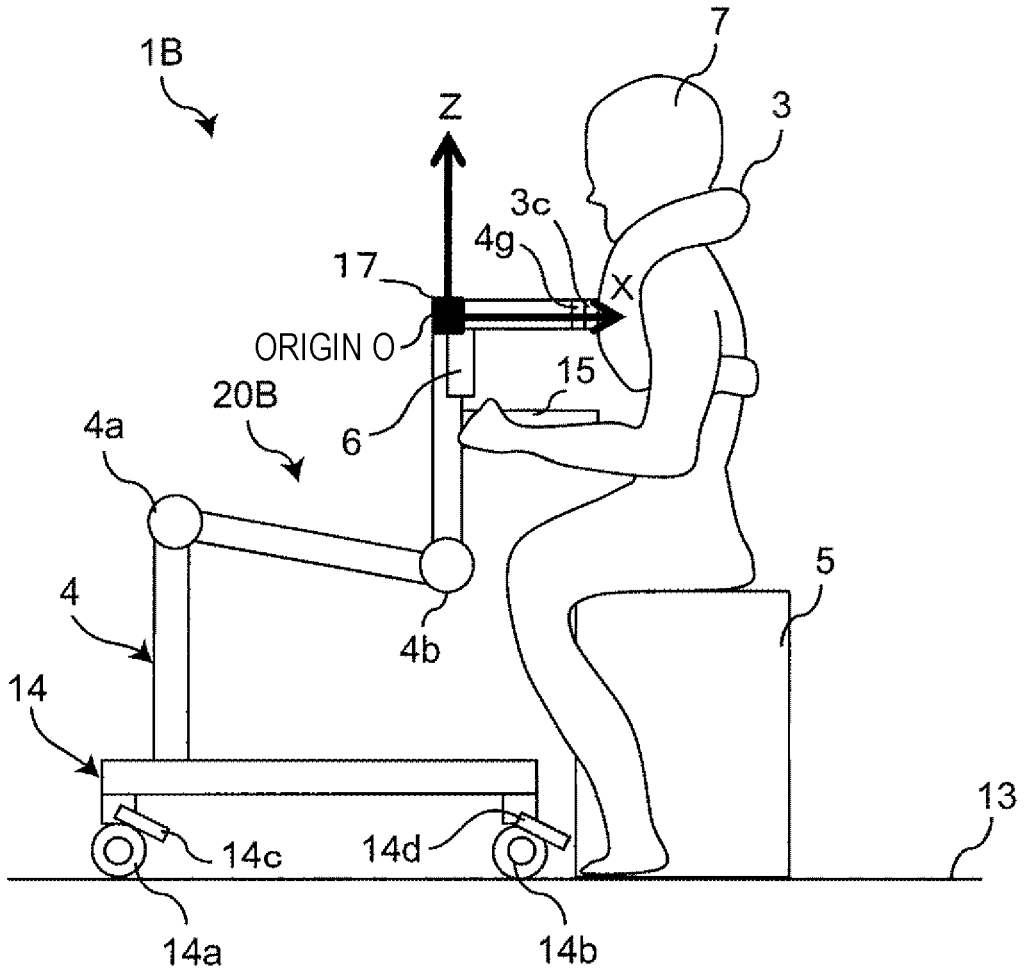
FIG. 8 is a diagram schematically illustrating a configuration of the robot system according to the second embodiment of the present disclosure
Figure 9:
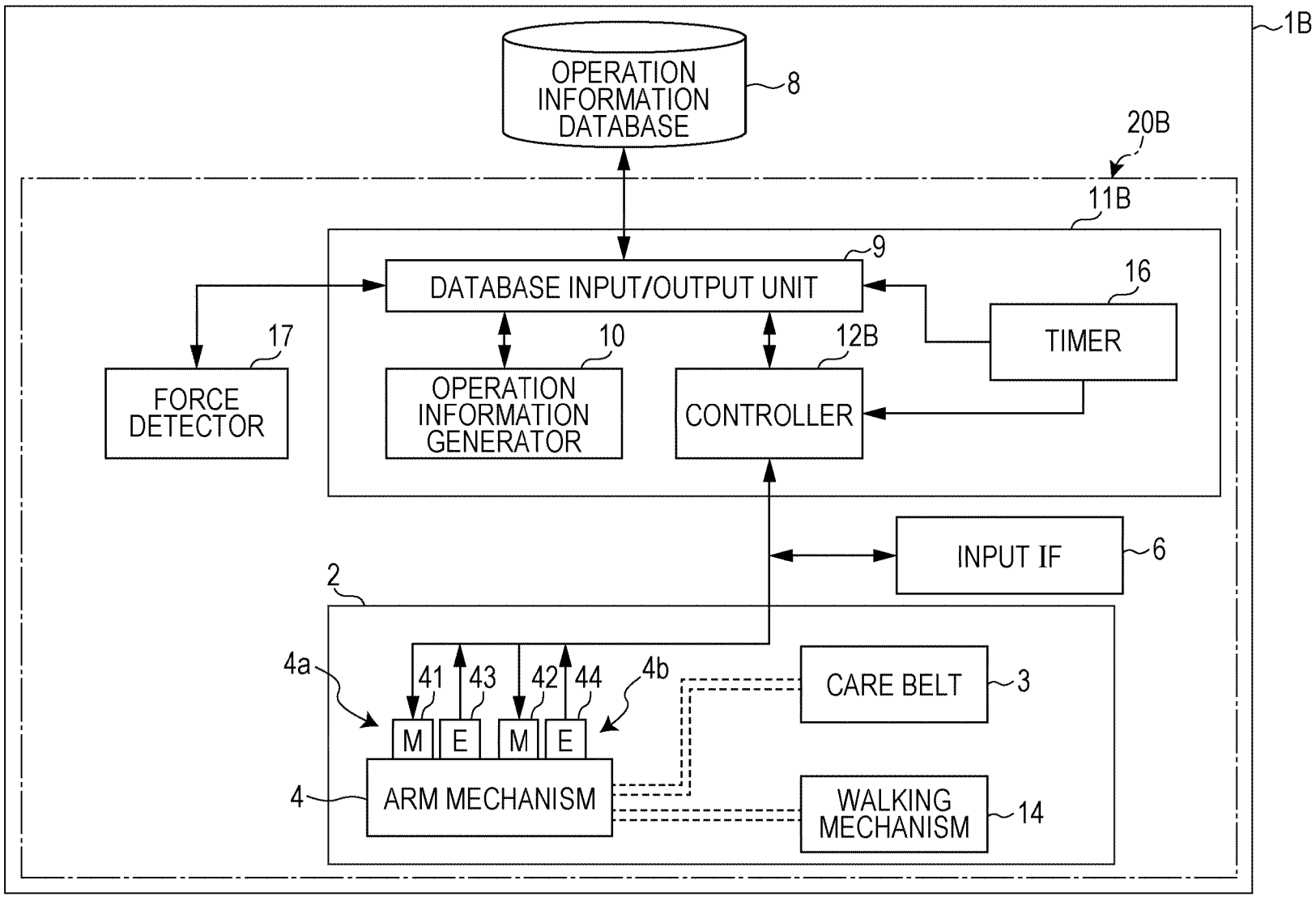
FIG. 9 is a block diagram illustrating a detailed configuration of the robot system according to the second embodiment of the present disclosure.

FIG. 8 illustrates a robot 20B which is included in a robot system 1B as an example of a standing-up motion assist system (that is, standing-up operation assist apparatus) according to a second embodiment of the present disclosure, and which is configured to, as an example of an operation using the robot system 1, assist a standing-up motion of a care receiving person 7 from a sitting position to a standing-up position. FIG. 9 is a block diagram illustrating a detailed configuration of the robot system 1B according to the second embodiment of the present disclosure.

The standing-up motion assist system 1B according to this second embodiment is significantly different from the first embodiment in that instead of acquiring operation information from the database input/output unit 9, an operation information generator 10 generates operation information based on position information and force detected by a force detector 17 which is an example of a force acquirer thereby acquiring the operation information, and thus, for this purpose, the standing-up motion assist system 1B additionally includes the force detector 17 and the operation information generator 10. The force detector 17 acquires information about force applied to the arm mechanism 4 from the outside. The operation information generator 10 generates operation information associated with the arm mechanism 4 from the information about the force acquired by the force detector 17 and the information about the position acquired from a first encoder 43 and a second encoder 44 described later. That is, in the second embodiment, the controller 12B controls the operation of the arm mechanism 4 based on the operation information generated by the operation information generator 10, as described in detail below.

Also in this second embodiment, as in the first embodiment described with reference to FIG. 1A to FIG. 2, the robot 20B of the robot system 1B is placed on a floor 13. The robot 20B includes a main mechanism 2, the control apparatus 11B, an input IF 6, and the force detector 17.

The main mechanism 2 includes, as in the first embodiment, an arm mechanism 4, a care belt 3, and a walking mechanism 14.

The control apparatus 11B includes a database input/output unit 9, a timer 16, a controller 12B, and the operation information generator 10.

The walking mechanism 14, the care belt 3, the timer 16, and the input IF 6 are similar to those according to the first embodiment, and thus a further description thereof is omitted.

As in the first embodiment, the care receiving person 7 is held by the holding mechanism 3*g* of the care belt 3 and sits on a sheet 5 (for example, a bed, a sheet, a toilet seat, or the like) when the care belt 3 is in the sitting position. An input IF 6 such as an operation board, on which a button and/or the like is disposed, is provided on a side of the arm mechanism 4 as in the first embodiment.

Next, differences from the first embodiment are described in detail below.

Force Detection Unit 17

First, the force detector 17 provided on the arm mechanism 4 detects force applied to the arm mechanism 4 by the care receiving person 7. The force detector 17 starts the detecting operation after the care receiving person 7 inputs operation start information of the robot system 1B via the input IF 6 (for example, by pressing down a button) thereby making the control apparatus 11B of the robot system 1B start a control operation. The force detector 17 detects the force that care receiving person 7 applies to the arm mechanism 4. Based on the force detected by the force detector 17 and the position of the arm mechanism 4, the operation information generator 10 generates operation information, and the controller 12B controls the operation of the arm mechanism 4.

More specifically, as illustrated in FIG. 8, the force detector 17 is disposed close to a connection part between the upper end of the third arm 4*e* of the arm mechanism 4 and the front end of the fourth arm 4*f*. Information about force applied to the arm mechanism 4 from the outside (for example, by the care receiving person 7) is detected by force detector 17. The information detected by the force detector 17 is stored together with time in the operation information database 8 via the database input/output unit 9. For example, the force detector 17 may be formed using a two-axis force sensor capable of measuring force in an up/down direction and force in a front/back direction of the robot system 1B or a three-axis force sensor capable of additionally detecting rotation in a forward direction.

Arm Mechanism 4

The arm mechanism 4 is disposed, as in the first embodiment, above the walking mechanism 14. For example, the arm mechanism 4 may be a two-degree-of-freedom arm including a first motor 41 and a first encoder 43 on a first joint and a second motor 42 and a second encoder 44 on a second joint. The control apparatus 11B controls the first motor 41 and the second motor 42 based on information given from the first encoder 43 and the second encoder 44 in a similar manner as in the first embodiment, thereby driving the robot system 1B by way of example as shown in FIG. 3A to FIG. 3C. The first encoder 43 and the second encoder 44 each function as an example of a position acquirer that acquires information about the position of the arm mechanism 4. Furthermore, a grab handle 15 is also provided as in the first embodiment such that the care receiving person 7 is allowed to grab the grab handle 15 with his/her hand when the care receiving person 7 is in the sitting position or when the care receiving person 7 stands up.

Operation Information Database 8

As in the first embodiment, the controller 12 is executed according to a command from the timer 16 such that the position information associated with the arm mechanism 4 (position information obtained by converting rotation angle information detected by the first encoder 43 and that detected by the second encoder 44 into position information associated with the arm mechanism 4) is generated at particular fixed time intervals (for example, every 1 millisecond) by the controller 12 and the database input/output unit 9 in response to the execution command from the timer 16. The generated position information is output together with time as operation information to the operation information database 8 via the database input/output unit 9 and is stored as the operation information in the operation information database 8. In the second embodiment, as will be described below, the operation information generator 10 generates operation information based on information stored in the operation information database 8 in terms of information about force detected by the force detector 17, the position information, and the time information, and the generated operation information is stored in the operation information database 8.

FIG. 10 illustrates an example of a content of information stored in a the operation information database 8.

(1) In fields of "time", information about a time during an operation of the arm mechanism 4 is described. In the second embodiment, time is expressed in units of milliseconds.

(2) Information described in fields of "position" describes a position of the arm mechanism 4 obtained by converting angle information detected by first and second encoders 43 and 44 of the arm mechanism 4. More specifically, as illustrated in FIG. 8, an origin O is defined on one end of the arm mechanism 4, and an x-axis is defined in a direction opposite to the moving direction of the robot system 1B and a z-axis is defined in an upward direction. The position information for the arm mechanism 4 is given by positions represented by relative coordinates from the origin on the two axes, that is, the x-axis and the z-axis, described above. In the second embodiment, the position is expressed in units of meters.

(3) Information described in fields of "force" describes for applied to the arm mechanism 4 detected by the force detector 17 disposed on the arm mechanism 4. More specifically, the force is represented by two components along the two axes, that is, the x-axis defined in the direction opposite to the moving direction of the robot system 1B and the z-axis defined in the upward direction. In the second embodiment, force is expressed in units of N.

Database Input/Output Unit 9

The database input/output unit 9 inputs and outputs data (information) among the operation information database 8, the controller 12, the force detector 17, and the operation information generator 10.

Operation Information Generator 10

The operation information generator 10 acquires information in terms of time, position, and force stored in the operation information database 8 via the database input/output unit 9, and generates operation information associated with the arm mechanism 4 based on the acquired information in terms of position and force. The generated operation information is stored in the operation information database 8.

Figure 11A:
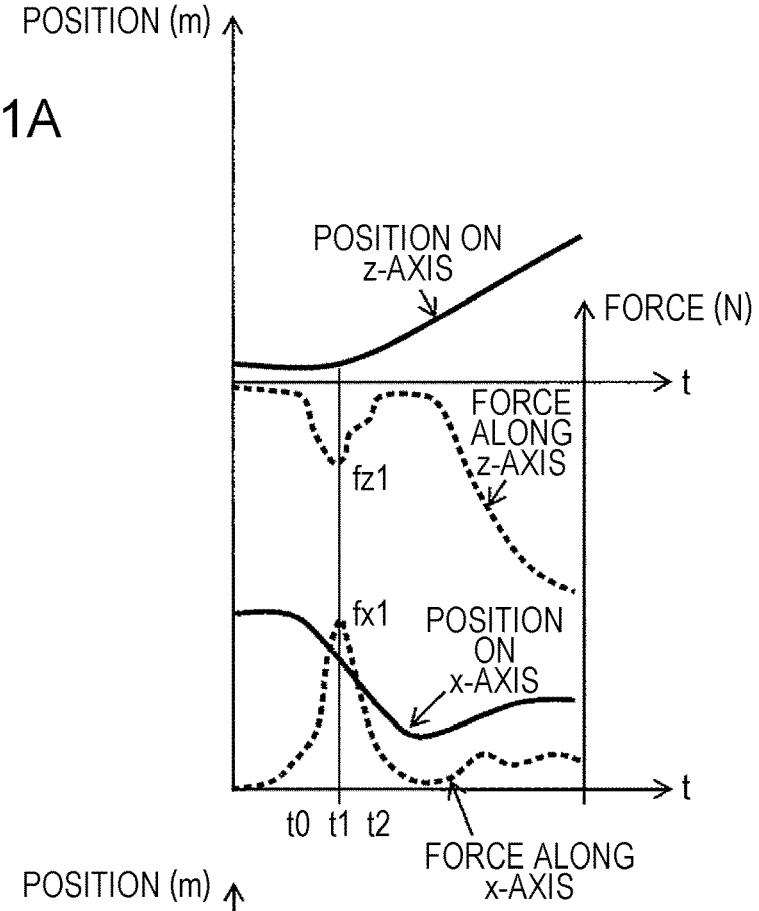
FIG. 11A is a graph of operation information according to the second embodiment of the present disclosure.

The generation of the operation information is further described below with reference to FIG. 11A. FIG. 11A illustrates a graph of operation information generated by the operation information generator 10. In FIG. 11A, a horizontal axis represents time, and a vertical axis represents information about a position on the x-axis and information about a position on the z-axis. Furthermore, information about force in the x-axis direction and force in the z-axis direction are also represented.

First, as illustrated in FIG. 6A, the care receiving person 7 starts a standing-up operation from the sitting position in which the care receiving person 7 sits on the sheet 5 (more specifically, a process from steps S201 to S203 similar to steps S101 to 103 according to the first embodiment is performed as described below). Next, the operation information generator 10 generates operation information according to which the controller 12B is to control operations of the first motor 41 and the second motor 42 independently such that the arm mechanism 4 is to be moved (step S205 described below) in a moving direction (for example, in a negative x-axis direction) as represented by a left-pointing arrow in FIG. 6B.

This operation in step S205 is performed during a period from time t0 to time t1 shown in FIG. 11A. At time t1, a large change occurs in force in the x-axis direction and force in the x-axis direction. This means that at time t1, the buttocks 7*e* start to move away from the sheet in response to the pulling in the forward direction. The moving of the buttocks 7*e* away from the sheet causes a reduction in force in the x-axis direction and a reduction in force in the x-axis direction.

The operation information generator 10 automatically detects this time t1. More specifically, based on forces in the x-axis direction and forces in the x-axis direction detected by the force detector 17 at time t1 and at time t0, the operation information generator 10 calculates the difference in force in the x-axis direction and the difference in force in the x-axis direction (for example, the difference between a first force at a first time (for example, time t1) and a second force at a second time (for example, time t0) earlier than the first time is calculated). Subsequently, also at time t2 and time t1, the operation information generator 10 calculates the difference in force in the x-axis direction and the difference in force in the x-axis direction (for example, the difference between a first force at a first time (for example, time t2) and a second force at a second time (for example, time t1) earlier than the first time is calculated). Similarly, the operation information generator 10 repeatedly calculates the difference in force between adjacent times.

Figure 11B:
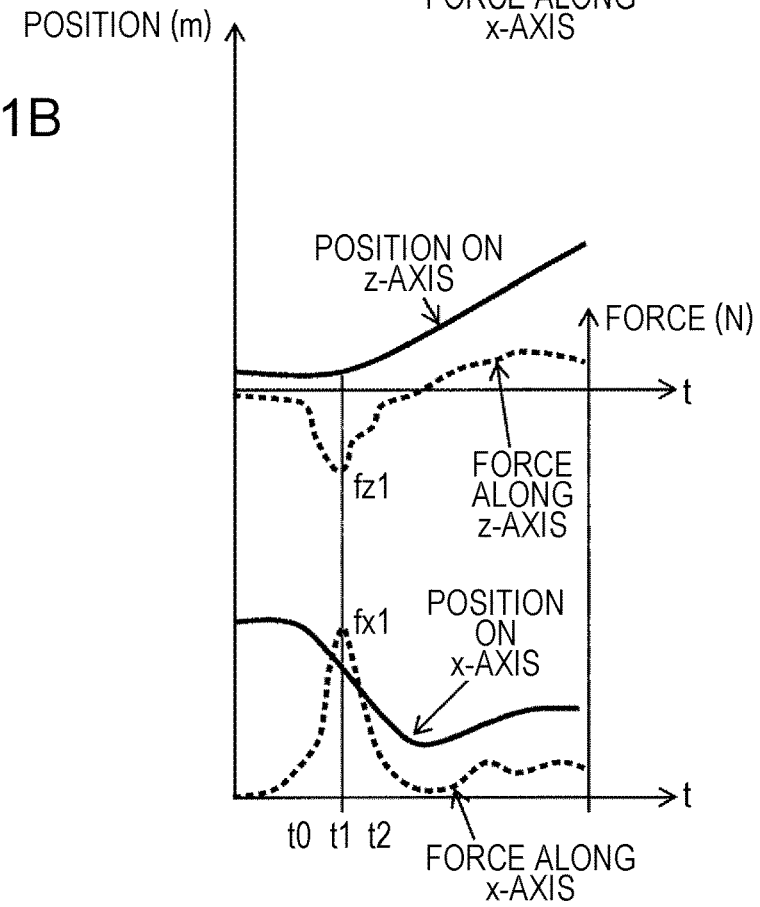
FIG. 11B is a graph of operation information according to the second embodiment of the present disclosure.
Figure 11C:
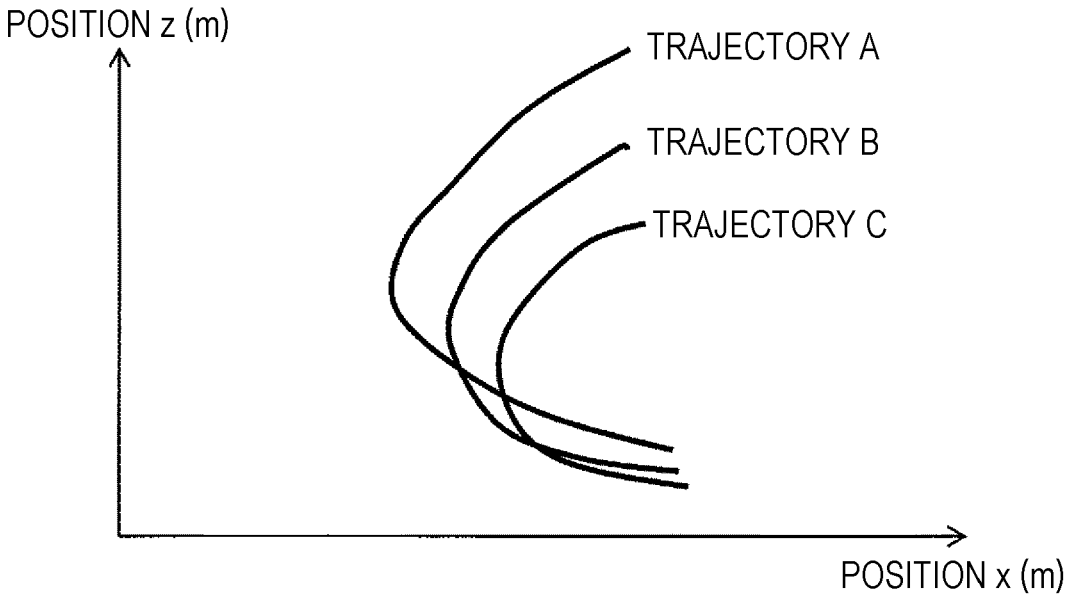
FIG. 11C is a graph illustrating a difference in a trajectory of a connector connected to an arm mechanism depending on a difference in a height of a care receiving person.
Figure 11D:
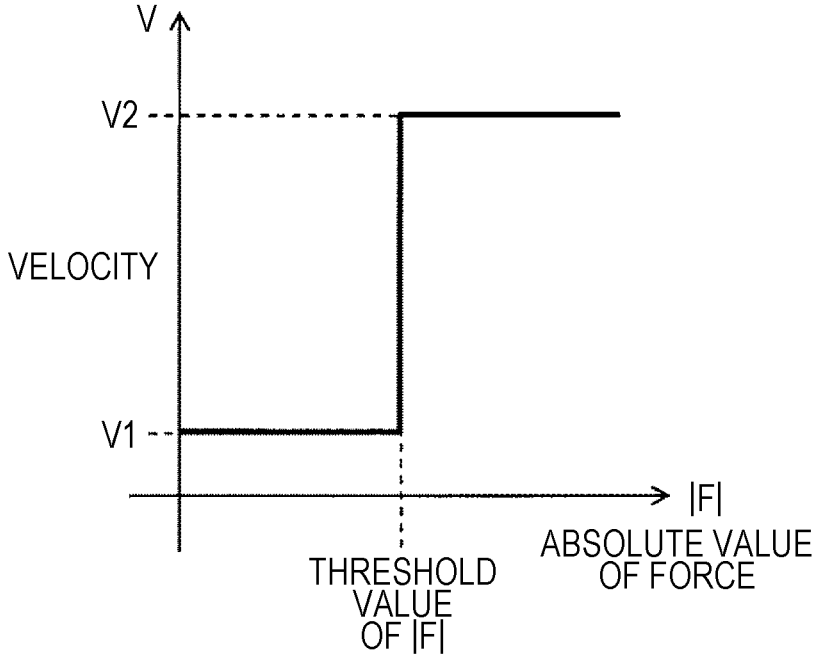
FIG. 11D is a graph illustrating an example of a manner in which a pulling speed is increased when the absolute value of force is equal to or greater than a threshold value according to the second embodiment of the present disclosure.

The operation information generator 10 detects a point of time at which an inversion occurs in the sign of the difference. Note that a large change in force occurs at time t1 immediately before the point of time (time t2 in this specific example) at which the inversion of the sign of the difference is detected. Hereinafter, the time at which the large change in force occurs will be referred to as a turning point. At a point of time at which the turning point is detected by the operation information generator 10, the operation information generator 10 generates operation information that is to cause the position on the z-axis to be moved upward (more specifically, the position on the z-axis is moved upward after time t1 in FIG. 11A). That is, as illustrated in FIG. 11D, in a case where the absolute value |F| of the force F, detected by the force detector 17 after an inversion occurs in the sign of the difference between the first force and the second force, is equal to or greater than a threshold value, the operation information generator 10 generates operation information such that the arm mechanism 4 pulls the second connector 3*cb* in the upward direction at a pulling speed V2 higher than a speed V1 as of before the occurrence of the inversion of the sign of the difference. The absolute value |F| may be, for example, 10 [N], and the speed V2 may be, for example, 1.1×V1 (that is, the speed V2 is higher than the speed V1 by 10%).

Figure 11E:
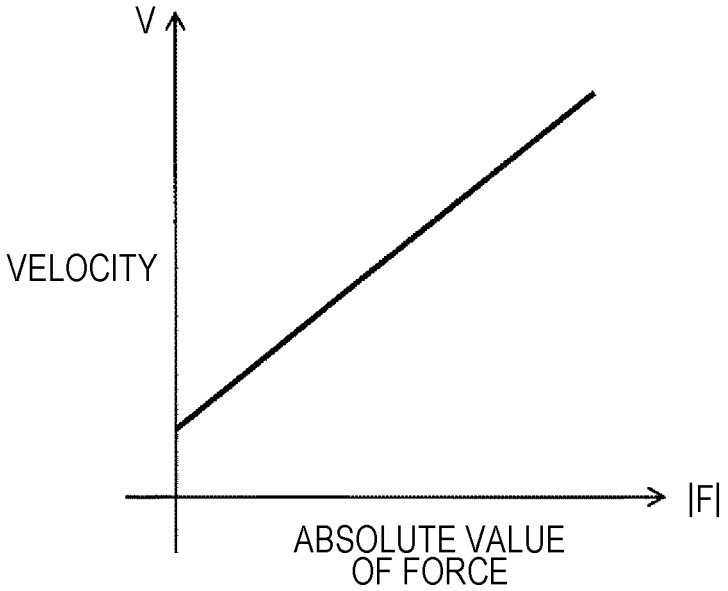
FIG. 11E is a graph illustrating an example of a manner in which the pulling speed is increased as the absolute value of force increases according to the second embodiment of the present disclosure.

In another example, as illustrated in FIG. 11E, the operation information generator 10 may generate operation information such that the pulling speed V at which the arm mechanism 4 pulls the second connector 3*cb* in the upward direction is increased as the absolute value |F| of the force F detected by the force detector 17 increases. In the example shown in FIG. 11E, the absolute value |F| of the force F is directly proportional to the pulling speed V.

Figure 11F:
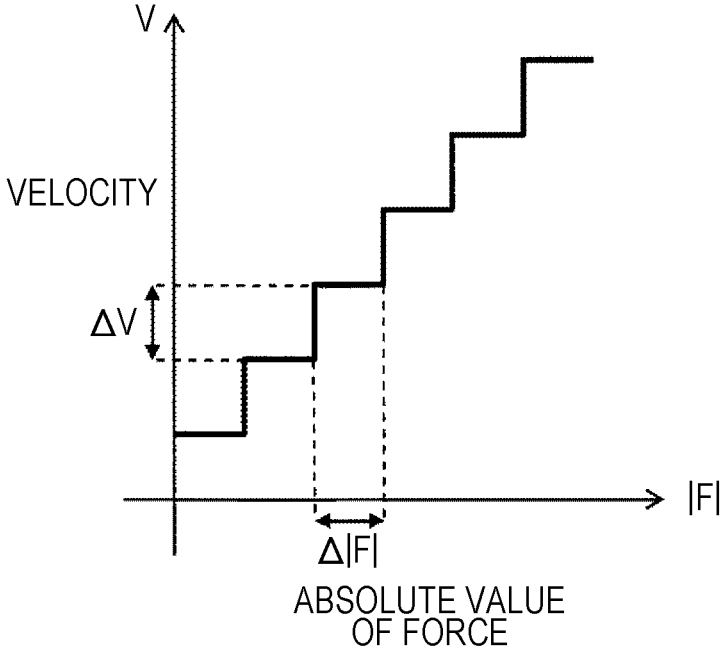
FIG. 11F is a graph illustrating another example of a manner in which the pulling speed is increased as the absolute value of force increases according to the second embodiment of the present disclosure.

Note that this example includes a case shown in FIG. 11F. In FIG. 11F, the relationship between the pulling speed V and the absolute value |F| of the force F is represented by a graph that varies in a stepwise from a bottom left point to an upper right point. Also in this case, macroscopically, the pulling speed V can be regarded as being directly proportional to the absolute value |F| of the force F. Therefore, also in the case shown in FIG. 11F, as in the case shown in FIG. 11E, the pulling speed V is increased as the absolute value |F| of the force F increases. Δ|F| may be, for example, 1 [N], and AV may be, for example, 1 [m/sec].

That is, in the pulling speed control scheme described above, as illustrated in FIG. 6C, the operation information generator 10 generates operation information that defines the operation of the arm mechanism 4 in terms of moving upward while moving forward. Furthermore, because the upper part of the body of the care receiving person 7 is held by the first holder 3*a* of the holding mechanism 3*g*, the back bending of the upper part of the body of the care receiving person 7 works effectively for the care receiving person 7 to more easily stand up. Although in the present example, the turning point in terms of the force in the x-axis direction and the x-axis direction is detected, the turning point may be detected based only on one of force components. For example, the turning point may be detected based on force along the x-axis.

Subsequently, the operation information generator 10 generates information indicating force in the z-axis direction that determines the speed at which the care receiving person 7 is to be lifted upward as illustrated in FIG. 6D.

More specifically, in a case where the force applied along the z-axis is in the downward direction at time t1 and in the following period as shown in FIG. 11A, the care receiving person 7 is to be lifted upward at a speed sz by the arm mechanism 4. The speed sz may be varied depending on the force being applied in the z-axis direction such that the speed sz is increased in the upward direction as the force being applied in the z-axis direction increases (that is, as the value of the speed sz increases in the negative direction), but conversely, the speed sz is reduced as the force being applied in the z-axis direction decreases. However, in a case where the force applied along the z-axis at time t1 and in the following period is in the upward direction as shown in FIG. 11B, the operation information generator 10 generates information indicating force in the z-axis direction such that the speed, at which the care receiving person 7 is to be lifted upward in the z-axis direction by the arm mechanism 4, is increased until reaching a position where the force becomes equal to zero. In another example, the speed sz may be varied depending on the force applied in the z-axis direction such that the speed sz is increased in the upward direction as the force being applied upward in the z-axis direction increases (that is, as the value of the speed sz increases in the positive direction) but conversely, the speed sz is reduced as the force being applied in the z-axis direction decreases. Note that the increasing rate of the speed sz may be varied depending on the sign of the force in the z-axis direction, or depending on the height or the weight of the care receiving person. That is, in a case where the muscle strength of the lower part of the body is strong enough for the care receiving person 7 to stand up with his/her own muscle strength, the lifting speed may be increased following the motion of the care receiving person 7 so as to allow the care receiving person 7 to smoothly stand up. Note that in this example, the operation information is generated by the operation information generator 10 such that the speed is increased until reaching a position where the force becomes equal to zero, the operation information may be generated by the operation information generator 10, for example, such that the speed is reduced until the direction of the force along the z-axis applied by the arm mechanism 4 becomes upward. In this mode, a load is imposed on the lower part of the body of the care receiving person 7, and thus this mode may be used for the purpose for providing a rehabilitation to the care receiving person 7. In a case where the force applied along the axis is in the downward direction, when the speed is varied depending on the force, the increasing rate of the speed may be set to be low such that the speed does not become very large in response to the applied force. In this case, the speed is not increased in response to the force applied by the care receiving person 7, and thus the care receiving person 7 does not feel a sense of being greatly assisted, which may allow the care receiving person 7 to have a rehabilitation in which the care receiving person 7 is supposed to try to stand up with his/her own muscle strength of the lower part of the body. The operation information may be generated by the operation information generator 10 such that when the direction of the force applied by the care receiving person 7 is changed from the upward direction to the downward direction, the speed is to be greater than 0 when the force F becomes equal to zero. This makes it possible to prevent the speed sz from becoming equal to zero when the force F becomes equal to zero during the process in which the direction of the force F changes from the upward direction to the downward direction, which makes it possible for the care receiving person 7 to smoothly stand up. Alternatively, the operation information may be generated by the operation information generator 10 such that the speed is to become equal to zero when the force F becomes equal to zero, that is, the assisting operation is stopped when an inversion occurs in the sign of the force F. In this case, "stopping the assisting operation" indicates that the direction of the force F applied by the care receiving person 7 is changed from the downward direction to the upward direction, that is, the care receiving person 7 is trying to stand up with his/her own force. The ending position shown in FIG. 6E is determined in advance depending on the height of the care receiving person 7. In a case where the force applied along the z-axis at time t1 and in the following period is in the downward direction, the lifting speed in the upward direction along the z-axis is increased until reaching a position where the direction of the force along the z-axis becomes upward. At a point of time when the direction of the force along the z-axis becomes upward, the lifting speed in the upward direction along the z-axis is not further increased, but the upward motion is continued at the constant speed. In this mode, in a case where the muscle strength of the lower part of the body of the care receiving person 7 is not strong enough for the care receiving person 7 to stand up with his/her own muscle strength, the lifting speed in the upward direction is increased such that it becomes possible for the care receiving person 7 to easily stand up. By stopping increasing the lifting speed at the point of time when the direction of the force becomes upward, it becomes possible to prevent the assist from being given more than necessary. This makes it possible to assist the motion of the care receiving person 7 such that when the care receiving person 7 tries to stand up with his/her own muscle strength of the lower part of the body, assisting is performed such that additional force needed by the care receiving person 7 is provided.

After the operation information generator 10 generates the operation information in the above-described manner, the operation information generator 10 stores the generated operation information in the operation information database 8 via the database input/output unit 9.

The value detected by the force detector 17 may be displayed on a monitor or the like provided, for example, on the arm mechanism 4 thereby providing information indicating how much force is being applied to the arm mechanism 4. The greater the force being applied is, the smaller the force of the lower part of the body is used by the care receiving person 7. Thus, it is possible for the care receiving person 7 to recognize the degree of advance of the rehabilitation from the indicated value. Furthermore, by making a comparison with the past force information stored, it is possible to check whether how effective the rehabilitation has been.

Controller 12B

The controller 12B operates the first motor 41 and the second motor 42 of the arm mechanism 4 such that the arm mechanism 4 moves according to the position information and the force information described in the operation information input from the database input/output unit 9. Furthermore, the controller 12B controls braking operations of the front-wheel brake 14*c* and the rear-wheel brake 14*d* according to ON/OFF commands associated with the front-wheel brake 14*c* and the rear-wheel brake 14*d* input via the input IF 6.

The operation of the robot system 1B performed under the control of the controller 12B according to the operation information generated by the operation information generator 10 is described below.

A procedure of operating the arm mechanism 4 of the robot system 1B and a corresponding operation of a care receiving person are described below with reference to FIG. 6A to FIG. 6E and a flow chart shown in FIG. 12.

As illustrated in FIG. 6A, the care receiving person 7 sits on the sheet 5 such as a bed or the like placed on the floor 13. Next, a caregiver or the like places the robot 20B of the robot system 1B in front of the care receiving person 7 sitting on the sheet 5.

Figure 12:
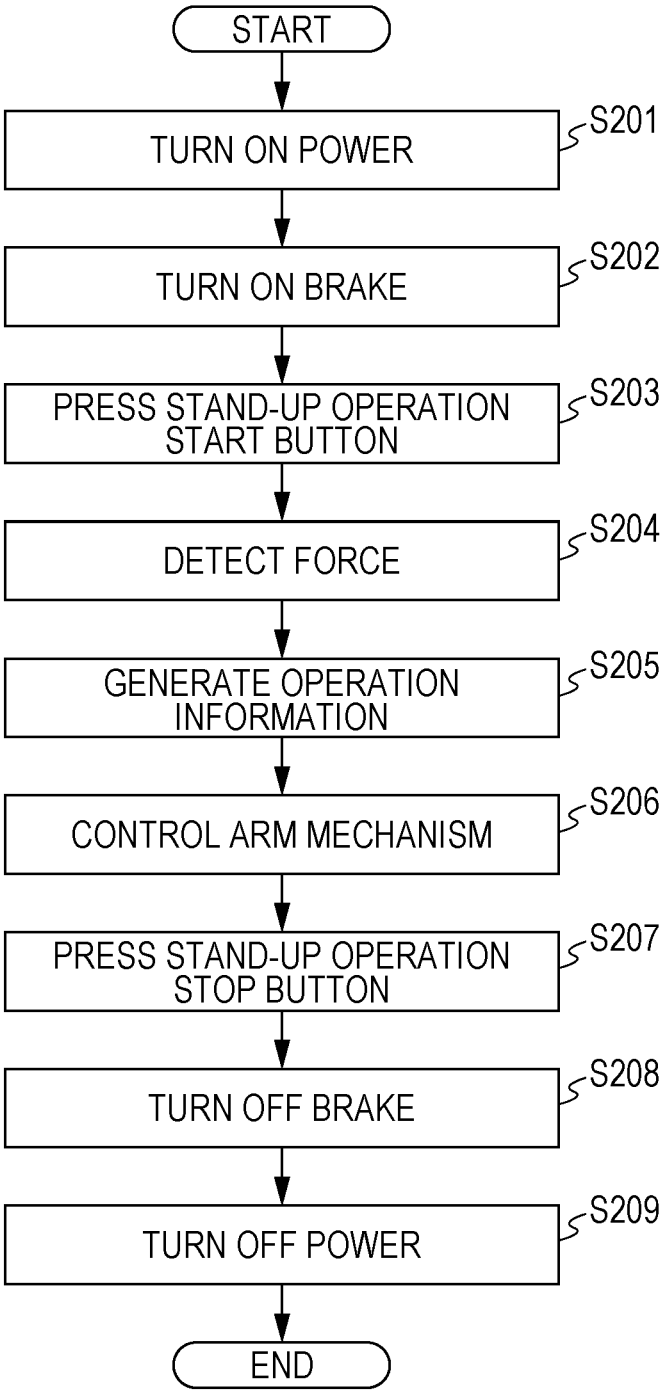
FIG. 12 is a flow chart illustrating an operation of a controller according to the second embodiment of the present disclosure.
Figure 13:
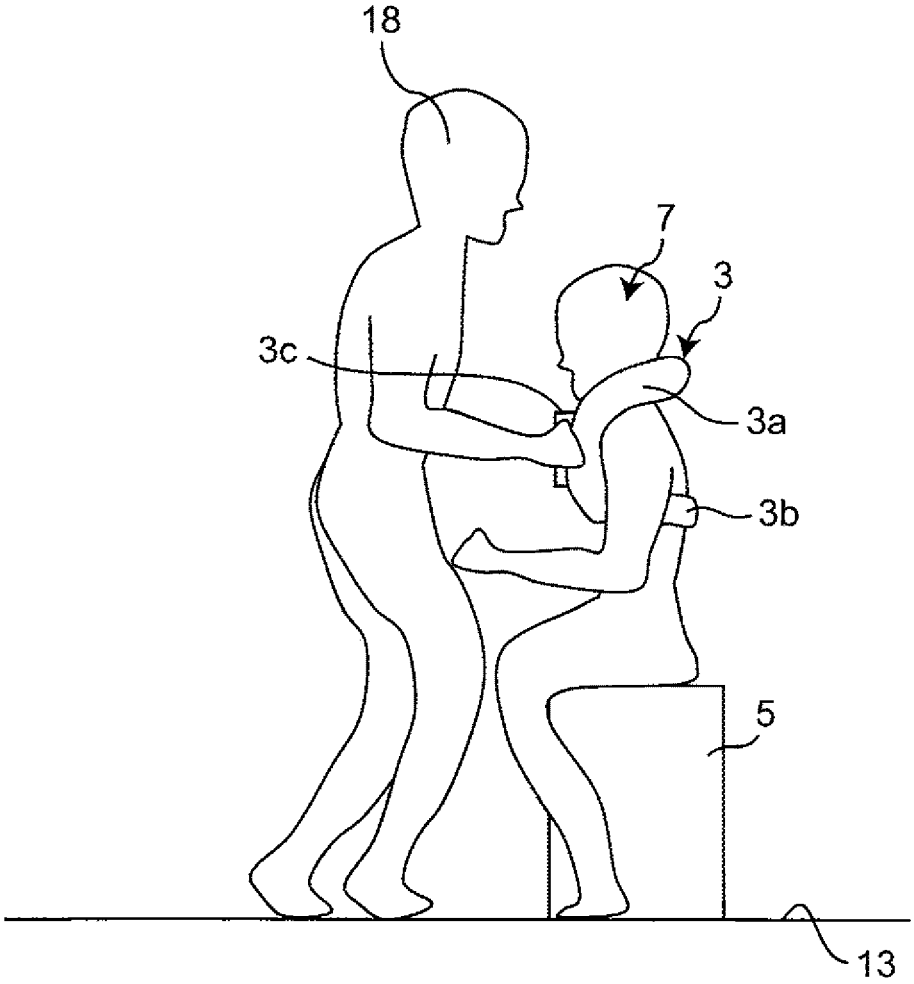
FIG. 13 is a diagram schematically illustrating a configuration of the holding mechanism according to the third embodiment of the present disclosure in which a care receiving person is also illustrated.

Next, in step S201 in FIG. 12, the care receiving person 7 turns on the power of the robot system 1B by operating the input IF 6 of the robot 20B.

Next, in step S202, the care receiving person 7 turns on the front-wheel brake 14*c* and the rear-wheel brake 14*d* by operating the input IF 6. In response, the controller 12B performs braking such that front wheels 14*a* and rear wheels 14*b* of the walking mechanism 14 are not allowed to rotate.

Next, the care receiving person 7 wears the holding mechanism 3*g* of the care belt 3 connected to the arm mechanism 4 such that the holding mechanism 3*g* is tied around a body of the care receiving person 7, and the care receiving person 7 grabs the grab handle 15 with his/her both hands.

Next, in step S203, the care receiving person 7 presses down a standing-up operation start button on the input IF 6. In response, the robot system 1B starts to operate. In this example, the robot system 1 operates when the standing-up operation start button is in the pressed-down state, but the robot system 1B stops the operation when the standing-up operation start button is released. In the following process from step S204 to step S206, the control apparatus 11B of the robot system 1B controls the operations of the first driving unit 4*a* and the second driving unit 4*b* of the arm mechanism 4 independently such that the buttocks 7*e* of the care receiving person 7 in the sitting position shown in FIG. 3A move away from the sheet 5 as illustrated in FIG. 3B in the assisting of the standing-up motion show in FIG. 3C.

Next, in step S204, the force detector 17 detects the force applied by the care receiving person 7 to the arm mechanism 4.

Next, in step S205, the operation information generator 10 generates operation information based on the force detected by the force detector 17 and the position information associated with the arm mechanism 4, and the operation information generator 10 stores the generated operation information in the operation information database 8 via the database input/output unit 9.

Next, in step S206, the controller 12B acquires operation information from the database input/output unit 9, and the controller 12B controls driving the first motor 41 and the second motor 42 independently such that the arm mechanism 4 is driven according to the operation information acquired from the database input/output unit 9.

More specifically, for example, under the control of the controller 12B, the arm mechanism 4 moves in a forward direction (in a direction to the left in FIG. 6A) as illustrated in FIG. 6A and FIG. 6B. As a result, as illustrated in FIG. 6B, the first holder 3*a* and the second holder 3*b* of the holding mechanism 3*g* are both pulled simultaneously in the forward direction by the arm mechanism 4. In the operation, the pulling the first holder 3*a* forward by the arm mechanism 4 via the connector 3*c* urges the upper part of the body of the care receiving person 7 to be bent back as represented by a clockwise dashed-line arrow A in FIG. 6B. Furthermore, by pulling the second holder 3*b* forward via the connector 3*c*, it becomes possible to urge the pelvis of the care receiving person 7 to be leaned forward as represented by a counter-clockwise dashed-line arrow B in FIG. 6B. By assisting the forward leaning of the care receiving person 7 by the arm mechanism 4 as described above, it becomes possible to urge the buttocks 7*e* of the care receiving person 7 to move away from the sheet 5, and simultaneously urge the upper part of the body of the care receiving person 7 to be bent back thereby making it easy for the care receiving person 7 to stand up from the sheet 5. Furthermore, by urging the upper part of the body of the care receiving person 7 to be bent back, it becomes possible for the care receiving person 7 to smoothly move from the sitting position to the standing-up position without having to take a deep forward leaning position.

Next, as illustrated in FIG. 6C, when the buttocks 7*e* of the care receiving person 7 move away from the sheet 5 (that is, at the end of the first phase), the controller 12B controls the driving of the arm mechanism 4 such that the arm mechanism 4 moves upward as represented by an upward arrow in FIG. 6D.

In this second embodiment, the operation information generator 10 generates operation information based on the force detected by the force detector 17 and the position information associated with the arm mechanism 4. Therefore, the operation information generator 10 is capable of generating operation information adaptively depending on a difference in height of the care receiving person 7, a difference in the forward leaning speed, and/or other factors.

As an example, a description is given below referring to FIG. 11C as to how the trajectory of connector 3*c* connected to the arm mechanism 4 differs depending on the difference in height of the care receiving person 7. In FIG. 11C, a vertical axis represents a z-axis of the robot system 1 defined in a vertical direction, and a horizontal axis represents an x-axis defined in a running direction (for example, a forward direction) of the robot system 1. A trajectory A in FIG. 11C represents a trajectory of the connector 3*c* for a care receiving person 7 with a height 180 cm. A trajectory B in FIG. 11C represents a trajectory of the connector 3*c* for a care receiving person 7 with a height 167 cm. A trajectory C in FIG. 11C represents a trajectory of the connector 3*c* for a care receiving person 7 with a height 155 cm. The higher the height, the higher the trajectory. Conversely, the lower the height, the lower the trajectory.

As described above, the upward movement of the arm mechanism 4 assists the care receiving person 7 to move in the upward direction until the care receiving person 7 reaches the final standing-up position as illustrated in FIG. 6E, and the standing-up operation is completed.

Next, in step S207, the care receiving person 7 releases the pressed-down input IF 6 (that is, the care receiving person 7 removes his/her finger from it). In response, the controller 12B stops controlling the standing-up operation and the operation of the arm mechanism 4. Note that even before step S207, the care receiving person 7 is allowed to releases the pressed-down input IF 6 to make the controller 12B stop controlling the standing-up operation and driving the arm mechanism 4 in the middle of the standing-up operation.

Next, in step S208, the care receiving person 7 turns off the front-wheel brake 14*c* and the rear-wheel brake 14*d* by operating the input IF 6.

Furthermore, in step S209, the care receiving person 7 turns off the power by operating the input IF 6. After the standing-up position is achieved as illustrated in FIG. 6E, if the care receiving person 7 applies a force forward, the force applied by the care receiving person 7 causes the front wheels 14*a* and rear wheels 14*b* to rotate and thus the walking mechanism 14 serves as a walking assist apparatus to assist the care receiving person 7 to walk.

Effects of Second Embodiment

The operation information generator 10 generates operation information associated with the arm mechanism 4 based on the position information stored in the operation information database 8 and the force detected by the force detector 17 and stored in the operation information database 8, and thus, the operation information generator 10 is capable of generating operation information adaptively depending on a difference in height, a difference in the forward leaning speed, and/or other factors. Thus it is possible to assist the operation of the care receiving person 7 such that in the initial state of the standing-up motion (that is, in the first phase in which the buttocks 7*e* are to be moved away from the sitting position), the care receiving person 7 is allowed to lean forward as slightly as possible thereby making it possible to assist the standing-up motion to be performed in a manner close to a manner to an operation of a normal adult person.

Third Embodiment

FIG. 13 and FIG. 14A to FIG. 14D illustrate a manner in which a caregiver 18 assists a care receiving person 7 to move from a sitting position to a standing-up position by using a care belt 3, which does not include the arm mechanism 4 and the walking mechanism 14, according to a third embodiment of the present disclosure. In this embodiment, the caregiver 18 is allowed to grab the connector 3*c* located on a chest 7*d* of the care receiving person 7 and connecting, in front of the care receiving person 7, a first holder 3*a* and a second holder 3*b*.

Figure 14A:
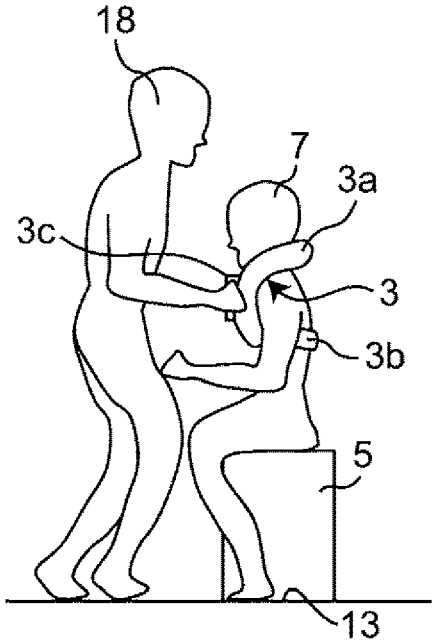
FIG. 14A is a diagram schematically illustrating an operation using the holding mechanism according to the third embodiment of the present disclosure.
Figure 14B:
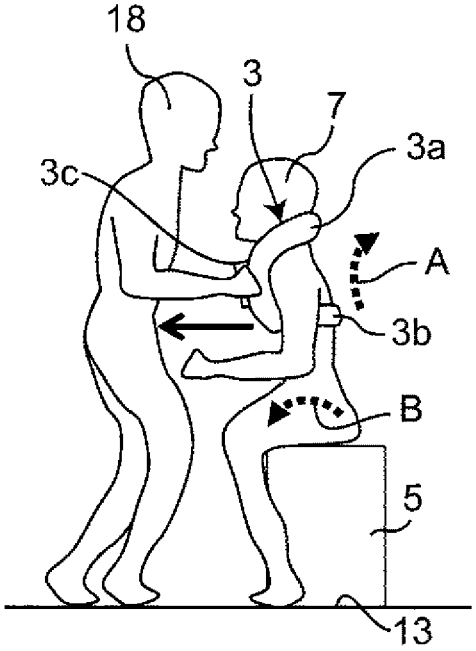
FIG. 14B is a diagram schematically illustrating an operation using the holding mechanism according to the third embodiment of the present disclosure.

As illustrated in FIG. 14A, the care receiving person 7 wears the care belt 3 such that the upper part of the body of the care receiving person 7 is held by the care belt 3. The caregiver 18 grabs the connector 3*c* of the care belt 3 and pulls the connector 3*c* toward the caregiver 18. When the caregiver 18 pulls the connector 3*c* toward the caregiver 18, force is transferred from the caregiver 18 to the first holder 3*a* and the second holder 3*b*, and this force urges the care receiving person 7 to move the buttocks 7*e* away from the sheet 5 as represented by a counterclockwise dashed-line arrow B in FIG. 14B and to bend back the upper part of the body as represented by a clockwise dashed-line arrow A in FIG. 14B. In this assisting operation, it is important for the caregiver 18 to simultaneously pull both the first holder 3*a* and the second holder 3*b* of the holding mechanism 3*g* in the forward direction away from the care receiving person 7. That is, the caregiver 18 pulls both the first holder 3*a* and the second holder 3*b* of the holding mechanism 3*g*, simultaneously, as represented by an arrow in FIG. 14B such that the care receiving person 7 is pulled forward from his/her sitting position. When the caregiver 18 pulls the first holder 3*a* and the second holder 3*b* simultaneously, the first region R1 of the neck part 7*a* or the back part 7*b* of the care receiving person 7 is first pulled forward so as to straighten up the back of the care receiving person 7, thereby making it possible for the care receiving person 7 to easily stand up. Furthermore, while performing the pulling operation described above, the second region R2 of the lumbar part 7*c* of the care receiving person 7 is pulled forward, so as to make it possible for the care receiving person 7 to easily move his/her pelvis forward and easily move away from the sheet 5. Therefore, compared with the case in which the second region R2 of the lumbar part 7*c* is simply pulled forward, the pulling both the first region R1 and the second region R2 simultaneously makes it possible for the care receiving person 7 to more easily move his/her buttocks 7*e* away from the sheet 5.

Figure 14C:
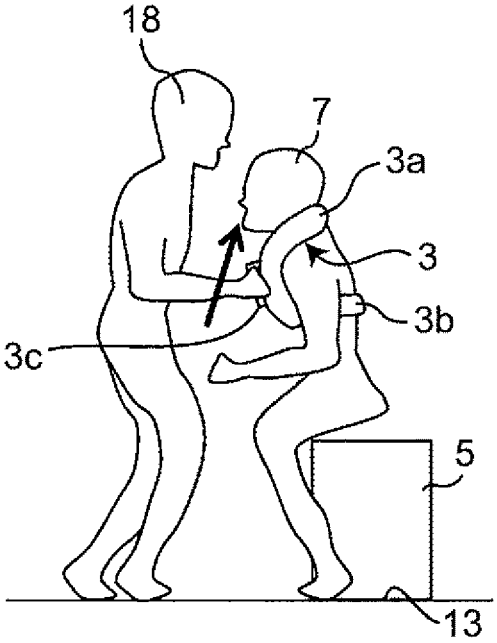
FIG. 14C is a diagram schematically illustrating an operation using the holding mechanism according to the third embodiment of the present disclosure.
Figure 14D:
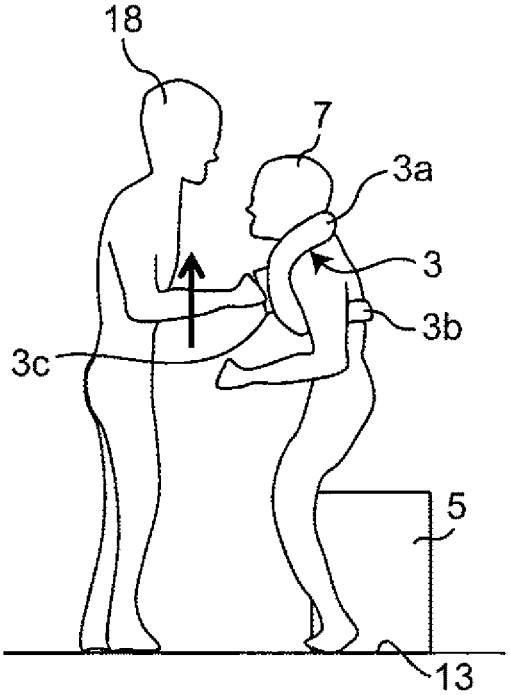
FIG. 14D is a diagram schematically illustrating an operation using the holding mechanism according to the third embodiment of the present disclosure.

Subsequently, as illustrated in FIG. 14C, after the caregiver 18 confirms that the buttocks 7*e* of the care receiving person 7 have moved away from the sheet 5, the caregiver 18 applies a force to the care belt 3 via the connector 3c such that the care belt 3 is lifted up in an upward and slightly backward direction. In this operation, the caregiver 18 supports the armpits 7g of the care receiving person 7 by using the second holder 3b or the third holder 3h of the care belt 3 such that the care receiving person 7 starts the standing-up motion.

Figure 15A:
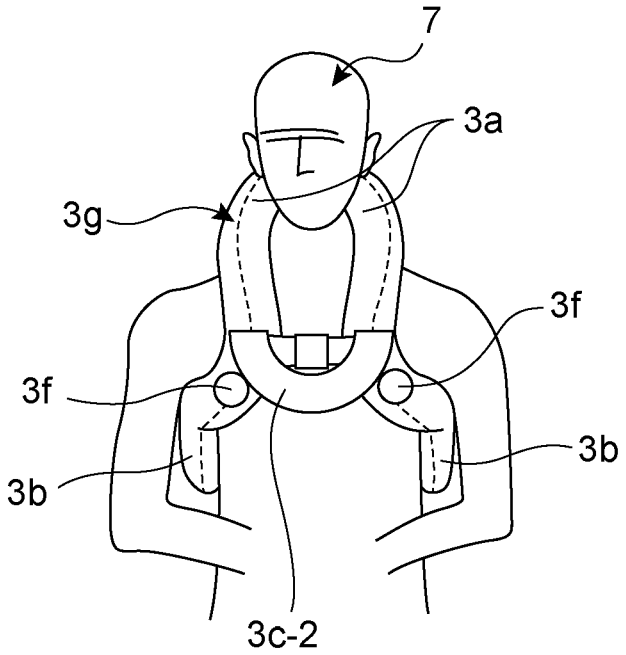
FIG. 15A is a front view illustrating a detailed configuration of a holding mechanism according to a modification of the third embodiment of the present disclosure in a state in which the holding mechanism is worn by a care receiving person.
Figure 15B:
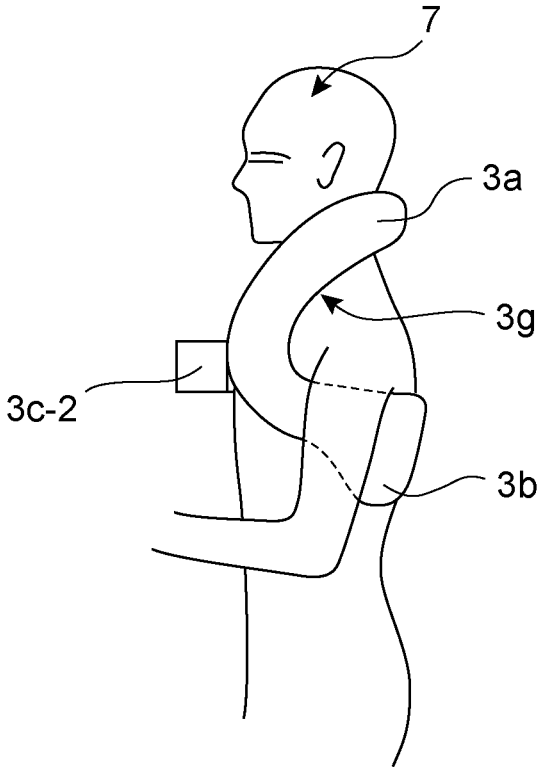
FIG. 15B is a side view illustrating a detailed configuration of a holding mechanism according to a modification of FIG. 15A in a state in which the holding mechanism is worn by a care receiving person.

To make it possible for the caregiver 18 to more easily grab the connector 3c with his/her hands, a connector 3c-2 formed in a U-like shape may be employed as the connector 3c as illustrated in FIG. 15A and FIG. 15B.

Figure 16A:
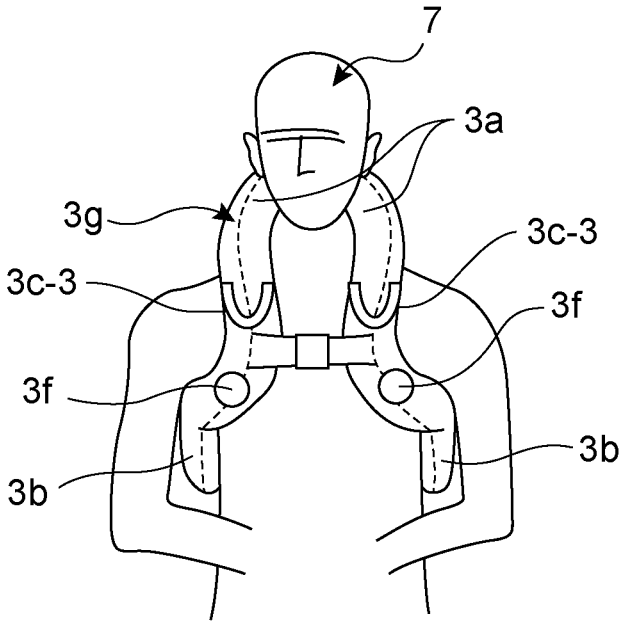
FIG. 16A is a front view illustrating a detailed configuration of a holding mechanism according to another modification of the third embodiment of the present disclosure in a state in which the holding mechanism is worn by a care receiving person.
Figure 16B:
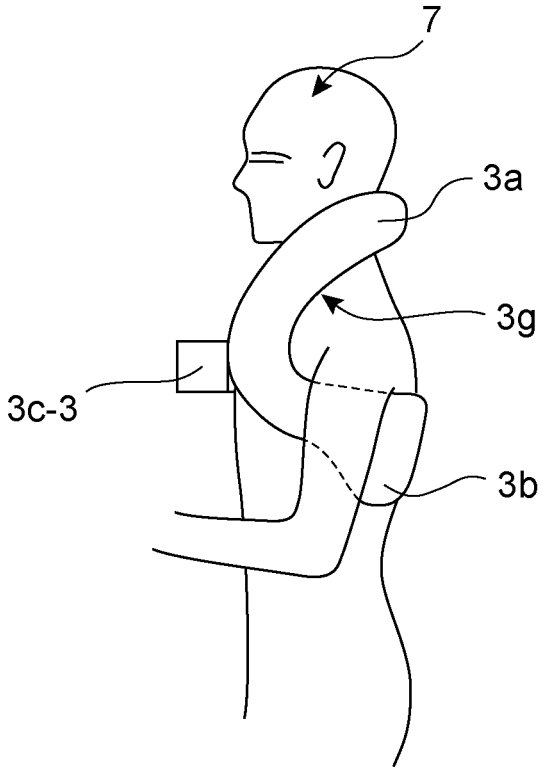
FIG. 16B is a side view illustrating a detailed configuration of a holding mechanism according to a modification of FIG. 16A in a state in which the holding mechanism is worn by a care receiving person.

Note that the number of connectors 3c is not limited to one, but two or more connectors 3c may be provided. For example, as illustrated in FIG. 16A and FIG. 16B, one connectors 3c-3 curved in the U-like shape may be proved in each of the front parts of the hermetically-closed cylinder-shaped element in the U-like form.

Effect of Third Embodiment

When the care receiving person 7 wears the care belt 3, if the caregiver 18 pulls the connector 3c, it is possible to easily assist the care receiving person 7 to stand up.

Modifications of First, Second, and Third Embodiments

In the first embodiment and the second embodiment descried above, the robot system 1 or 1B includes the walking mechanism 14 including the arm mechanism 4. Alternatively, the arm mechanism 4 may be disposed on a sheet 5, such as a bed, a toilet, a wheelchair, or the like.

Figure 20:
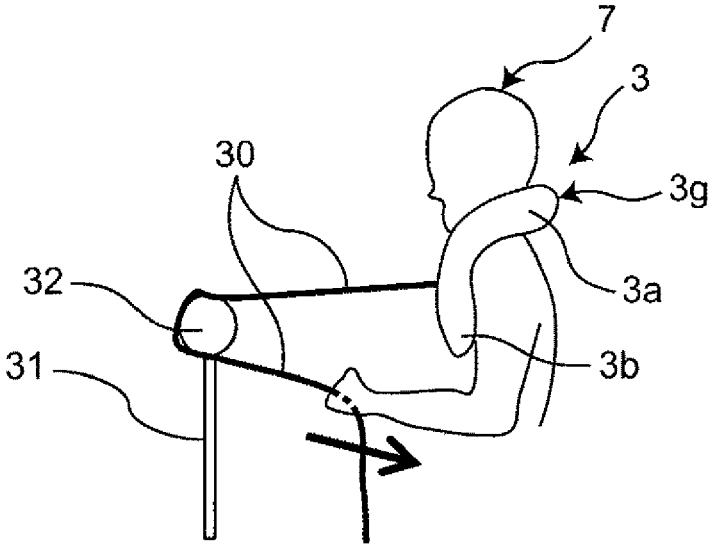
FIG. 20 is a diagram illustrating an arm mechanism according to a modification of the present disclosure.

In the first embodiment and the second embodiment descried above, the arm mechanism 4 is used as the pulling mechanism. However, the pulling mechanism is not limited to the arm mechanism 4. Any other type of pulling mechanism may be used as long as it is capable of applying a proper external force to the care belt 3 to assist the standing-up motion of the care receiving person 7. For example, as illustrated in FIG. 20, a pulley 32 may be rotatably disposed on an upper end of a pulley fixing element 31 vertically disposed on a floor 13. One end of a rope 30 is connected to a connector 3c of a care belt 3, and the other end of the rope 30 is a grabbed by a care receiving person 7 via the pulley 32. When the care receiving person 7 pulls the rope 30, the care belt 3 is pulled in a forward direction away from the care receiving person 7. Note that the configuration described above also falls within the scope of the pulling mechanism according to the present disclosure.

Figure 21A:
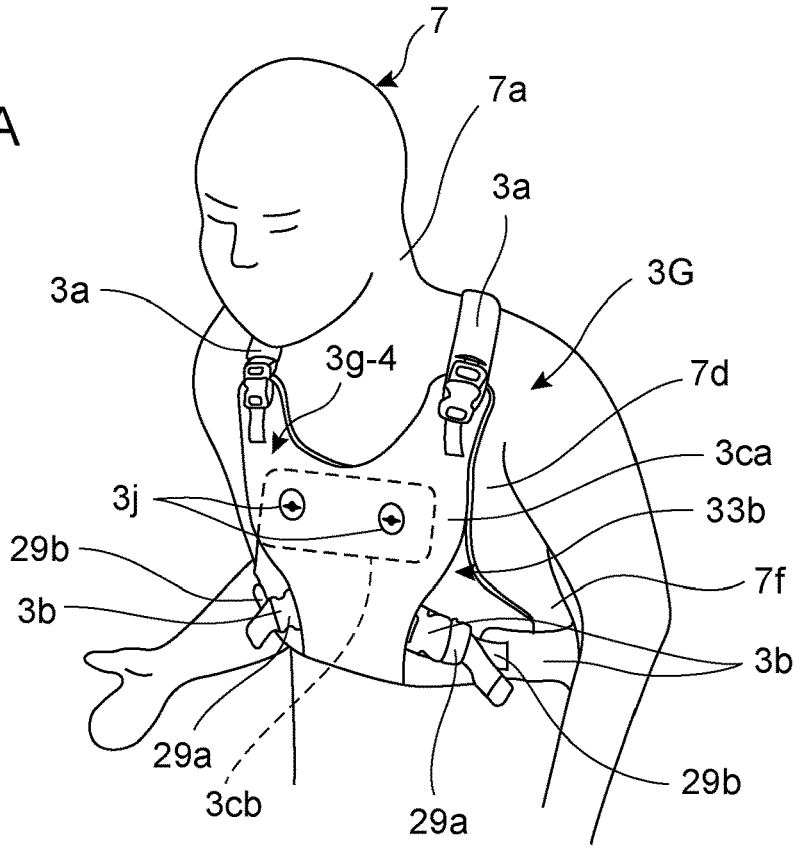
FIG. 21A is a perspective view illustrating a state in which a care receiving person wears the care belt according to the modification of the present disclosure.
Figure 21B:
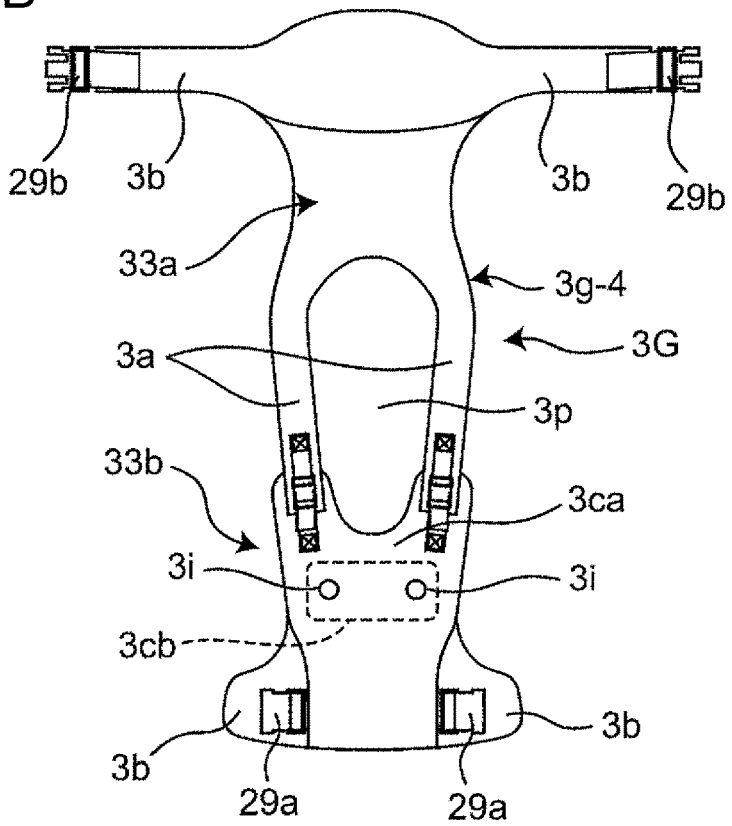
FIG. 21B is a diagram illustrating a surface (an external surface) of the care belt according to the modification shown in FIG. 21A in a state in which the care belt is developed.
Figure 21C:
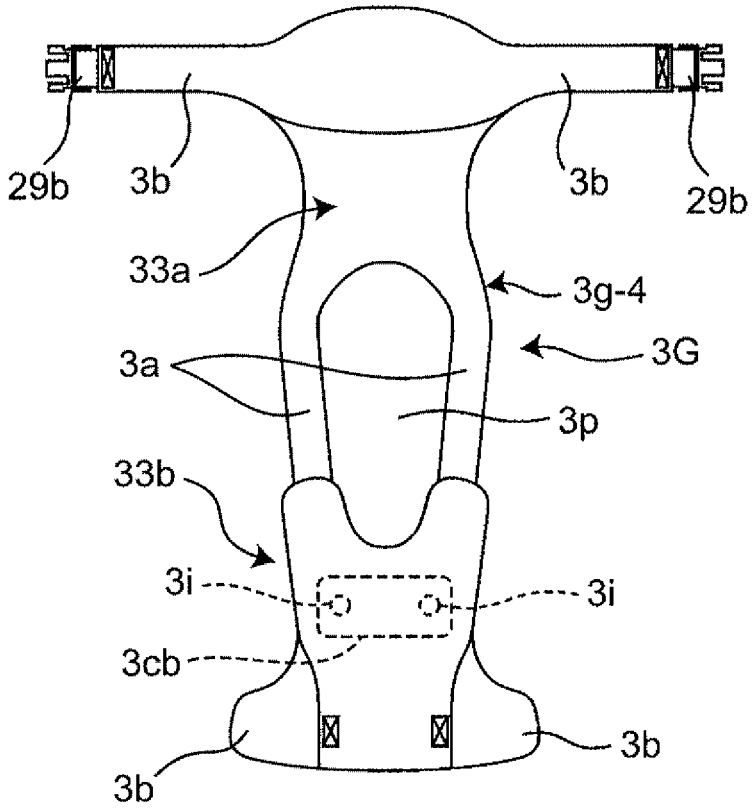
FIG. 21C is a diagram illustrating a back surface (an inner surface) of the care belt according to the modification shown in FIG. 21A in the state in which the care belt is developed.

A modification of a care belt 3G according to the present disclosure is illustrated in FIG. 21A to FIG. 21C. In this example, a connector 3c of the care belt 3G includes a first connector 3ca and a second connector 3cb. The first connector 3ca is located on a chest 7d of a care receiving person 7, and connected to both or one of a first holder 3a and a second holder 3b of a holding mechanism 3g-4. The first connector 3ca is made of a soft material such as urethane. The second connector 3cb is made of a plate-shaped hard core material inside the first connector 3ca and is capable of removably connected to a connector 4g of the pulling mechanism. In FIG. 21B, an upper part 33a is to be placed on a back of the care receiving person 7, and a lower part 33b is to be placed on a chest of the care receiving person 7.

The care belt 3G configured in the above-described manner is worn such that a neck part 7a of the care receiving person 7 is passed through a hole 3p between a pair of first holders 3a. Thereafter, single-touch buckles 29b, disposed on respective sides of a second holder 3b located on the back, are moved to the front of the care receiving person 7 and removably engaged with a front buckle 29a in front of the body of the care receiving person 7. When the care belt 3G is worn, the first holder 3a holds the neck part 7a and the back part 7b of the care receiving person 7, and the second holder 3b holds the lumbar part 7c of the care receiving person 7.

Figure 21D:
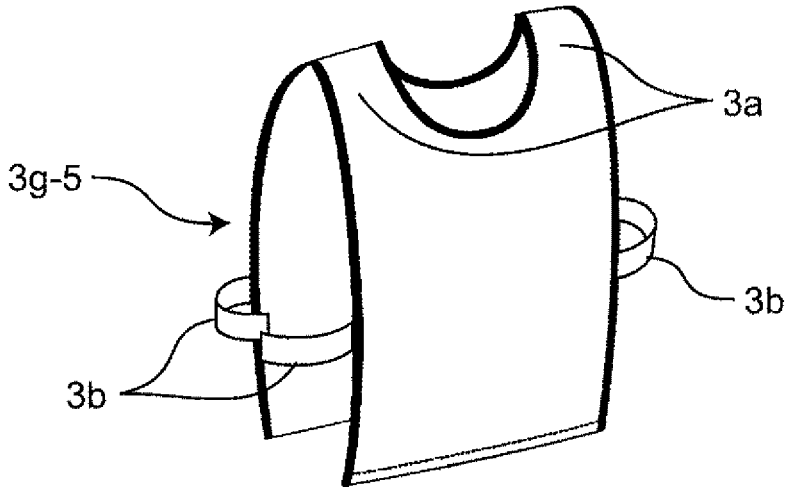
FIG. 21D is a perspective view illustrating a care belt according to another modification of the present disclosure.

FIG. 21D illustrates another modification of a holding mechanism 3g-5 of a care belt 3 in the form of a number-cloth type jacket (such as a bibs-like jacket). Note that this example also falls within the scope of the care belt according to the present disclosure.

FIG. 22A to FIG. 22I illustrate an example of a main mechanism 2. In this example, a grab handle 15 is formed in a U-like shape using a flat plate with a length large enough for a care receiving person 7 to put his/her elbow on the grab handle 15. An input IF 6 operated by the care receiving person 7 is disposed on a connection part between a third arm 4e and a fourth arm 4f. On a front surface of the main mechanism 2, a caregiver input IF 6G operated by a caregiver is disposed together with a light emitting part 6H. A grab handle 15G with a circular-wheel shape for use by the caregiver is disposed close to the caregiver input IF 6G. To start an arm mechanism 4 of the main mechanism 2, a caregiver operates the input IF 6G for use by the caregiver. Note that the arm mechanism 4 of the main mechanism 2 can be started by the caregiver without the care receiving person 7 having to perform any operation. If the caregiver grabs the grab handle 15G for use by the caregiver and moves the walking mechanism 14 in a forward direction with reference to the care receiving person 7, then a pulling operation is performed to assist the care receiving person 7 to stand up from the sitting position. The light emitting part 6H turns on or blinks an LED or the like in response to the operation performed on the input IF 6G for use by the caregiver or the input IF 6 to indicate a state such as an on/off state of the power, a driving state of the arm mechanism 4, a moving timing of the walking mechanism 14, or the like.

The care belt according to the present disclosure may be used for a purpose other than the purpose for assisting a care receiving person with a weakened muscle strength. For example, it is possible not only to assist a care receiving person with a weakened muscle strength, the care belt may be worn as a supporter by a normal adult person who carries a heavy thing to assist him/her to stand up.

The robot 20 may be configured and the arm mechanism 4 may be controlled as described below.

For example, as illustrated in FIG. 1A, FIG. 8, and FIG. 21A to FIG. 21C, the robot 20 may include an arm mechanism 4 connected to a connector 3c (the connector 3c may include a first connector 3ca and a second connector 3cb) included in the care belt 3G serving as the supporter worn by a care receiving person 7 such that the arm mechanism 4 is capable of moving the connector 3c in the x-axis direction and/or the z-axis direction. For example, as illustrated in FIG. 8, the x-axis and the z-axis may be parallel to a virtual plane in which an arm included in the arm mechanism 4 operates, the x-axis and the z-axis may be perpendicular to each other, and the z-axis may be perpendicular to a surface (for example, a floor 13) on which the robot 20B is installed, in which the z-axis is defined so as to be positive in a direction toward the robot 20B from the surface (for example, the floor 13) on which the robot 20B is installed, and the x-axis is defined so as to be positive in a direction from a leading end (a connector 4g) of the arm mechanism 4 toward the connector 3c.

The operation information database 8 may store data such as that shown in FIG. 5B. The data shown in FIG. 5B represents a position at which the leading end of the arm mechanism 4 is to be located at time ti, that is, the data represents target coordinate values pi(Xi, Zi).

The robot 20 may include a control apparatus 11 that controls the arm mechanism 4 based on the data representing the time (the time shown in FIG. 5B) and the target coordinate values (the position shown in FIG. 5B) at that time stored in the operation information database 8.

Figure 5C:
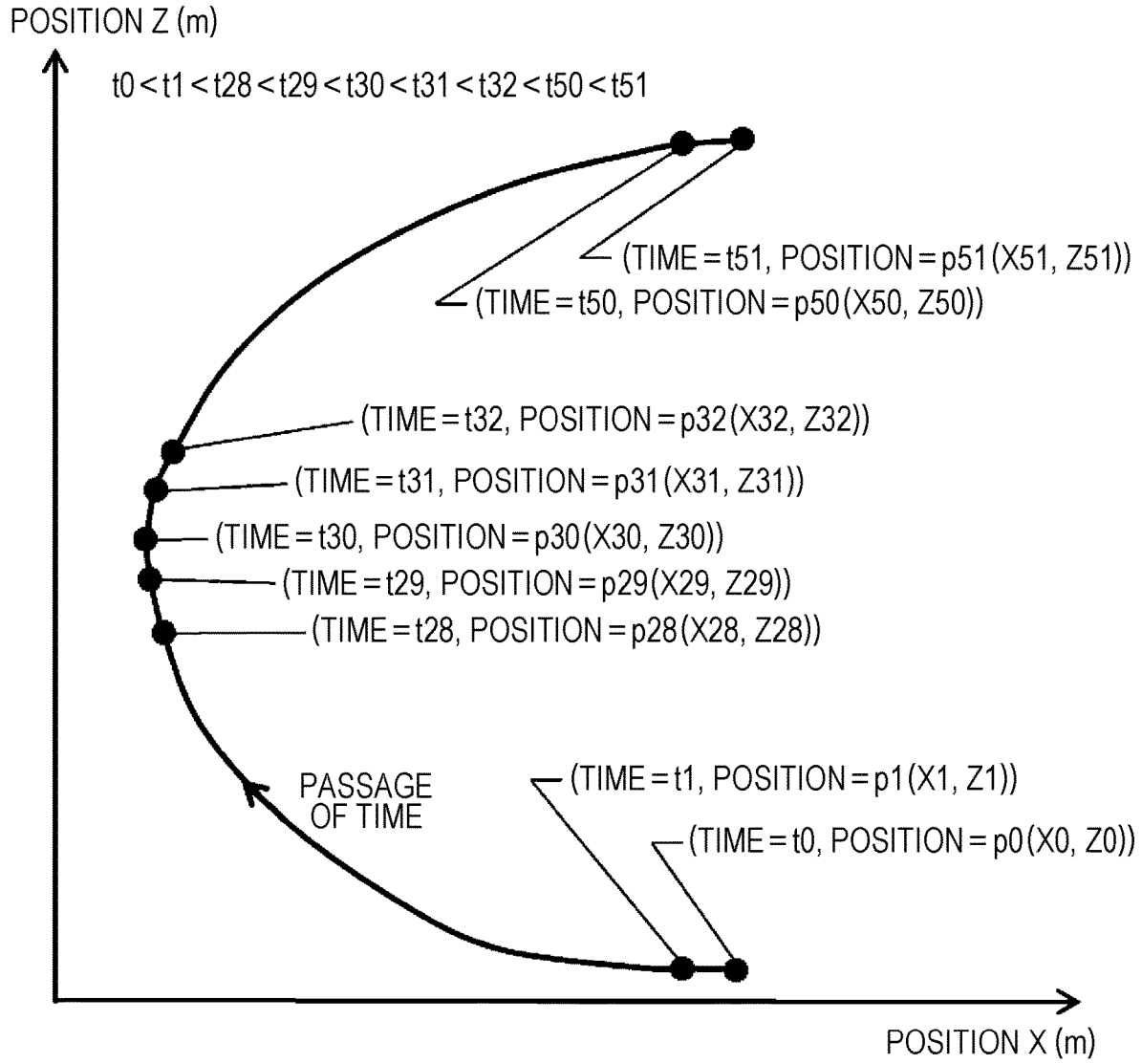
FIG. 5C is a diagram illustrating target coordinate values according to the modification of the present disclosure.

As illustrated in FIG. 5B and FIG. 5C, when the time is in a period from t0 to t51, the z-axis coordinate value of the target coordinate values increases. When the time is in a period from t0 to t30, the x-axis coordinate value of the target coordinate values decreases. When the time is in a period from t30 to t51, the x-axis coordinate value of the target coordinate values increases. Note that t0<t1<t28<t29<t30<t31<t32<t50<t51.

The control apparatus 11 controls the robot 20 based on the data shown in FIG. 5B such that the connector 3*c* moves in a forward and upward direction with reference to a user in a period from time t0 to t30 and thereafter, in a period time t30 to t51, the connector 3*c* moves in a backward and upward direction with reference to the user. That is, a user wearing the supporter including the connector 3*c* receives an assist from the robot 20 in moving in a forward and upward direction in a period time t0 to t30 and thereafter, in a period time t30 to t51, the user wearing the supporter including the connector 3*c* receives an assist from the robot 20 in moving in a backward and upward direction with reference to the user. Time t0 may be a standing-up assist operation start time, and t51 may be a standing-up assist operation end time.

The care belt 3G serving as the supporter may be configured as follows.

Figure 21E:
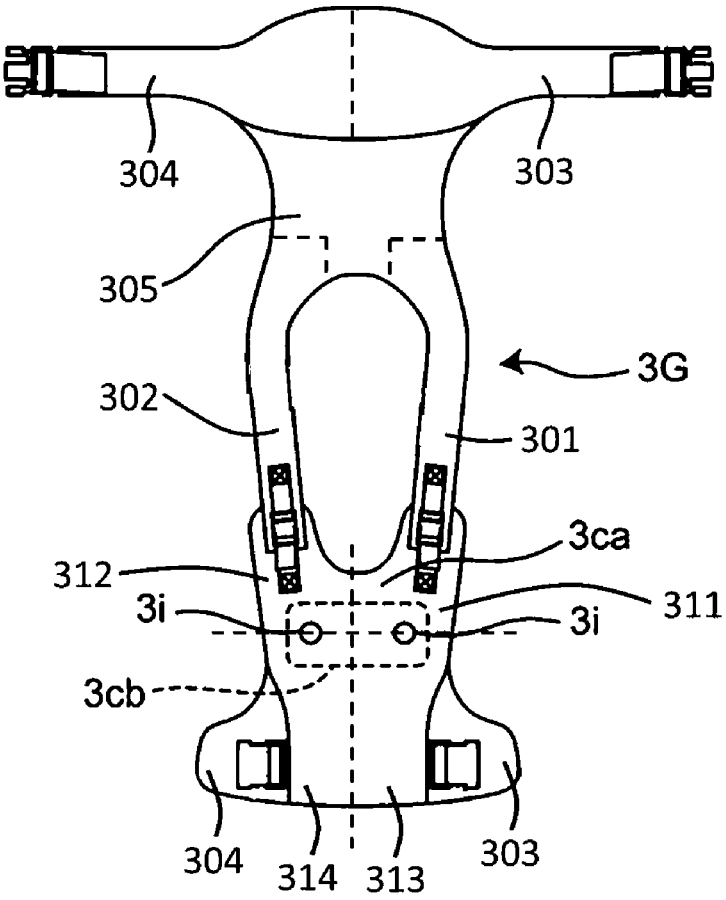
FIG. 21E is a diagram illustrating a surface (an external surface) of the care belt according to the modification shown in FIG. 21A in a state in which the care belt is developed.
Figure 22A:
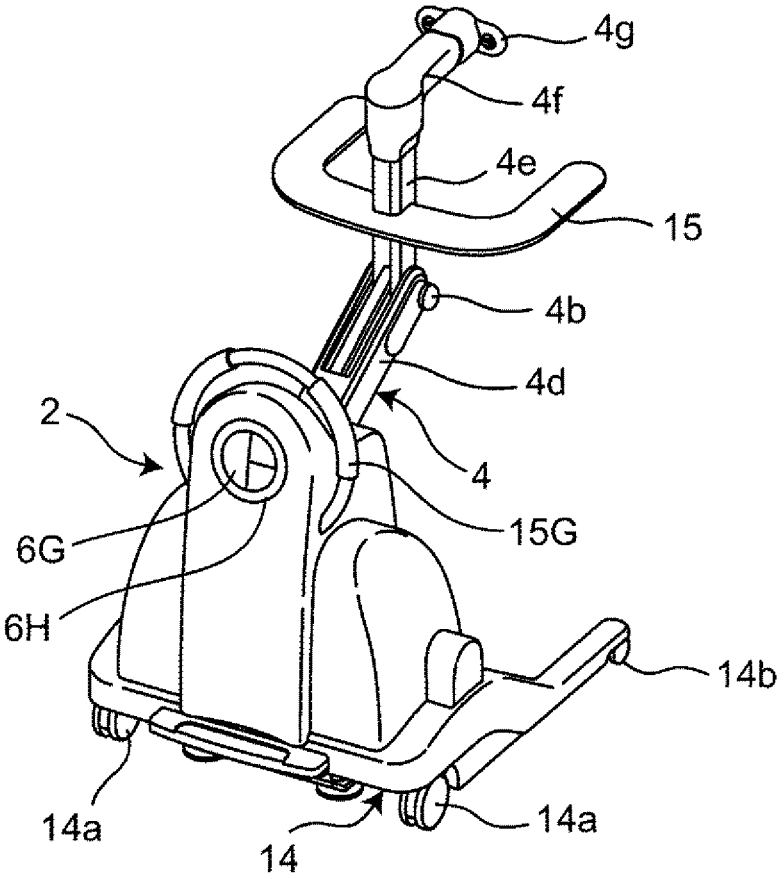
FIG. 22A is a perspective view illustrating a main mechanism according to another modification of the present disclosure.
Figure 22B:
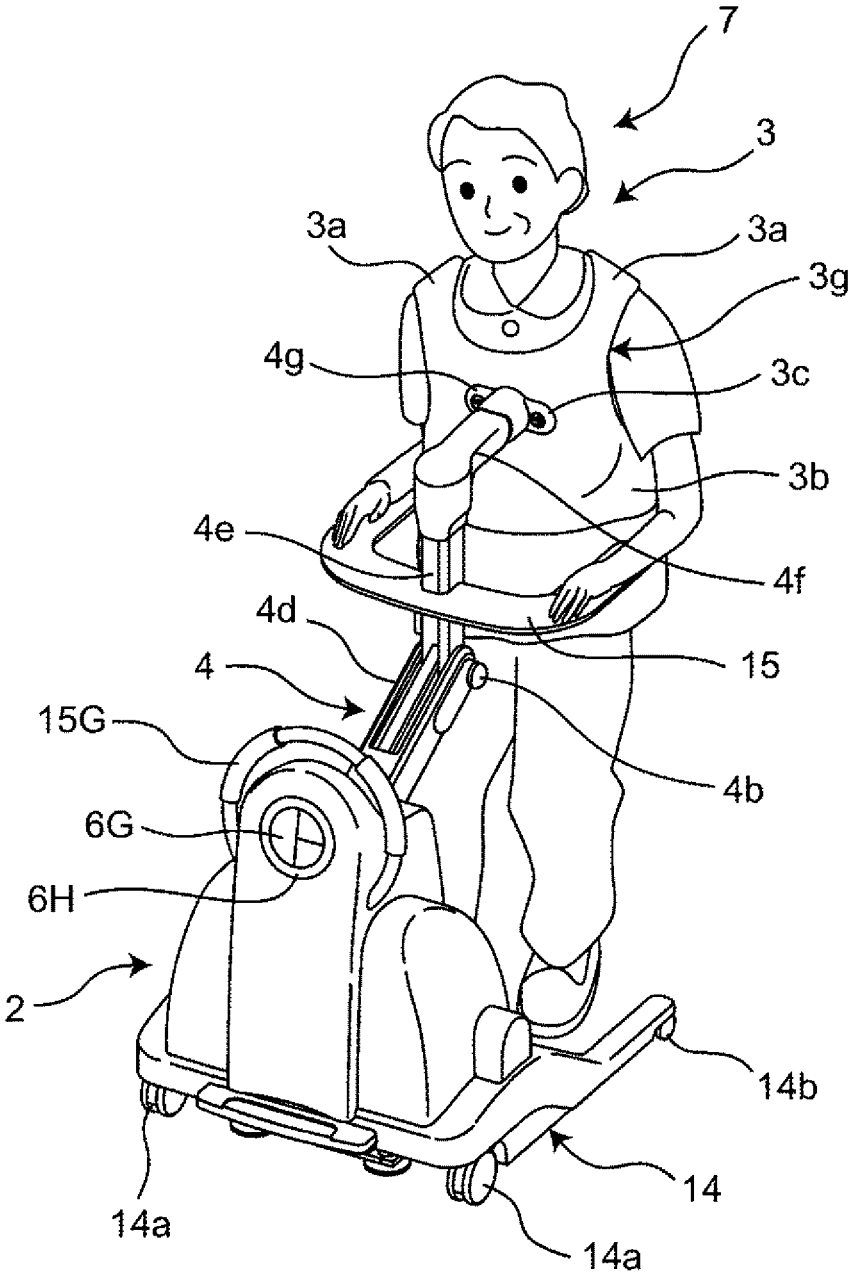
FIG. 22B is a perspective view illustrating a main mechanism according to a modification of the FIG. 22A.
Figure 22C:
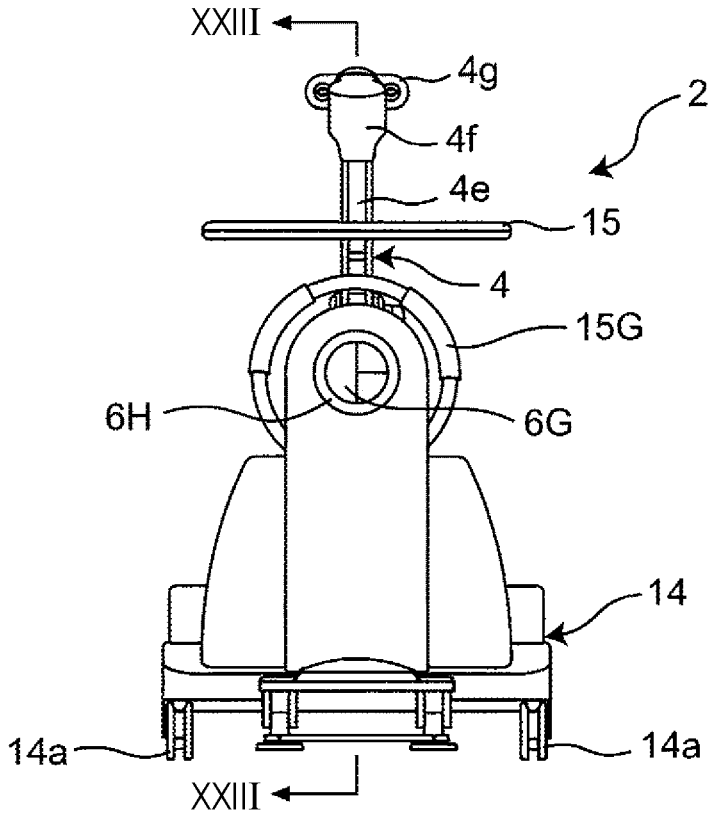
FIG. 22C is a front view illustrating the main mechanism according to the modification of the FIG. 22A.
Figure 22D:
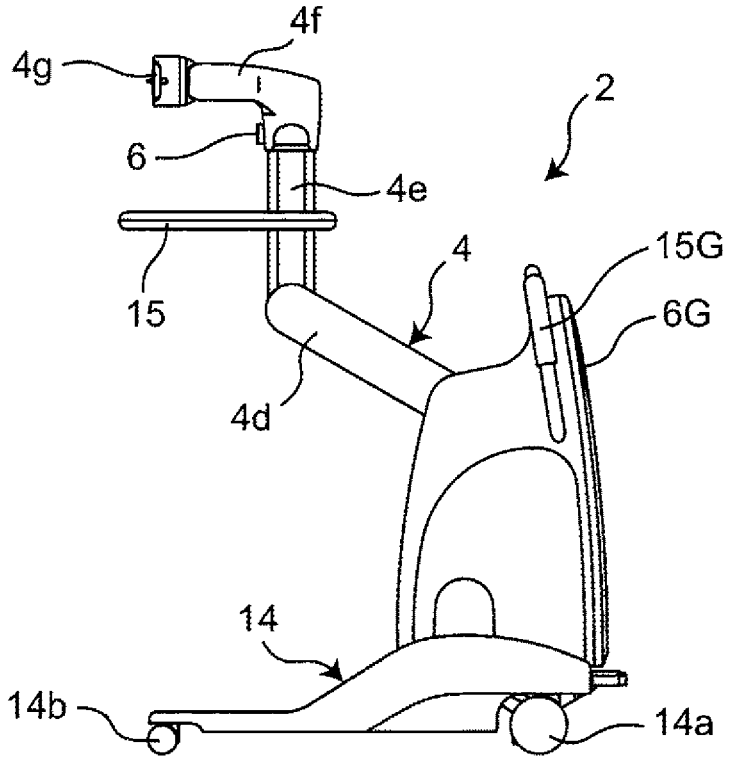
FIG. 22D is a left-side view illustrating the main mechanism according to the modification of the FIG. 22A.
Figure 22E:
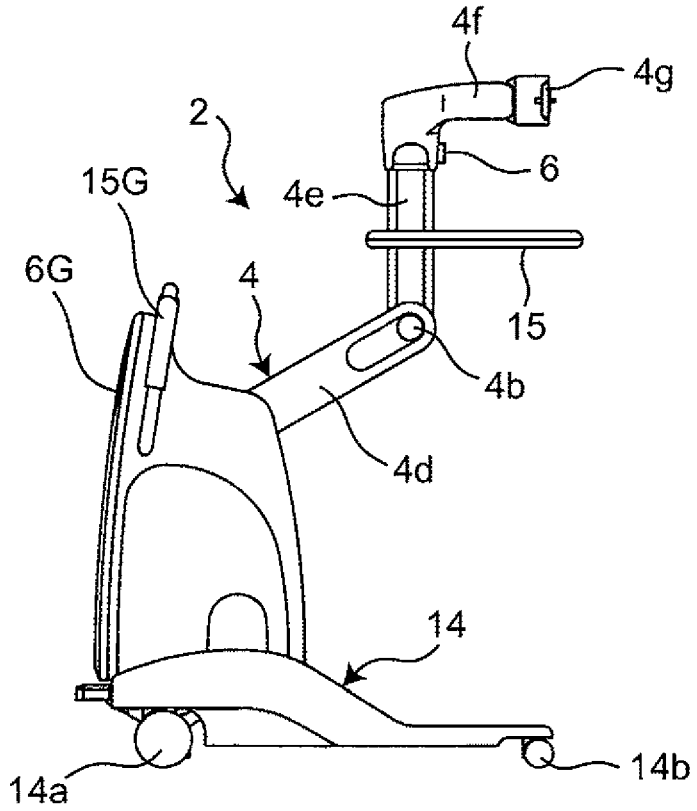
FIG. 22E is a right-side view illustrating the main mechanism according to the modification of the FIG. 22A.
Figure 22F:
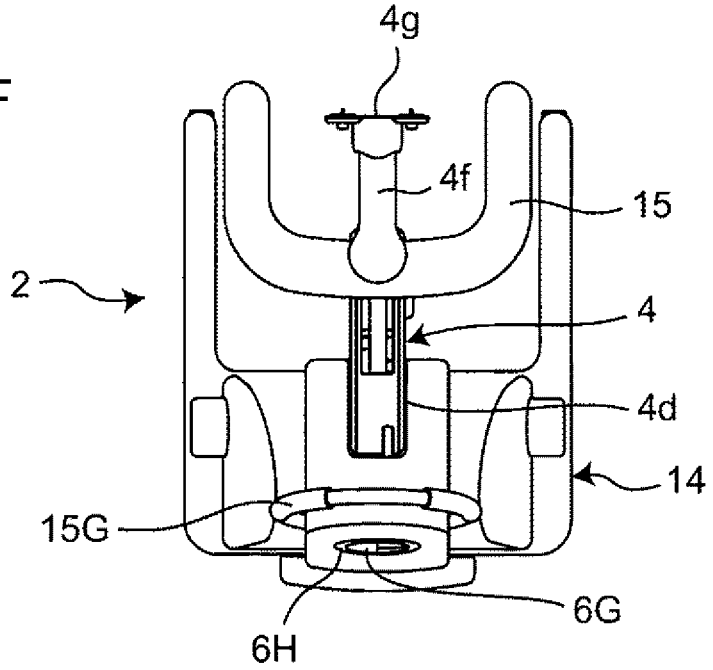
FIG. 22F is a plan view illustrating the main mechanism according to the modification of the FIG. 22A.
Figure 22G:
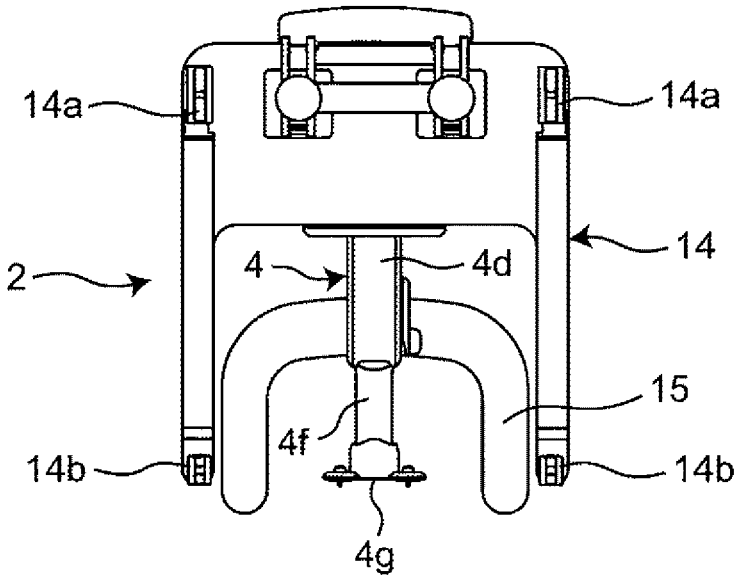
FIG. 22G is a bottom view illustrating the main mechanism according to the modification of the FIG. 22A.
Figure 22H:
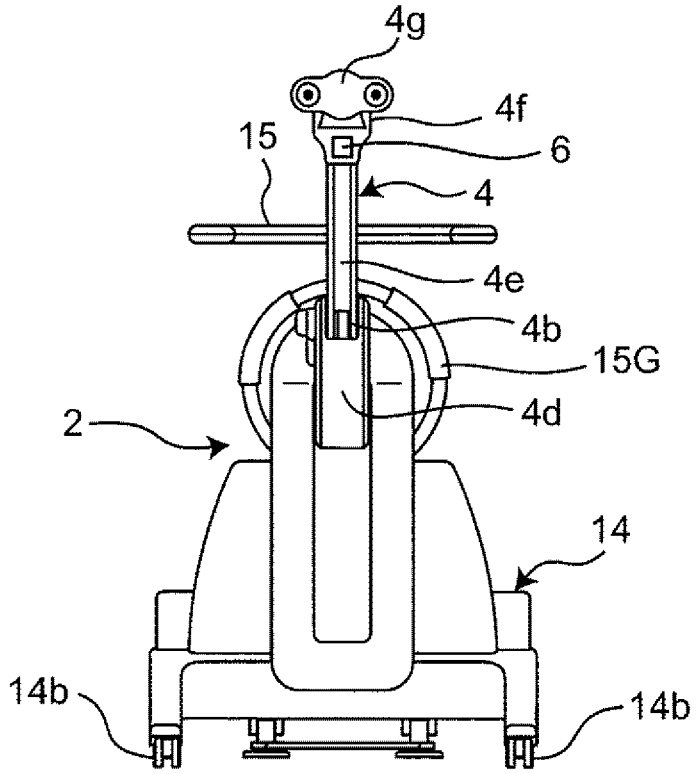
FIG. 22H is a rear view illustrating the main mechanism according to the modification of the FIG. 22A.
Figure 22I:
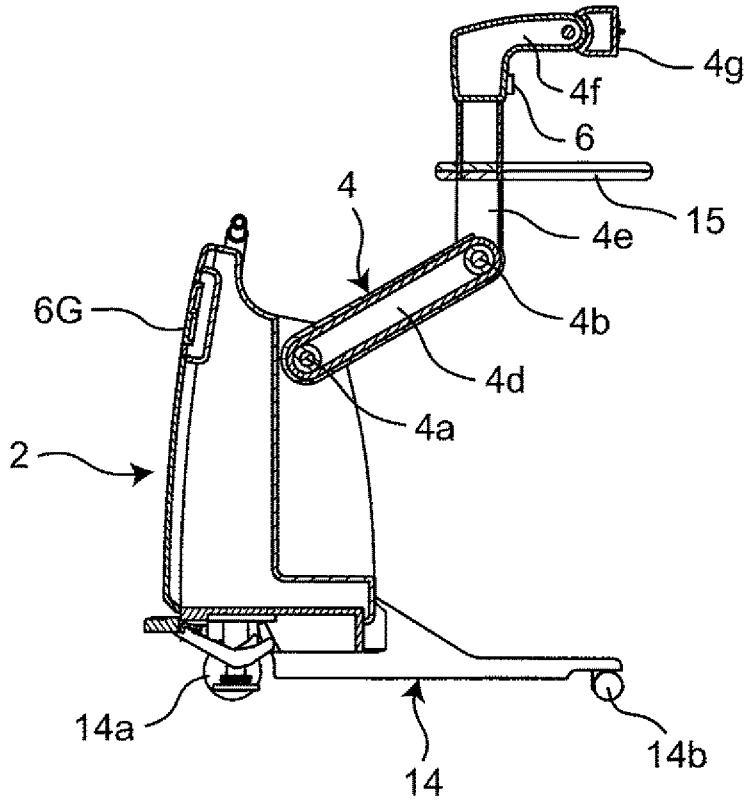
FIG. 22I is a cross-sectional view taken along line XXIII-XXIII of FIG. 22C.

As illustrated in FIG. 21E, the care belt 3G (supporter) may include a left shoulder part 301 including a part to be put along a left shoulder of a user wearing the supporter, a right shoulder part 302 including a part to be put along a right shoulder of the user wearing the supporter, a left lumbar part 303 including a part to be put along a left lumbar of the user wearing the supporter, a right lumbar part 304 including a part to be put along a right lumbar of the user wearing the supporter, a connection region 305 connected to the left shoulder part 301, the right shoulder part 302, the left lumbar part 303, and the right lumbar part 304 and including a part to be put along a back of the user wearing the supporter, and a connector 3*c* (the connector 3*c* may include a first connector 3*ca* and a second connector 3*cb*).

For example, the connector 3*c* may be connected to the leading end of the arm mechanism 4 via buckles 3*i* included in the connector 3*cb*. A line extending between centers of the respective buckles 3*i* defines a line (a pulling line) along which the arm mechanism 4 applies a force in the x-axis direction.

The connector 3*c* may be connected, at an upper left part 311 of the connector 3*c* (above the pulling line and on a right side to a symmetry center line of the connector 3*c* as seen in the figure), to the left shoulder part 301, the connector 3*c* may also be connected, at an upper right part 312 of the connector 3*c* (above the pulling line and on a left side to the symmetry center line of the connector 3*c* as seen in the figure), to the right shoulder part 302, the connector 3*c* may also be connected, at a lower left part 313 of the connector 3*c* (below the pulling line and on the right side to the symmetry center line of the connector 3*c* as seen in the figure), to the left lumbar part 303, and the connector 3*c* may also be connected, at a lower right part 314 of the connector 3*c* (below the pulling line and on the right side to the symmetry center line of the connector 3*c* as seen in the figure), to the right lumbar part 304.

That is, the connector 3*c* is connected to the left shoulder part 301, the right shoulder part 302, the left lumbar part 303, and the right lumbar part 304. When a user wears the supporter, the user is located between the connector 3*c* and the connection region 305.

The present disclosure has been described above with reference to the first to third embodiments and examples of modifications thereto. However, the present disclosure is not limited to the first to third embodiments and the examples of modifications thereto, and further embodiments are possible. Some examples of further embodiments are described below.

In each embodiment described above, any part of the control apparatus 11 or 11B may be implemented by software. That is, steps of control operations according to any embodiment may be described as a computer program, and the computer program may be stored in a storage medium such as a storage apparatus (for example, a hard disk or the like) in a readable manner. The computer program may be loaded into a temporary storage apparatus (for example, a semiconductor memory or the like) of a computer and may be executed on the computer thereby performing each step described above.

More specifically, all or part of each control apparatus may be a computer system including a microprocessor, a ROM, a RAM, a hard disk unit, a display unit, a keyboard, a mouse and/or the like. The computer program may be stored in the RAM or the hard disk unit. The microprocessor may operate according to the computer program so as to achieve functions of respective units or parts. The computer program may include a plurality of instruction codes indicating instructions to be executed by the computer to achieve the functions.

For example, each constituent element may be realized by reading the software program stored in the storage medium such as a hard disk, a semiconductor memory, or the like and executing the program by a program execution unit such as a CPU or the like. The software that realizes all or part of elements of a control apparatus according to one of the embodiments or the modifications thereto may be a program, for example, such as that described below. That is, in an aspect, the program may be a program for a controller of a standing-up motion assist system including a care belt including a first holder that holds a neck part or a back part of a care receiving person, a second holder that holds a lumbar part of the care receiving person, a third holder that connects the first holder and the second holder and holds armpits of the care receiving person, and a first connector which includes a second connector located at a chest of the care receiving person and which connects, in front of the care receiving person, the first holder and the second holder, a pulling mechanism which is connected to the second connector and which pulls the second connector, and the controller that controls the pulling operation of the pulling mechanism, the program causing the controller to control the pulling mechanism to pull the second connector in a forward and upward direction with reference to the care receiving person, and thereafter causing the controller to control the pulling mechanism to pull the second connector in a backward and upward direction with reference to the care receiving person.

In another aspect, the program may be a program for a controller of a standing-up motion assist system including a care belt capable of being worn by a care receiving person and including a holding mechanism including a first holder capable of holding a first region of a neck part or a back part of the care receiving person, a second holder capable of holding a second region of a lumbar part of the care receiving person, and a connector capable of being located close to a chest of the care receiving person and including a connector connected to the holding mechanism, and a pulling mechanism that is connected to the holding mechanism via the connector and that performs a pulling operation so as to pull the care belt in a forward direction with reference to the care receiving person such that buttocks of the care receiving person move away from the sitting position, the program causing a computer to execute a step of controlling the pulling operation of the care belt performed by the pulling mechanism such that the care receiving person is pulled in the forward direction in the first phase in which the buttocks of the care receiving person in the sitting position move away from the seat.

The program may be downloaded from a server or the like and executed, or may be read out from a storage medium (for example, an optical disk such as a CD-ROM or the like, a magnetic disk, a semiconductor memory, or the like) and executed.

There is no particular restriction on the number of computers that execute the program. That is, the program may be executed by a single computer or a plurality of computers.

One or more of the aspects and/or the modifications may be properly combined to achieve effects provided by the respective aspects or the modifications.

Two or more of the aspects may be combined or two or more of embodiments may be combined. One or more of the aspects and one or more of the embodiments may be combined. Features of different aspects of embodiments may be combined.

The standing-up motion assist system, the method for the controller of the standing-up motion assist system, the program for the controller of the standing-up motion assist system, the care belt, and the robot may be applied as a standing-up motion assist system for assisting a care receiving person to stand up or walk, a method for a controller of such a standing-up motion assist system, a program for a controller of such a standing-up motion assist system, a care belt in such a standing-up motion assist system, and a robot in such a standing-up motion assist system.

What is claimed is:

1. A standing-up motion assist system that assists a standing-up motion of a care receiving person, the standing-up motion assist system comprising:

a care belt including a first holder that holds a neck part or a back part of the care receiving person, a second holder that holds a lumbar part of the care receiving person, a third holder that connects the first holder and the second holder and holds armpits of the care receiving person, a first connector that connects, in front of the care receiving person, the first holder and the second holder, and a second connector that is located at a chest of the care receiving person;

a pulling mechanism that is connected to the second connector and that pulls the second connector; and a controller that controls the pulling mechanism such that the pulling mechanism pulls the second connector in a forward and upward direction with reference to the care receiving person, and, thereafter, the pulling mechanism pulls the second connector in a backward and upward direction with reference to the care receiving person.

2. The standing-up motion assist system according to claim 1, wherein the controller controls the pulling mechanism such that a pulling speed of the pulling mechanism is increased when the pulling mechanism is pulling the second connector in the forward and upward direction with reference to the care receiving person.

3. The standing-up motion assist system according to claim 1, wherein the first holder holds the neck part, the chest, and sides of a torso in a direction from a back to a front of a body of the care receiving person, and the second holder holds the back part via the sides of the torso.

4. The standing-up motion assist system according to claim 2, wherein the first holder holds the neck part, the chest, and sides of a torso in a direction from a back to a front of a body of the care receiving person, and the second holder holds the back part via the sides of the torso.

5. The standing-up motion assist system according to claim 1, wherein the pulling mechanism includes a walking mechanism including a pair of front wheels and a pair of back wheels.

6. The standing-up motion assist system according to claim 1, wherein the pulling mechanism includes an arm mechanism including a plurality of joints, and wherein the standing-up motion assist system further includes a force acquirer that acquires information about a force applied to the arm mechanism from the outside, a position acquirer that acquires information about a position of the arm mechanism, and an operation information generator that generates operation information about the arm mechanism from the information about the force acquired by the force acquirer and the information about the position acquired by the position acquirer, and wherein the controller controls an operation of the arm mechanism based on the operation information generated by the operation information generator.

7. The standing-up motion assist system according to claim 6, wherein the operation information generator generates the operation information such that when the controller is controlling the pulling mechanism so as to pull the second connector in the forward and upward direction with reference to the care receiving person, the operation information generator calculates a difference between a first force at a first time acquired by the force acquirer and a second force at a second time acquired by the force acquirer earlier than the first time, and in a case where an absolute value of the force, acquired by the force acquirer after a sign of the difference between the first force and the second force is inverted, is equal to or greater than a threshold value, the operation information generator generates the operation information that causes a pulling speed, at which the arm mechanism pulls the second connector in an upward direction, to be increased compared to the pulling speed as of when the sign of the difference is not yet inverted.

8. The standing-up motion assist system according to claim 6, wherein the operation information generator generates the operation information such that when the controller is controlling the pulling mechanism so as to pull the second connector in the forward and upward direction with reference to the care receiving person, the operation information generator calculates a difference between a first force at a first time acquired by the force acquirer and a second force at a second time acquired by the force acquirer earlier than the first time, and the operation information generator generates the operation information that causes a pulling speed, at which the arm mechanism pulls the second connector in an upward direction, to be increased as an absolute value of the force, acquired by the force acquirer after a sign of the difference between the first force and the second force is inverted, increases.

9. The standing-up motion assist system according to claim 1, wherein one of the pulling mechanism and the second connector includes a buckle, and another one of the pulling mechanism and the second connector includes a buckle receiver, and wherein the buckle and the buckle receiver are removably connected to each other.

10. A control method for a controller of a standing-up motion assist system, the standing-up motion assist system including a care belt including a first holder that holds a neck part or a back part of a care receiving person, a second holder that holds a lumbar part of the care receiving person, a third holder that connects the first holder and the second holder and holds armpits of the care receiving person, a first connector that connects, in front of the care receiving person, the first holder and the second holder, and a second connector that is located at a chest of the care receiving person, a pulling mechanism that is connected to the second connector and that pulls the second connector, and the controller that controls a pulling operation of the pulling mechanism, the control method comprising:

causing the controller to control the pulling mechanism to pull the second connector in a forward and upward direction with reference to the care receiving person; and thereafter causing the controller to control the pulling mechanism to pull the second connector in a backward and upward direction with reference to the care receiving person.

11. A non-transitory computer-readable recording medium storing a program for a controller of a standing-up motion assist system, the standing-up motion assist system including a care belt including a first holder that holds a neck part or a back part of a care receiving person, a second holder that holds a lumbar part of the care receiving person, a third holder that connects the first holder and the second holder and holds armpits of the care receiving person, a first connector that connects, in front of the care receiving person, the first holder and the second holder, and a second connector that is located at a chest of the care receiving person, a pulling mechanism that is connected to the second connector and that pulls the second connector, the controller that controls a pulling operation of the pulling mechanism, the program comprising:

causing the controller to control the pulling mechanism to pull the second connector in a forward and upward direction with reference to the care receiving person; and thereafter causing the controller to control the pulling mechanism to pull the second connector in a backward and upward direction with reference to the care receiving person.

* * * * *